US010618730B2

(12) United States Patent
Manssourian

(10) Patent No.: US 10,618,730 B2
(45) Date of Patent: Apr. 14, 2020

(54) RETAINER MECHANISM

(71) Applicant: Grigooris Manssourian, Glendale, CA (US)

(72) Inventor: Grigooris Manssourian, Glendale, CA (US)

( * ) Notice: Subject to any disclaimer, the term of this patent is extended or adjusted under 35 U.S.C. 154(b) by 945 days.

(21) Appl. No.: 15/057,941

(22) Filed: Mar. 1, 2016

(65) Prior Publication Data

US 2016/0257491 A1 Sep. 8, 2016

Related U.S. Application Data

(60) Provisional application No. 62/127,224, filed on Mar. 2, 2015.

(51) Int. Cl.
*B65F 1/16* (2006.01)

(52) U.S. Cl.
CPC ..... *B65F 1/1615* (2013.01); *Y10S 292/22* (2013.01); *Y10T 292/094* (2015.04); *Y10T 292/0937* (2015.04); *Y10T 292/0941* (2015.04); *Y10T 292/1063* (2015.04); *Y10T 292/1064* (2015.04); *Y10T 292/1069* (2015.04); *Y10T 292/20* (2015.04); *Y10T 292/228* (2015.04); *Y10T 292/28* (2015.04); *Y10T 292/34* (2015.04)

(58) Field of Classification Search
CPC ..... B65F 1/1615; B65F 1/16; B65F 1/1623; Y10T 24/1016; Y10T 292/1063; Y10T 292/1064; Y10T 292/1069; Y10T 292/0937; Y10T 292/094; Y10T 292/0941; Y10T 292/20; Y10T 292/228; Y10T 292/28; Y10T 292/34
USPC ..... 292/130, 131, 134, 136, 230, 231, 236, 292/238, 256, 258, 262, 288, DIG. 22; 220/315, 317, 318; 16/349
See application file for complete search history.

(56) References Cited

U.S. PATENT DOCUMENTS

| | | | | |
|---|---|---|---|---|
| 74,367 A | | 2/1868 | Hurd | A44B 11/12 24/163 R |
| 203,817 A | | 5/1878 | Brock | B65F 1/1623 220/828 |
| 1,639,870 A | * | 8/1927 | Valsvig | B65D 45/16 16/109 |
| 2,531,503 A | | 11/1950 | Dick | A24F 19/06 220/264 |
| 3,662,435 A | * | 5/1972 | Allsop | A43C 11/1413 24/70 SK |
| 3,893,725 A | | 7/1975 | Coulter | B65D 45/02 220/318 |
| 3,980,202 A | | 9/1976 | Monyak et al. | |

(Continued)

FOREIGN PATENT DOCUMENTS

| | | | |
|---|---|---|---|
| DE | 3028233 A1 | 2/1982 | B65F 1/1436 |

OTHER PUBLICATIONS

U.S. Appl. No. 14/247,094, filed Apr. 7, 2014; File HIstory up to Feb. 14, 2017.

(Continued)

*Primary Examiner* — Kristina R Fulton
*Assistant Examiner* — Faria F Ahmad
(74) *Attorney, Agent, or Firm* — Peter Ganjian; Patent Law Agency, LLC

(57) ABSTRACT

The present invention discloses a retainer mechanism that may be associated with a bin or a lid of the bin to maintain lid in a closed (latched) position in relation to the bin.

28 Claims, 48 Drawing Sheets

(56) References Cited

U.S. PATENT DOCUMENTS 4,136,422 A * 1/1979 Ivanov ..... A44B 11/125 24/170
4,182,530 A 1/1980 Hodge
4,229,862 A * 10/1980 Kubelka ..... A43C 11/1406 24/170
4,326,320 A * 4/1982 Riedel ..... A43C 11/008 24/70 SK
4,371,092 A 2/1983 Teague
4,395,801 A * 8/1983 Gabrielli ..... A43C 11/1413 24/70 SK
4,413,851 A 11/1983 Ritter
4,453,290 A * 6/1984 Riedel ..... A43C 11/1406 24/68 SK
4,547,980 A * 10/1985 Olivieri ..... A43C 11/1413 24/269
4,549,770 A * 10/1985 Kurtti ..... B60R 22/1855 24/136 K
4,639,978 A * 2/1987 Boden ..... F16G 11/101 24/132
4,660,889 A * 4/1987 Anthony ..... A44B 11/14 24/68 CD
4,683,620 A * 8/1987 Valsecchi ..... A43C 11/1406 24/593.11
4,796,337 A * 1/1989 Marxer ..... A43C 11/1413 24/68 SK
4,869,697 A 9/1989 Ackert ..... B63B 35/812 24/134 R
4,942,647 A * 7/1990 Wallner ..... A44B 11/125 24/170
4,955,501 A 9/1990 Hodge
4,976,371 A 12/1990 Wise ..... B65D 45/02 220/315
5,102,001 A 4/1992 Teague et al.
5,118,000 A 6/1992 Howell et al.
5,297,692 A 3/1994 Kronmiller
5,373,959 A 12/1994 Haasewinkel
5,416,952 A * 5/1995 Dodge ..... A43C 11/00 24/68 A
5,572,747 A * 11/1996 Cheng ..... A44B 11/12 2/312
5,599,050 A 2/1997 Tinsley
5,606,779 A * 3/1997 Lu ..... A43C 11/146 24/68 SK
5,642,555 A * 7/1997 Lin ..... A43C 11/1413 24/68 SK
5,669,122 A * 9/1997 Benoit ..... A43C 11/146 24/70 SK
5,738,395 A 4/1998 Probst ..... B65F 1/1615 220/315
5,745,959 A * 5/1998 Dodge ..... A43C 11/00 24/68 SK
5,745,963 A * 5/1998 Graziano ..... A43B 1/0072 24/68 SK
5,772,264 A 6/1998 Bettenhausen ..... B65F 1/1615 292/130
5,779,259 A * 7/1998 Lin ..... A43C 11/1413 24/68 SK
5,832,569 A * 11/1998 Berg ..... A44B 11/12 24/170
5,852,852 A * 12/1998 Rigal ..... A44B 11/14 24/68 R
5,887,318 A * 3/1999 Nicoletti ..... A43C 11/1413 24/68 SK
5,909,850 A * 6/1999 Cavasin ..... A43C 11/1413 24/70 SK
5,920,963 A * 7/1999 Chou ..... F16G 11/106 24/170
5,927,744 A * 7/1999 Knapschafer ..... A63C 10/06 280/14.22
6,175,994 B1 * 1/2001 Nicoletti ..... A43C 11/1413 24/68 SK
6,290,093 B1 9/2001 Obriot ..... B65F 1/1615 220/324
6,374,464 B1 * 4/2002 Lai ..... A43C 11/1406 24/68 SK
6,381,810 B2 * 5/2002 Hsieh ..... A44B 11/06 24/170
6,543,096 B2 * 4/2003 Settelmayer ..... A44B 11/12 24/170
6,554,297 B2 * 4/2003 Phillips ..... A43C 11/1413 24/68 SK
6,560,825 B2 * 5/2003 MacIejczyk ..... A44B 11/14 24/170
6,666,485 B1 * 12/2003 Moret ..... B65F 1/1615 220/315
6,694,644 B2 * 2/2004 Haupt ..... A43C 11/1413 36/50.5
6,748,630 B2 * 6/2004 Livingston ..... A43C 11/1406 24/68 R
6,802,550 B1 10/2004 Griggs, Jr. ..... B60N 2/4686 292/136
6,868,587 B2 3/2005 Rard ..... A44B 11/125 24/170
6,880,717 B1 * 4/2005 O'Conor ..... B65F 1/1615 220/315
6,902,080 B2 6/2005 Busch
6,902,081 B2 6/2005 Walker
7,117,569 B2 * 10/2006 Bledsoe ..... A41F 1/008 24/593.11
7,334,301 B2 * 2/2008 Huang ..... B60P 7/0823 24/170
7,343,650 B2 * 3/2008 Baldwin ..... A44B 11/14 24/503
7,506,413 B2 * 3/2009 Dingman ..... B60R 22/20 24/170
7,506,902 B2 3/2009 Sheng ..... G03G 21/1666 16/221
7,712,191 B2 * 5/2010 Huang ..... A44B 11/065 24/170
7,877,845 B2 * 2/2011 Signori ..... F16B 2/08 24/68 SK
D634,912 S 3/2011 Pouliot et al.
8,096,065 B2 * 1/2012 Marechal ..... A43C 11/1433 24/70 SK
8,327,507 B2 * 12/2012 Eisinger ..... B60N 2/2812 24/168
8,459,487 B2 * 6/2013 Sharma ..... B65F 1/1615 220/315
8,689,364 B2 * 4/2014 Rowland ..... A41F 9/025 2/311
8,763,209 B2 * 7/2014 Kavarsky ..... A43C 11/1413 24/68 SK
8,763,210 B2 * 7/2014 Vincent ..... A43B 5/04 24/68 SK
8,763,211 B1 * 7/2014 Yu ..... B60P 7/0823 24/191
8,869,354 B2 * 10/2014 Horimoto ..... A42B 3/08 24/69 ST
8,935,833 B2 1/2015 Kaneko ..... A44B 11/12 24/170
9,010,824 B2 * 4/2015 Hayes ..... B65G 7/12 294/150
9,145,244 B2 * 9/2015 Nakajima ..... F16B 2/08
9,332,798 B2 * 5/2016 Gafforio ..... A42B 3/08
9,346,429 B2 * 5/2016 Sutherland ..... B60R 21/02
9,351,539 B2 * 5/2016 Briggs ..... A43C 11/146
9,376,255 B2 6/2016 Banik ..... B65F 1/1615
9,856,079 B2 * 1/2018 Manssourian ..... B65F 1/1615
D809,241 S * 2/2018 Thayer ..... D2/627
2001/0022013 A1 * 9/2001 Hsieh ..... A44B 11/06 24/170
2002/0189056 A1 * 12/2002 Gallina ..... A44B 11/12 24/68 R
2003/0005556 A1 * 1/2003 Gallina ..... A43C 11/1406 24/68 SK
2003/0019080 A1 * 1/2003 Anthony ..... A44B 11/14 24/68 R

(56) References Cited

U.S. PATENT DOCUMENTS

| | | | | |
|---|---|---|---|---|
| 2003/0019081 | A1* | 1/2003 | Livingston | A43C 11/1406 24/68 R |
| 2004/0163216 | A1* | 8/2004 | Simonson | B60P 7/083 24/68 CD |
| 2007/0089945 | A1* | 4/2007 | Martignago | A43C 11/146 188/79.54 |
| 2007/0226958 | A1 | 10/2007 | Clifton, Jr. | A45F 5/02 24/3.12 |
| 2008/0010786 | A1* | 1/2008 | Huang | A44B 11/12 24/170 |
| 2008/0134480 | A1* | 6/2008 | Shiue | A44B 11/20 24/68 E |
| 2008/0169289 | A1 | 7/2008 | Dawn | |
| 2009/0050627 | A1 | 2/2009 | Shinault | |
| 2009/0151508 | A1* | 6/2009 | Signori | F16B 2/08 74/577 R |
| 2010/0102575 | A1 | 4/2010 | Ferkovich et al. | |
| 2010/0162539 | A1* | 7/2010 | Rancon | A43C 11/1453 24/70 ST |
| 2011/0197406 | A1* | 8/2011 | Couzyn | B63C 11/22 24/68 E |
| 2011/0209314 | A1* | 9/2011 | Miller | B60P 3/079 24/68 CD |
| 2012/0297591 | A1* | 11/2012 | Bozzetto | A43C 11/146 24/68 SK |
| 2014/0299602 | A1 | 10/2014 | Manssourian | |

OTHER PUBLICATIONS

Final Office Action and File History From Case U.S. Appl. No. 14/247,094, filed Aug. 10, 2017.

* cited by examiner

RETAINER MECHANISM

CROSS-REFERENCE TO RELATED APPLICATIONS

This application claims the benefit of priority of U.S. Utility Provisional Patent Application No. 62/127,224, filed 2 Mar. 2015, the entire disclosure of which is expressly incorporated by reference in its entirety herein.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention relates to a retainer mechanism and, more particularly, to a retainer mechanism for actively securing a lid (holding and maintaining content) of a container even if the container is overfilled and for passively (and automatically) self-releasing the lid to fully open when and as a result of the container appropriately tilted to a particular orientation for unhindered, unobstructed emptying of the container.

One or more embodiments of the present invention also relate to a retainer mechanism and, more particularly, to a retainer mechanism for actively securing a lid (holding and maintaining content) of a container only if the container lid may fully close over the container and for passively (and automatically) self-releasing the lid to fully open when and as a result of the container appropriately tilted to a particular orientation for unhindered, unobstructed emptying of the container.

Description of Related Art

Conventional retainer mechanisms that passively (and automatically) self-release (or unlatch) when and as a result of the appropriately tilting to a particular orientation are well known and have been in use for a number of years, a non-limiting example of which is disclosed in U.S. Patent Application Publication 2014/0299602 A1 to Grigooris MANSSOURIAN, the entire disclosures of which is expressly incorporated by reference in its entirety herein. Regrettably, known retainer mechanisms use too many parts, which adds to the overall complexity and cost of manufacturing.

Additionally, known retainer mechanisms require the use of webbing, which is comprised of material that is not reasonably appropriate for the environment within which it is used. That is, depending on the garbage (especially liquid trash or sludge), current webbing material from which the webbings may comprise of may create unsanitary condition, requiring constant cleaning. A further drawback with known retainer mechanisms is the mounting position of the retainer mechanism on the bin, which may interfere with known semi-automatic lift mechanisms.

Another drawback with most known retainer mechanisms is that in all instances, they secure the lid even if the bin is overfull. There are certain instances where it is desired or a requirement that the lid of the bin be fully closed and secured, without allowing the users the option of securing a lid when it is not in full contact with the rim of the bin.

Accordingly, in light of the current state of the art and the drawbacks to current retainer mechanism mentioned above, a need exists for a retainer mechanism that would allow for actively securing a lid (holding and maintaining content) of a container even if the container is overfilled and for passively (and automatically) self-releasing the lid to fully open when and as a result of the retainer mechanism appropriately titled to a particular orientation for unhindered, unobstructed emptying of the container. Further, a need exists for a retainer mechanism that would allow for actively securing a lid (holding and maintaining content) of a container only if the container is not overfilled and for passively (and automatically) self-releasing the lid to fully open when and as a result of the retainer mechanism appropriately titled to a particular orientation for unhindered, unobstructed emptying of the container. Additionally, a need exists for a retainer mechanism that would provide a quick and easy engagement of an adjusting mechanism with a retainer member, with the adjusting mechanism comprised of material that would not require constant cleaning. Further, a need exists for a retainer mechanism that would be adapted to be mounted at a position that would be universally acceptable for use for both full and semi automatic lift mechanisms. Additionally, a need exists for a retainer mechanism that would allow securing of a lid only if the lid is able to fully close in relation to bin.

BRIEF SUMMARY OF THE INVENTION

A non-limiting, exemplary aspect of an embodiment of the present invention provides a device, comprising:

- a retainer member that is associated with one of a bin and a lid of the bin, and
- an adjusting member associated with another one of the bin and the lid of the bin and further, the retainer member.

Another non-limiting, exemplary aspect of an embodiment of the present invention provides a retainer mechanism, comprising:

- a retainer member; and
- an adjusting member associated with the retainer member;
- the retainer member is comprised of:
- a mounting support; and
- lever assembly comprised of a lever and a weight-mass assembly.

A further non-limiting, exemplary aspect of an embodiment of the present invention provides a device, comprising:

- a mounting member;
- an intermediary member that couples a latch member to the mounting member;
- a lever assembly that is coupled to the latch member; and
- a catch member that receives and detachably latches the latch member.

Another non-limiting, exemplary aspect of an embodiment of the present invention provides a device, comprising:

- a mounting member;
- an intermediary member that couples a lever assembly with the mounting member; and
- a catch member that receives and detachably latches a latching end of the lever assembly.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1A:
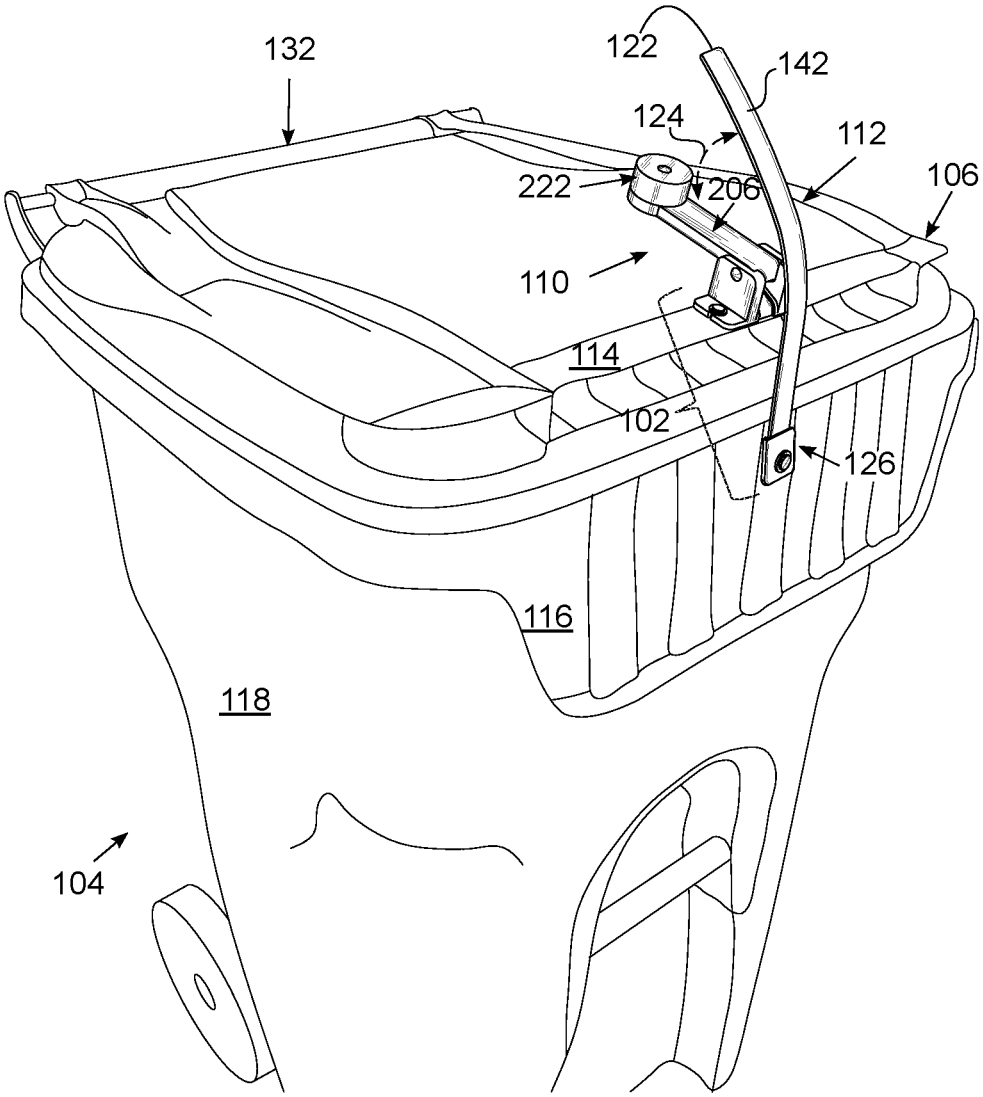
FIGS. 1A to 1N are non-limiting, exemplary illustration that progressively show securing and eventual release of a lid of a trash bin using an embodiment of a retainer mechanism in accordance with the present invention.

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

Further, unless otherwise noted and distinguished specifically, throughout the disclosure, the use of specific terms such as a bin, trash bin, container, receptacle, can, trashcan (residential or commercial), etc. should be interpreted as synonymous, as interchangeable, meant as illustrative, and for convenience of example, only.

One or more embodiments of the present invention provides a device for actively securing or tightly holding down a lid of a bin even if the bin is overfilled (for compacting the content) and for passively (and automatically) self-releasing or self-unlatching the lid to fully open when and as a result of the device appropriately tilted to a particular orientation for unhindered, unobstructed emptying of the bin. One or more embodiments of the present invention may be used to compact content of an overfilled bin, securing content of the bin even if the lid of the bin is not fully closed due to bin overfill.

Further, one or more embodiments of the present invention provides a device for actively securing a lid (holding and maintaining content) of a container only if the container is not overfilled and for passively (and automatically) self-releasing the lid to fully open when and as a result of the retainer mechanism appropriately titled to a particular orientation for unhindered, unobstructed emptying of the container. That is, one or more embodiments of the present invention provide a device for securing of a lid only if the lid is able to fully close in relation to bin.

Additionally, one or more embodiments of the present invention provides a device for a quick and easy engagement of an adjusting mechanism with a retainer member, with the adjusting mechanism comprised of material that would not require constant cleaning.

Further, one or more embodiments of the present invention provides a device that is adapted to be mounted at a position on a container/lid combination that may be universally acceptable for use for both full and semi automatic lift mechanisms.

In general, the disclosed embodiments of the present invention are lightweight, and easily install on most containers without requiring any special equipment. Disclosed embodiments of the present invention are comprised of mechanism with minimal parts and simple movements, easily usable by most. One or more embodiments of the present invention or parts thereof may be retrofitted with any existing container or be manufactured as part of container itself. For example, a mounting support (detailed below) may be molded with the bin or lid of the bin (or adapted to be integral with bin or the lid of the bin), with a lever and other components affixed or mounted onto the mounting support.

Figure 1B:
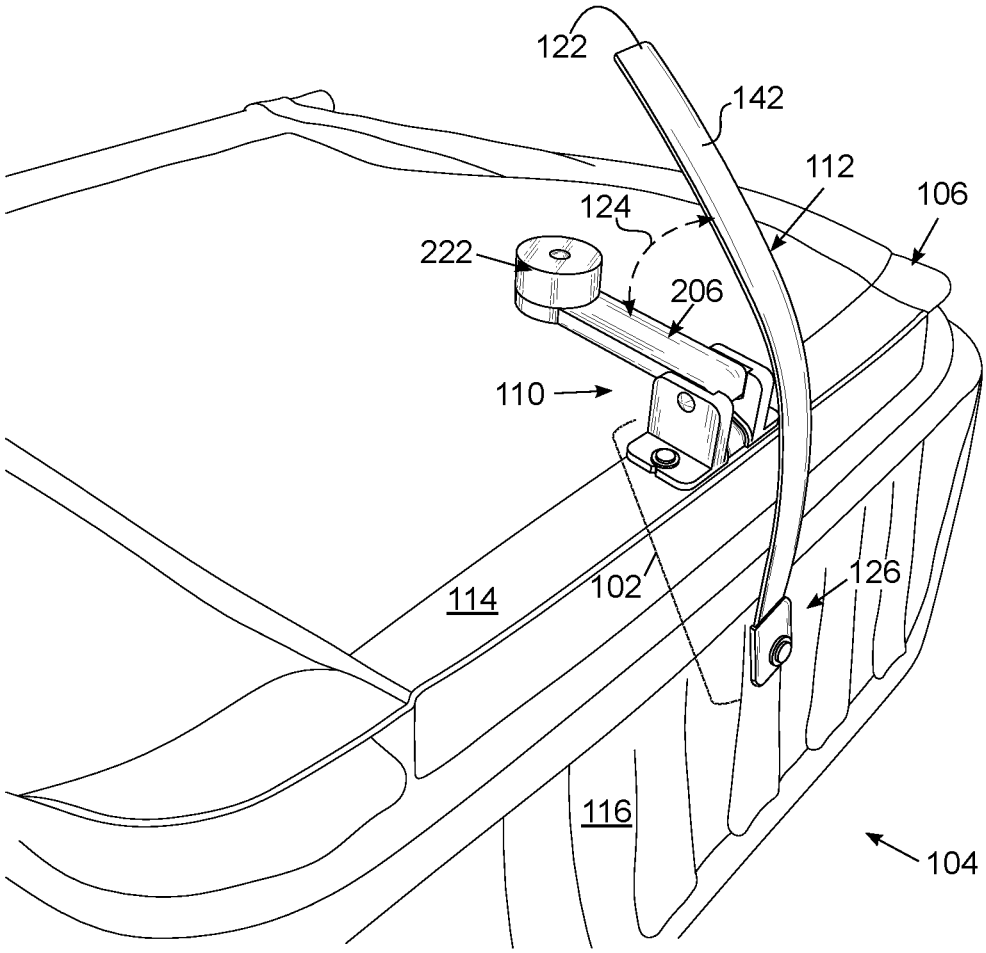
Figure 1C:
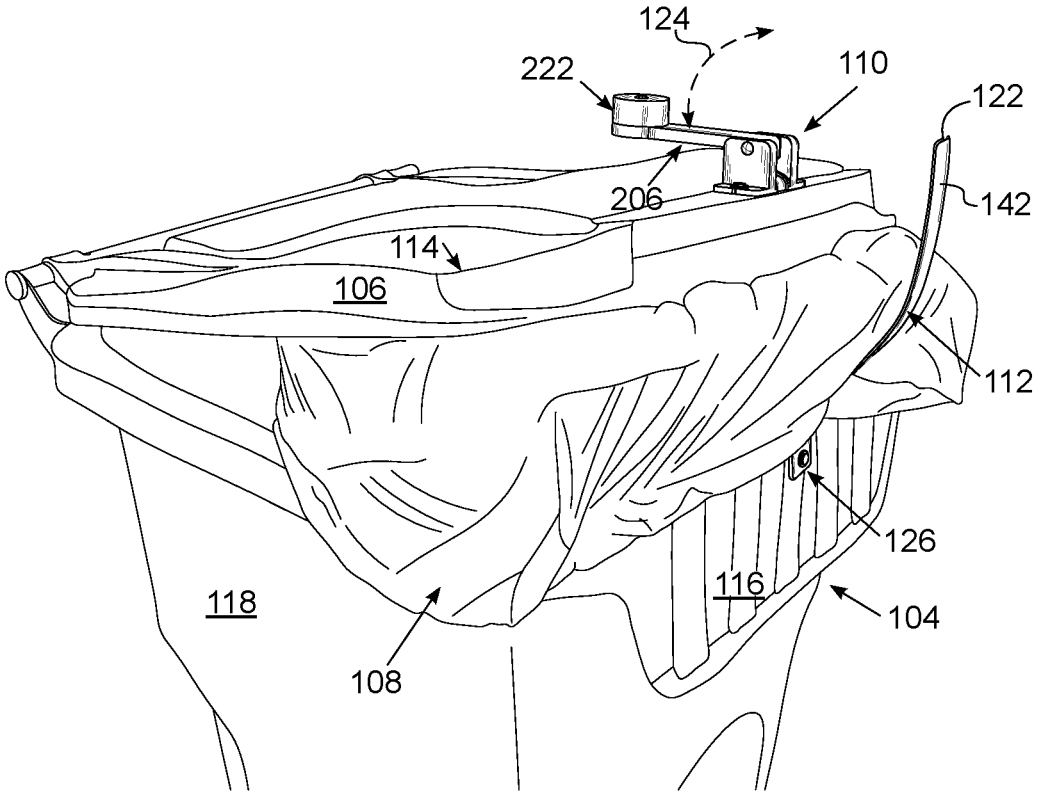
Figure 1D:
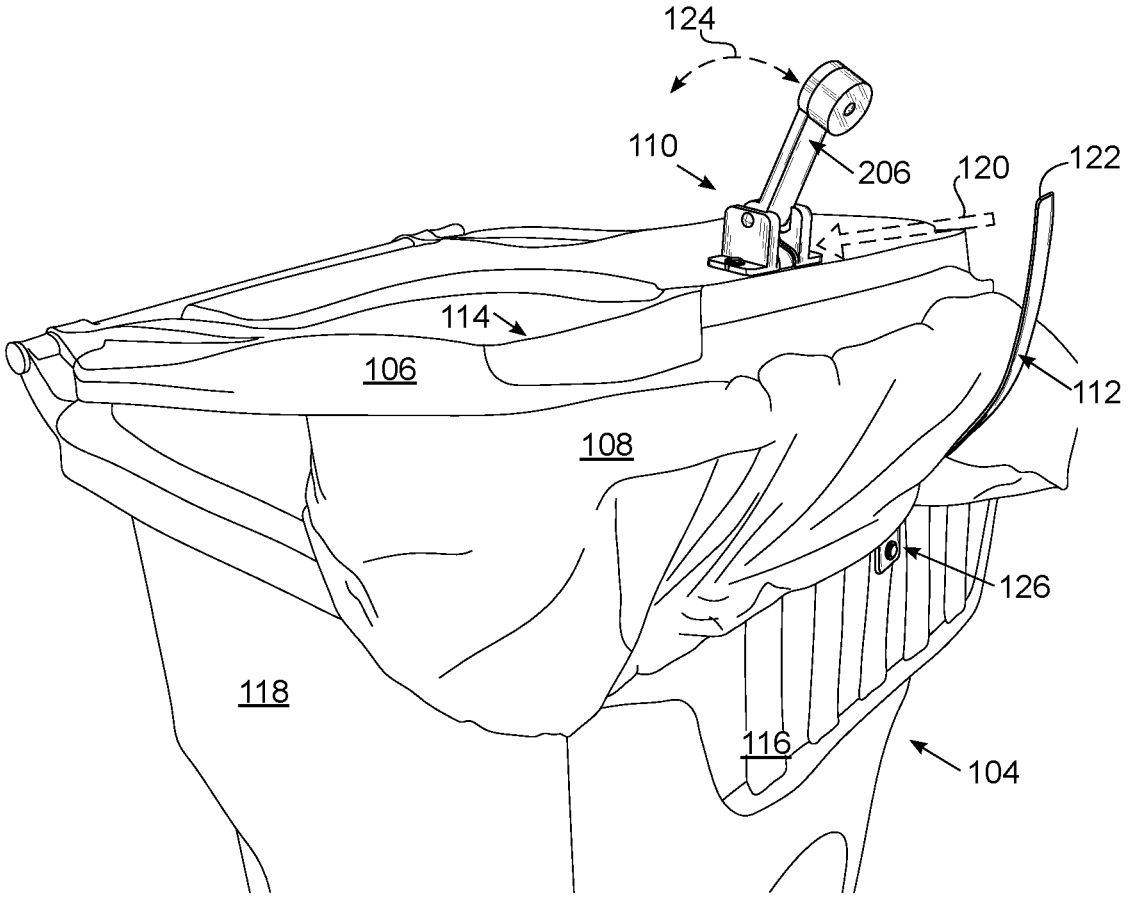
Figure 1E:
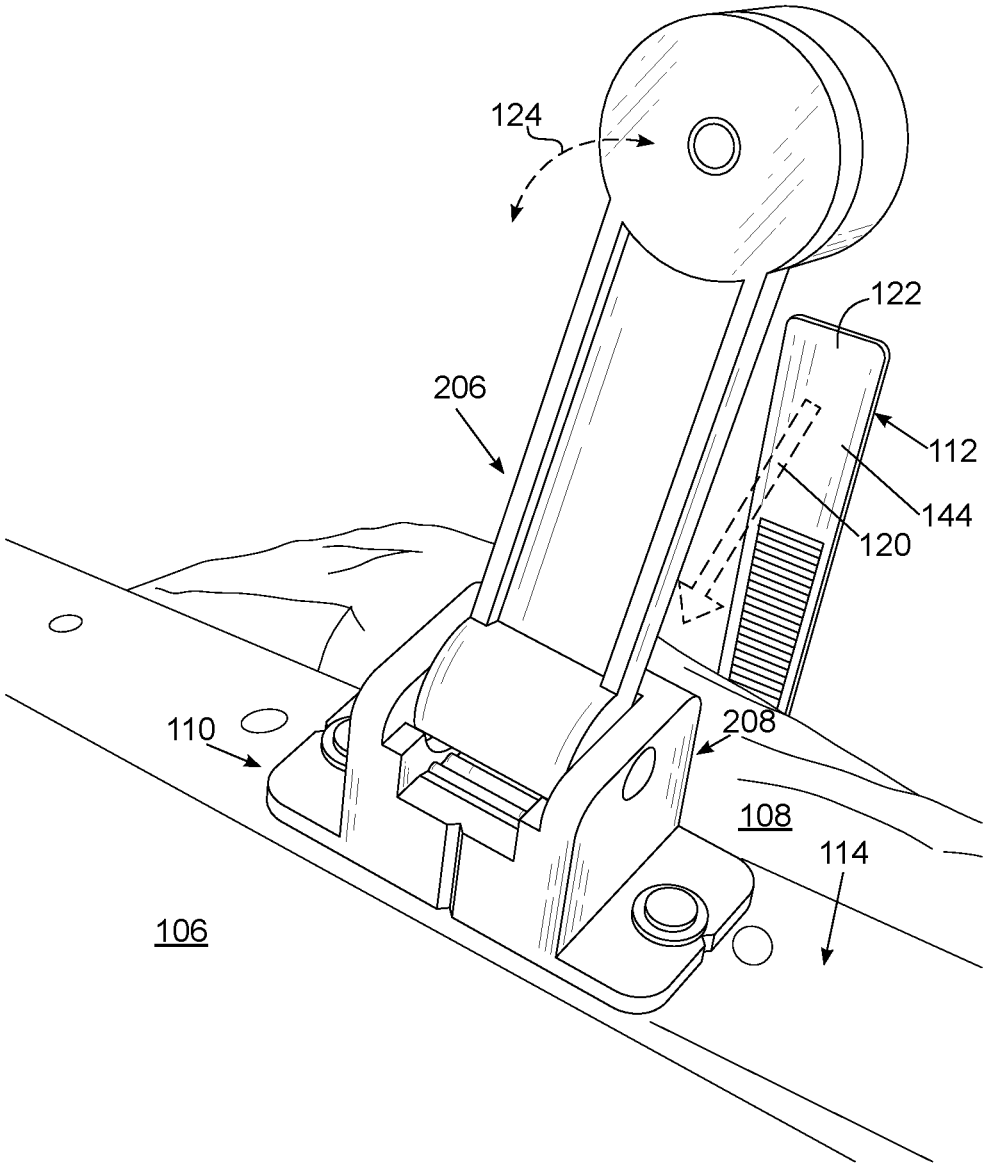
Figure 1F:
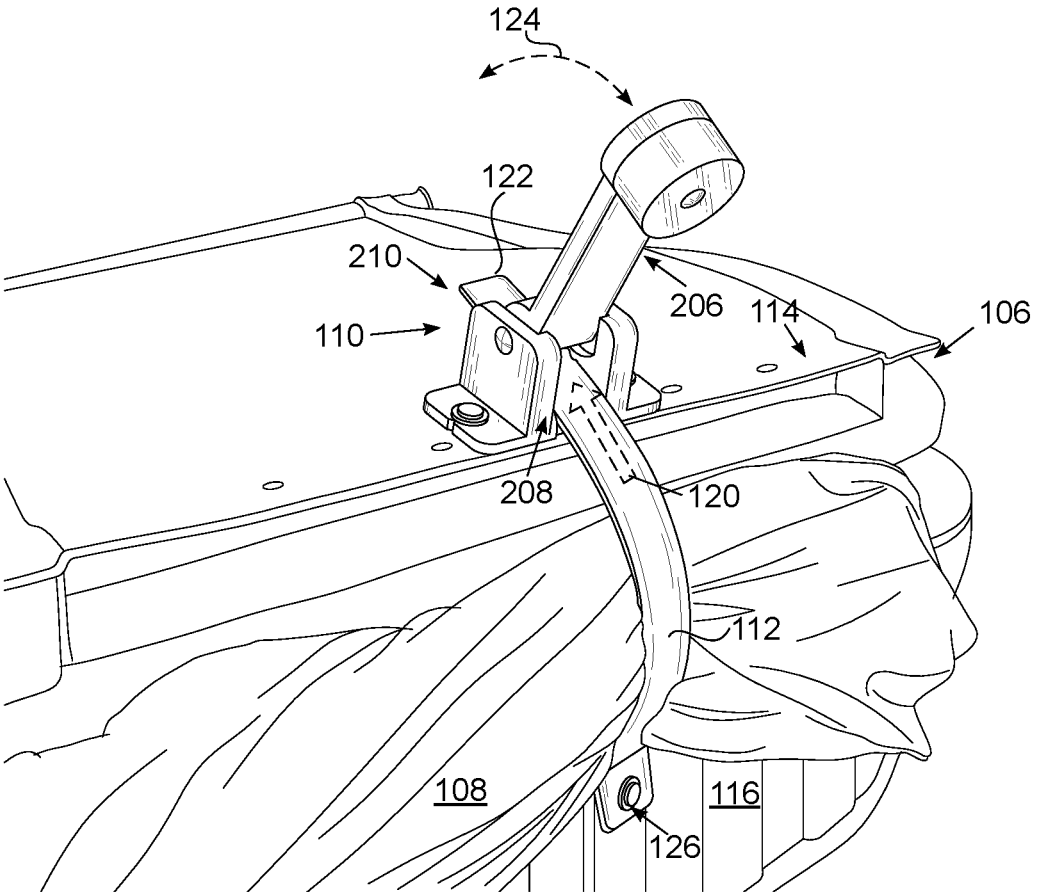
Figure 1G:
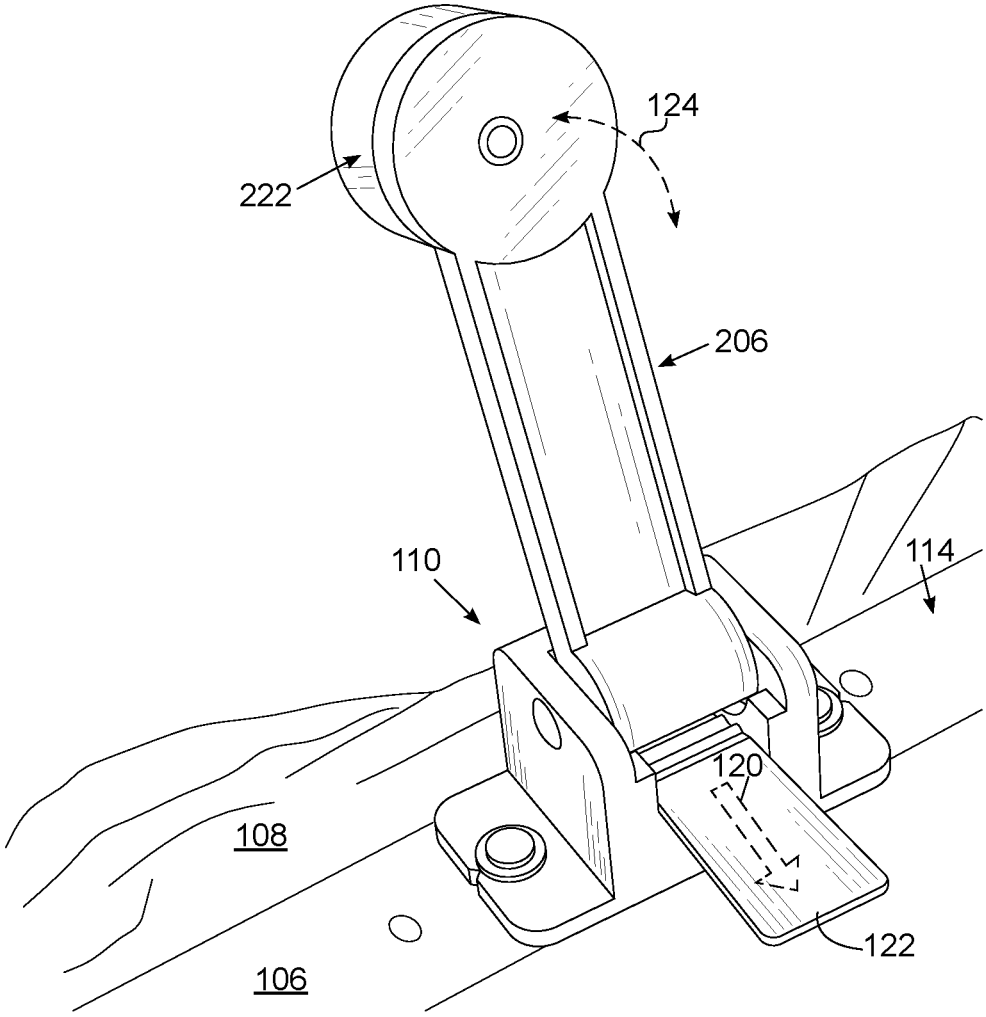
Figure 1H:
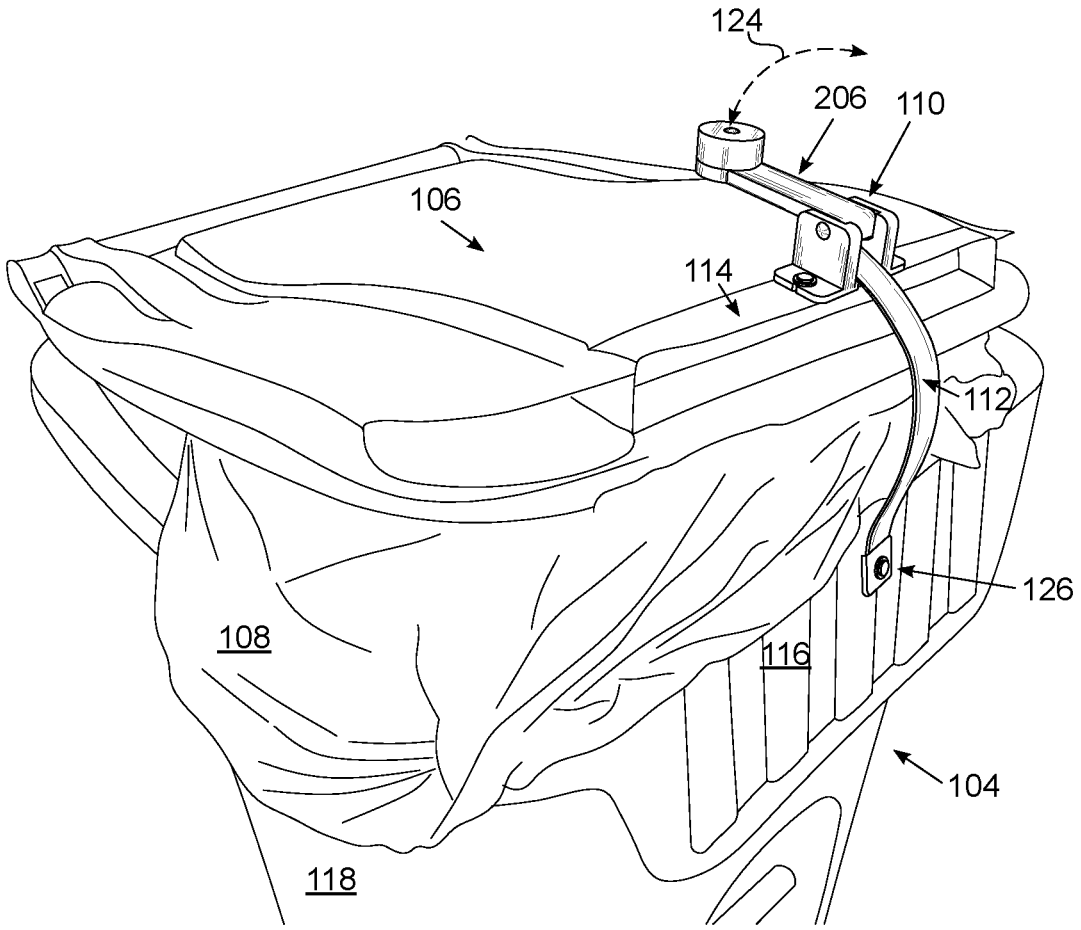
Figure 1I:
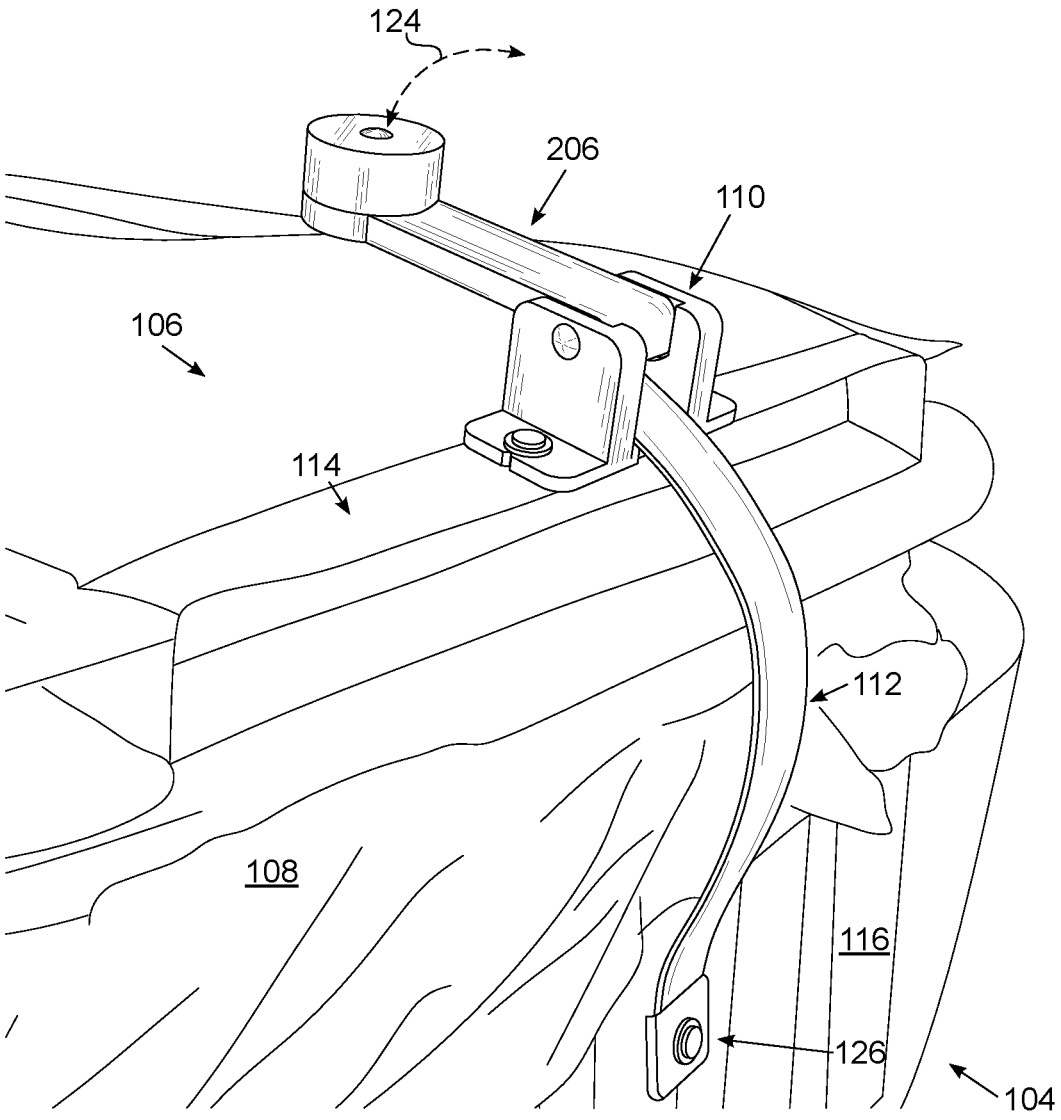
Figure 1J:
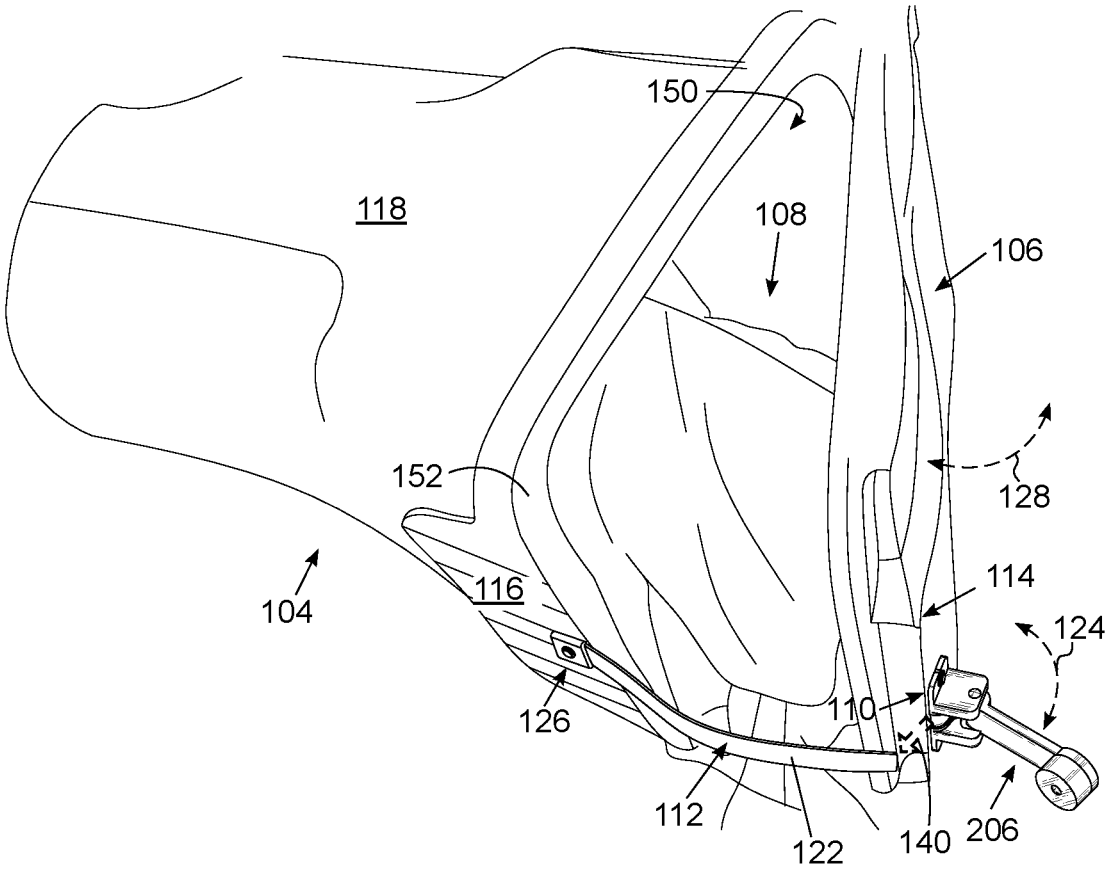
Figure 1K:
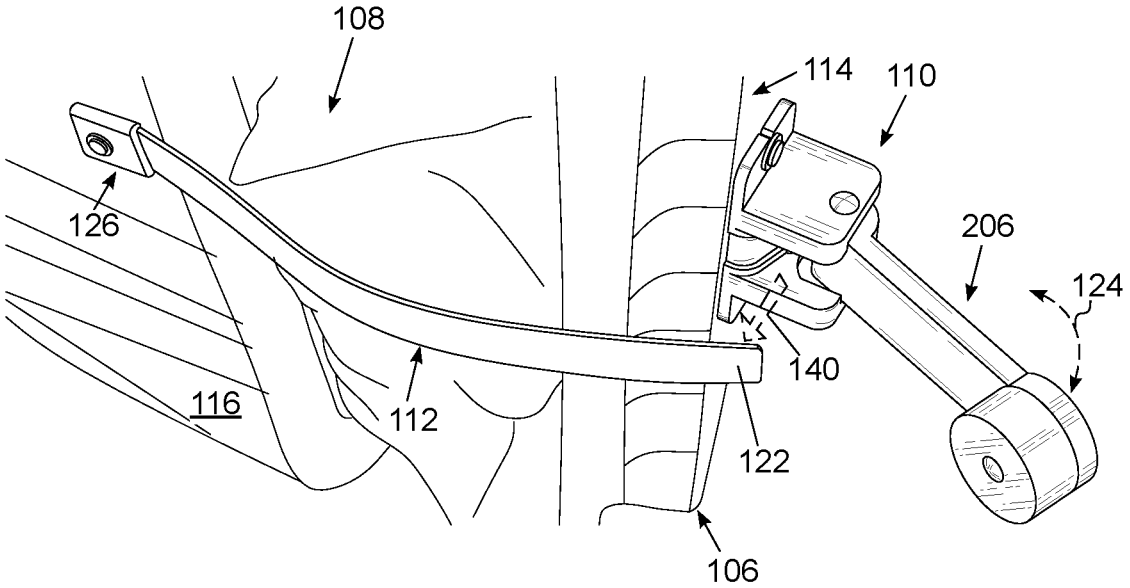
Figure 1L:
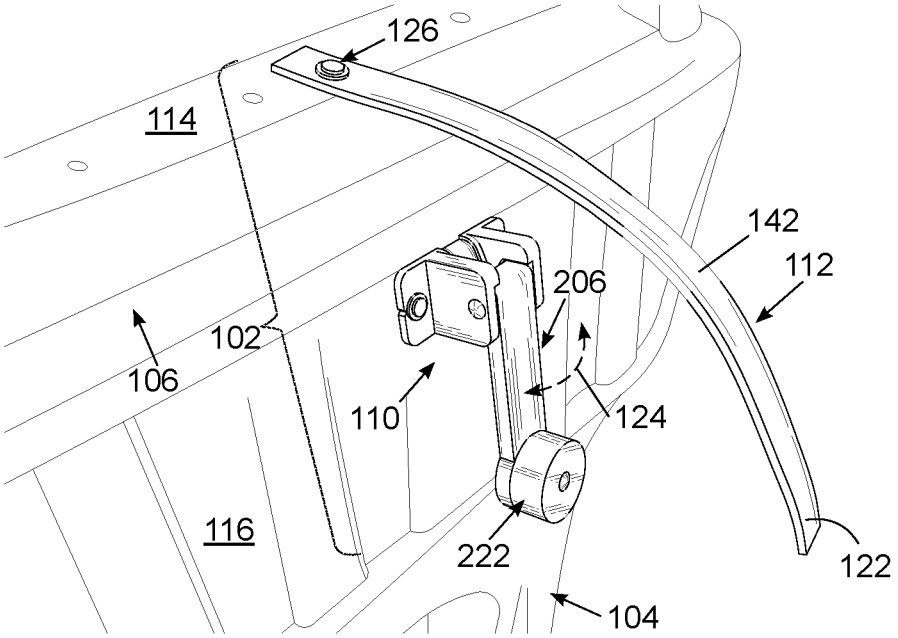
Figure 1M:
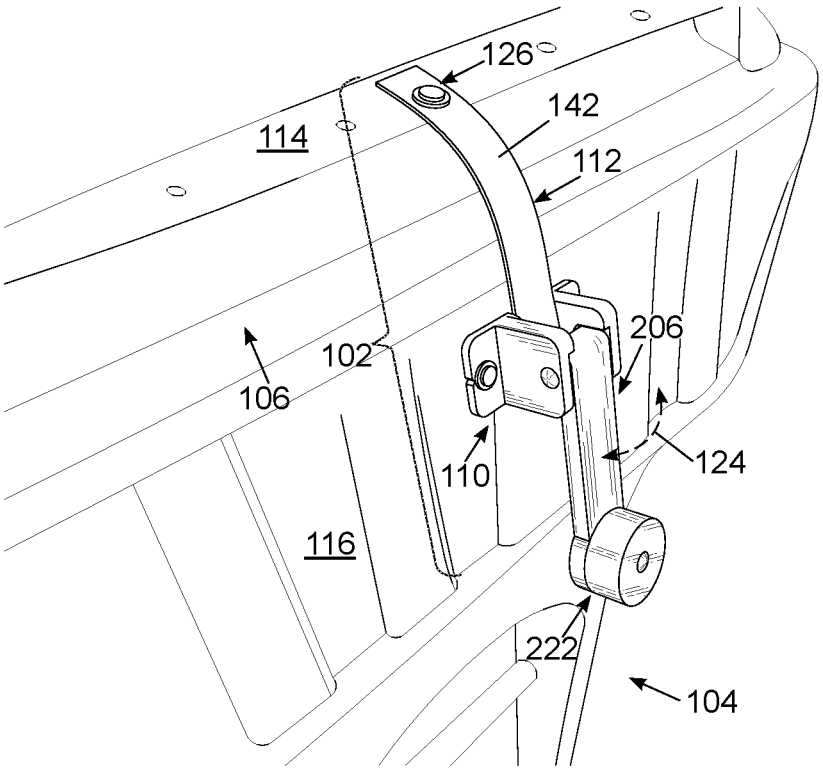
Figure 1N:
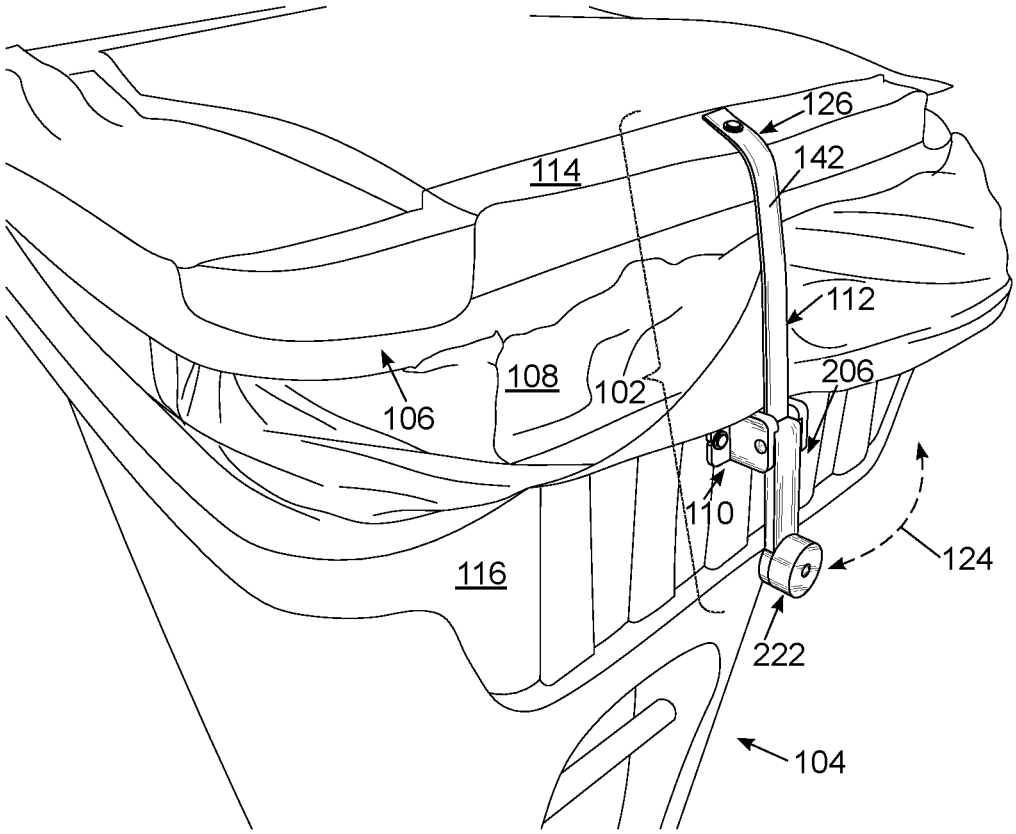

FIGS. 1A to 1N are non-limiting, exemplary illustration that progressively show securing and eventual release of a lid of a trash bin using an embodiment of a retainer mechanism in accordance with the present invention. As illustrated in FIGS. 1A to 1K, a retainer mechanism 102 of an embodiment of the present invention is comprised of a retainer member 110 illustrated as associated with a front side 114 of a lid 106 of a bin 104, and a distal end 126 of an adjusting member 112 associated with a front side 116 of bin 104.

Lid 106 may easily be secured and tightly held down in relation to bin 104 when adjusting member 112 is associated with the retainer member 110. That is, in this non-limiting, exemplary embodiment, even if bin 104 is overfilled with content 108 as illustrated, lid 106 may still be easily secured and tightly held down in relation to bin 104 by associating adjusting member 112 with retainer member 110 (which would in fact, aid in further compacting content 108 of bin 104). Accordingly, retainer member 110 holds and securely maintains adjusting member 112 at a fixed position along a length of adjusting member 112, which, in turn, holds and securely maintains lid 106 in relation to bin 104. The adjustable features or aspects of adjusting member 112 in relation to retainer member 110 enables retainer mechanism 102 to maintain the hold position of lid 106 even if bin 104 is overfilled. In other words, retainer member 110 holds and securely maintains adjusting member 112 at a fixed position along a length of adjusting member 112, which, in turn, holds and securely maintains lid 106 in relation to an opening 150 of the overfilled bin 104, further compacting and securing content of bin 104 as the adjusting member 112 is tightened in relation to retainer member 110. It should be noted that adjusting member 112 may comprise of any flexible material, non-limiting examples of which may include a strap or the like that may comprise of made of materials such as polyester, polyurethane, leather, rubber, plastic, nylon, polyethylene, polypropylene, Acrylonitrile butadiene styrene (ABS), Polyvinyl chloride (PVC), Polyethylene terephthalate (PET), Polyoxyrnethylene (POM), also known as ACETAL, Polycarbonate, Polystyrene, thermoplastic elastomers, etc.

In general, retainer member 110 is comprised of substantially rounded smooth edges, and its dimensions may be varied. Material used for retainer member 110 may be comprised of any metallic material, plastic or others so long as the material has substantial structural integrity in terms of strength, durability, etc. so that retainer member 110 can withstand holding forces when adjusting member 112 is pulled through retainer member 110 to tightly hold lid 106 in relation to bin 104. It should be noted the parts or components constituting retainer member 110 may each comprise of different material so long as they exhibit minimal flexure.

Retainer member 110 passively releases adjusting member 112 when retainer member 110 is tilted to a specific orientation (or direction) only, which, in turn, frees lid 106 to an open position. If bin 104 is tilted outside the specific orientation (e.g., backward, side ways, or falls side ways), retainer member 110 maintains its engagement or "grip" with adjusting member 112, securely holding and maintaining adjusting member 112 at a fixed or hold position to maintain lid 106 in a closed or hold position.

Adjusting member 112 is passed through retainer member 110, which maintains adjusting member 112 at a desired position (e.g., length, tightness, etc.). When bin 104 is picked up and tilted to the appropriate orientation to be emptied, a lever assembly 206 of retainer member 110 passively moves to a release position, and allows the release of adjusting member 112 to allow lid 106 to "fling" open. In other words, retainer member 110 includes a lever assembly 206, which is passively moved (due to gravity) when retainer member 110 is tilted to a specific orientation to passively release adjusting member 112. Accordingly and as further detailed below, retainer member lever assembly 206 is actively moved to one of hold or release positions to hold or release adjusting member 112, and is passively moved to release adjusting member 112 when retainer member 110 is tilted to a specific orientation. If bin 104 is tilted to any other orientation (e.g., side or back tilted verses the correct forward tilted), retainer member 110 will not passively release adjusting member 112, which will maintain lid 106 in a hold position, keeping content 108 inside bin 104.

As illustrated in FIGS. 1A to 1N, retainer mechanism 102 may be used to actively secure or tightly hold down lid 106 of bin 104 and for passively (and automatically) self-release or self-unlatch lid 106 to fully open when and as a result of retainer mechanism 102 appropriately titling to a particular orientation for unhindered, unobstructed emptying of bin 104 of its content 108. As illustrated in FIGS. 1A to 1C (with FIG. 1C showing an overfilled bin 104), lever assembly 206 of retainer member 110 of retainer mechanism 102 may be first moved along a reciprocating path 124 to a disengagement or release position as illustrated in FIGS. 1D and 1E, with a free end 122 of adjusting member 112 maneuvered in the direction illustrated by arrow 120 through an insertion side 208 and out extraction side 210 (FIGS. 1F and 1G) of retainer member 110. Adjusting member 112 out from the extraction side 210 may be pulled to further tighten the hold position of lid 106 in relation to bin 104. It should be noted that obviously, "extraction" does not means "to pull free and separate."

It should be noted that lever assembly 206 dangles and moves freely due to the pull of the gravity onto an assembled weight-mass 222 and therefore, may be actively held in the illustrated disengagement or release position by users or passively moved to the disengagement or release position when and as a result of retainer mechanism 102 appropriately titling to a particular orientation. Depending on the degree of tightness desired, pulling onto free end 122 of adjusting member 112 from the extraction side 210 of retainer member 110 would lower (pull in) lid 106 to a further closed position and if bin 104 is overfilled with content 108 as illustrated, lid 106 would simply compact the content 108.

As best illustrated in FIGS. 1H and 1I, once adjusting member 112 is pulled to a desired degree of tightness out from extraction side 210 of retainer member 110, lever assembly 206 is simply moved along the reciprocating path 124 to an engagement or hold position as illustrated, retaining and holding adjusting member 112 at the desired tightness. It should be noted that in this non-limiting, exemplary embodiment, since retainer member 110 is optionally associated with lid 106, rest position of lever assembly 206 (FIGS. 1A to 1C) also happens to be the engagement or hold position (FIGS. 1H and 1I).

As best illustrated in FIGS. 1J and 1K, when bin 104 is forward tilted and substantially upside down to empty out content 108 in normal operation, lever assembly 206 passively (and automatically) self-releases or self-unlatches due to gravity, dangling free and moving along path 124 to a disengagement or release position, which disengages retainer member 110 engagement with adjusting member 112 to free lid 106 to a fully open position along path 128. The motion of lid 106 along path 128 pulls out free end 122 of adjusting member 112 from insertion side 208 of retainer member 110 (as shown by arrow 140 in FIGS. 1J and 1K), completely disengaging adjusting member 112 from retainer member 110, which allows for unhindered, unobstructed emptying of bin 104 of its content 108 as shown in FIGS. 1J and 1K. Accordingly, one or more embodiments of the present invention provide a retainer mechanism 102 that allows for actively securing lid 106 by a user for holding and maintaining content 108 of bin 104 even if container 104 is overfilled and for passively (and automatically) self-releasing lid 106 to fully open when and as a result of retainer mechanism 102 appropriately tilted to a particular orientation for unhindered, unobstructed emptying of container 104. However, while lid 106 of bin 104 is secured by retainer mechanism 102, if bin 104 is tilted and falls onto any one of its vertical sides 118, lid 106 will remain secure as shown in FIGS. 1H and 1I, and continue to hold and maintain content 108 of bin 104. Accordingly, adjusting member 112 is passively (automatically) released only when and only as a result of retainer mechanism 102 being tilted to a particular orientation where lever assembly 206 of retainer mechanism 102 is able to passively move to a disengaging or release position as illustrated. In other words, lever assembly 206 is moved when retainer member 110 is tilted to a specific orientation to passively release adjusting member. That is, lever assembly 206 is actively moved to one of hold or release positions to hold or release adjusting member 112, and is passively moved to release adjusting member 112 when retainer member 110 is tilted to a specific orientation.

As best illustrated in FIGS. 1L to 1N, for this and some of the other embodiments, the installment or mounting position of retainer member 110 and adjusting member 112 (further detailed below) may be switched where retainer member 110 is coupled with front top side 116 of bin 104 and adjusting member 112 coupled with front side 114 of lid 106. Switching installment position of retainer member 110 and adjusting member 112 as illustrated would not affect the operation of the retainer mechanism 102.

In the exemplary embodiments shown in FIGS. 1A to 1N, lid 106 is hinged at one side of an opening 150 of bin 104 forming a hinged lid, with retainer member 110 or adjusting member 112 associated with the free, open front side 116 of lid 104. In a non-limiting, exemplary instance of FIGS. 1L to 1N where retainer member 110 is coupled with bin 104 and adjusting member 112 with lid 106, a distal end 126 of adjusting member 112 may be harnessed (secured) to the front 114 of the lid 106 by a variety of mechanisms, non-limiting examples of which may include the use of rivets, screws, through slots, or other fasteners (e.g., glue). Further, retainer member 110 is coupled with front side 116 of bin 104 as illustrated with insertion side 208 of retainer member 110 facing free end 122 of adjusting mechanism 112. Therefore, in one non-limiting, exemplary embodiment one end of the adjusting member 112 may be secured to the front edge 114 of the lid 106 and the other end is free and associated with the retainer member 110. That is, the lid 106 is hinged at one side of the opening of the bin 104 forming a hinged lid, and the adjusting member 112 is coupled with the free, open front side 114 (the "closing side") of the lid 106. As best illustrated in FIG. 1N, lid 106 may easily be latched to a hold position when bin 104 is overfilled and released even if retainer member 110 is associated with bin 104 and adjusting member 112 associated with lid 106, exactly as disclosed in relation to FIGS. 1A to 1K, without affecting functionality.

FIGS. 2A to 2I are non-limiting, exemplary, detailed illustrations of a retainer mechanism illustratively shown in FIGS. 1A to 1N, detailing an embodiment of a retainer member in accordance with one or more embodiments of the present invention. As illustrated in FIGS. 1A to 2I, an embodiment of a retainer mechanism 102 (FIGS. 2E to 2I) of the present invention includes a retainer member 110 (FIG. 2A to 2D) that is comprised of a mounting support 202 and a lever assembly 206 associated with mounting support 202. Mounting support 202 allows connection or retrofitting of retainer member 110 with bin 104 or lid 106 of bin 104 or, alternatively, mounting support 202 may become an integral part of bin 104 or lid 106 of bin 104 itself (by well known molding or fusing processes). The lever assembly 206 (detailed below) includes a weight assembly 212.

As illustrated, retainer member 110 of retainer mechanism 102 has insertion side 208 that receives free end 122 of adjusting member 112 in the direction of the indicated arrow 120, and extraction side 210 from which adjusting member 112 is pulled in the direction of arrow 120, and extracted or pulled out to tighten the hold position of lid 106 of bin 104. In general, adjusting member 112 is maneuvered at insertion side 208 and inserted to pass underneath lever assembly 206, while lever assembly 206 is in the disengaged or release position (FIGS. 2C, 2D, and 2I), and exit out extraction side 210.

Figure 2A:
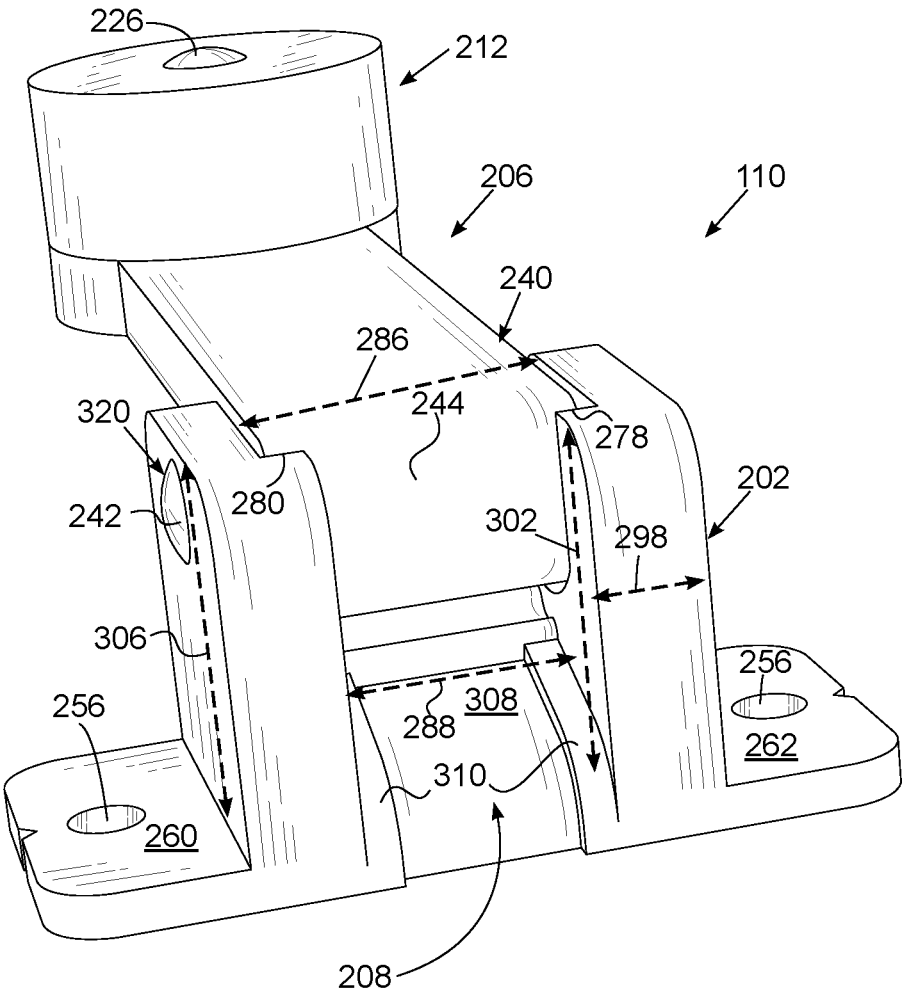
FIGS. 2A to 2I are non-limiting, exemplary, detailed illustrations of a retainer mechanism illustratively shown in FIGS. 1A to 1N, detailing an embodiment of a retainer member in accordance with one or more embodiments of the present invention.
Figure 2B:
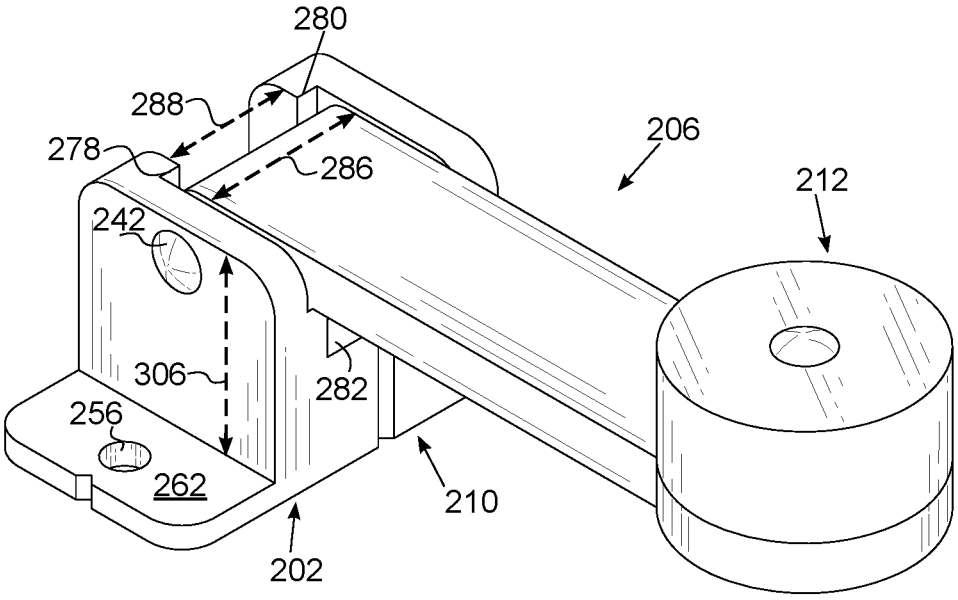
Figure 2C:
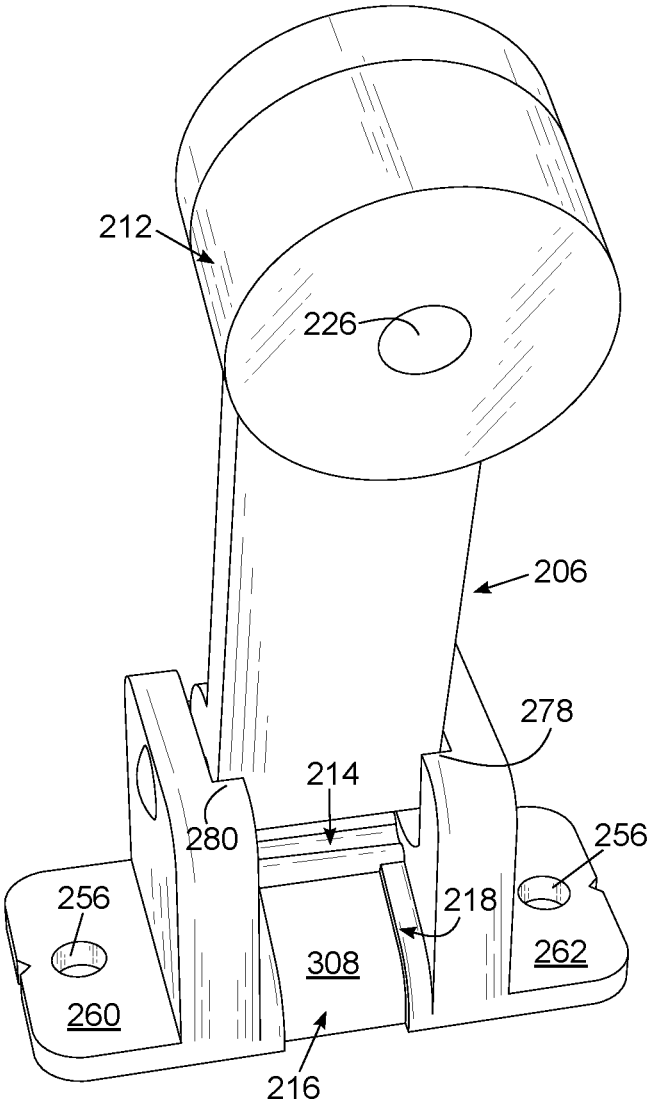
Figure 2D:
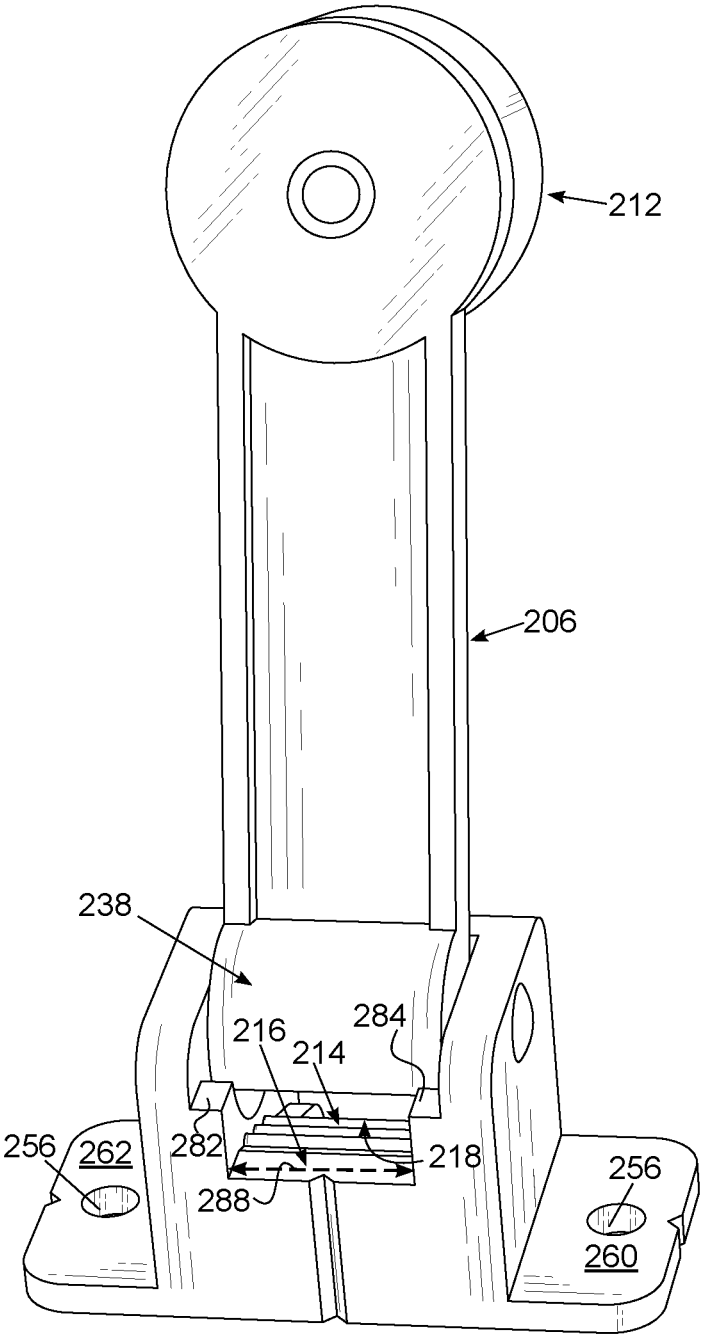
Figure 2E:
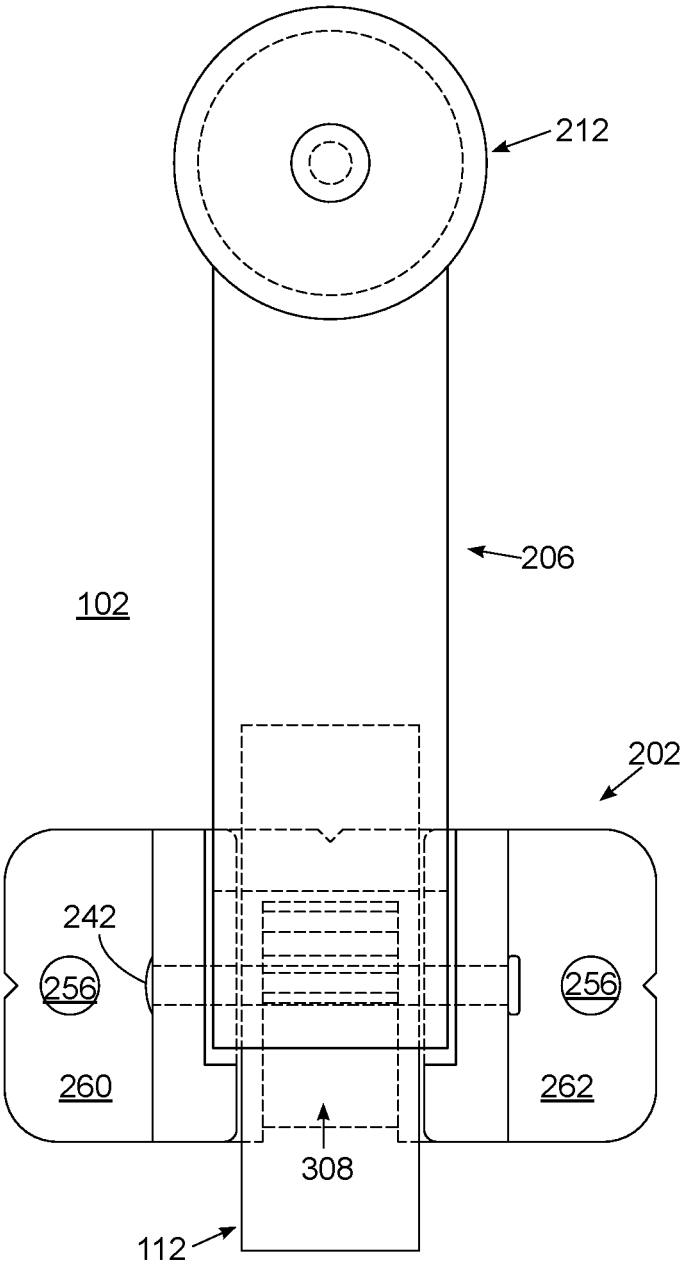
Figure 2F:
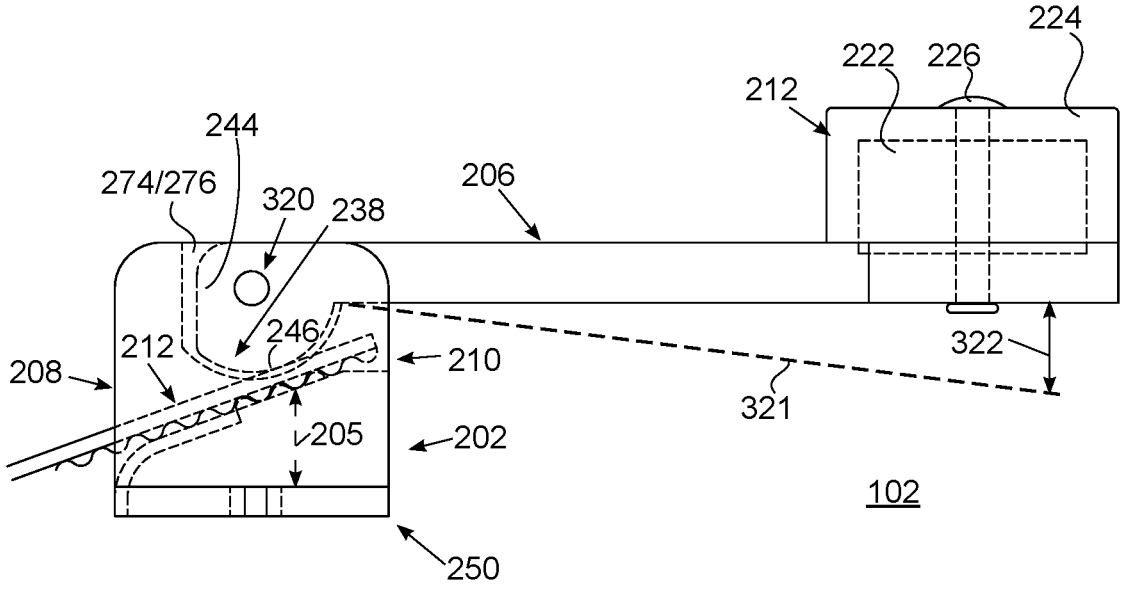
Figure 2G:
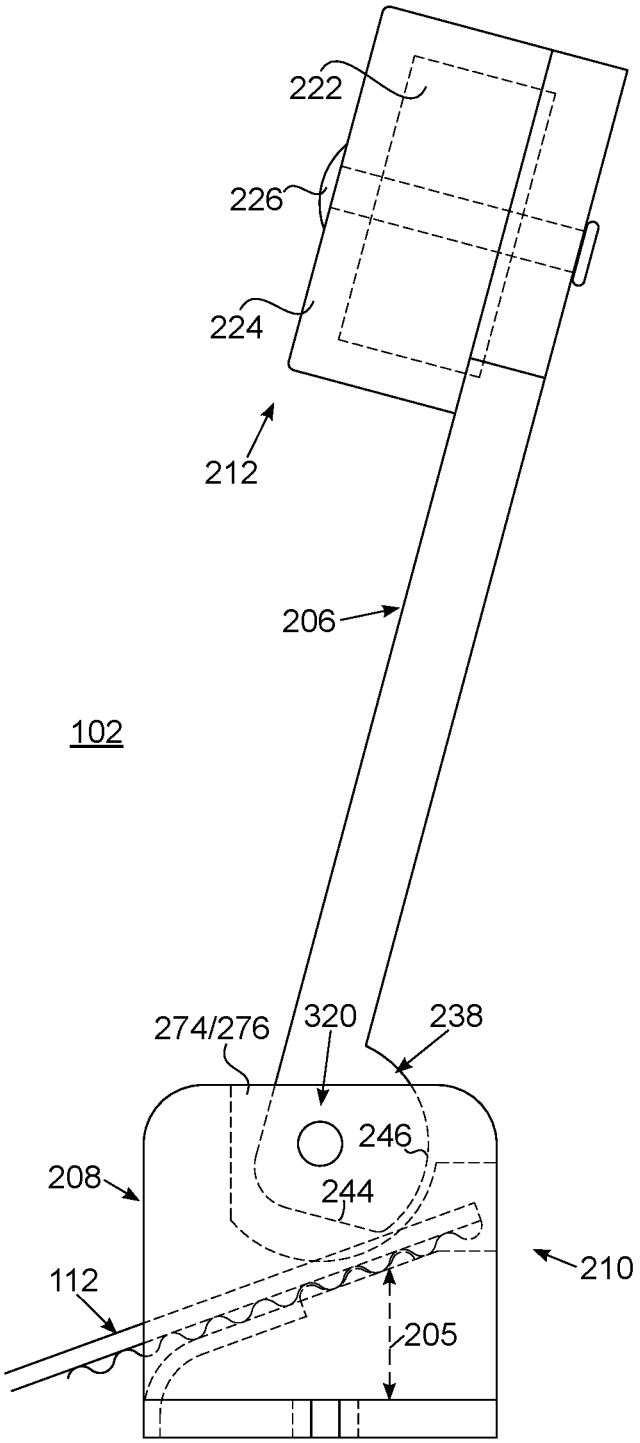
Figure 2H:
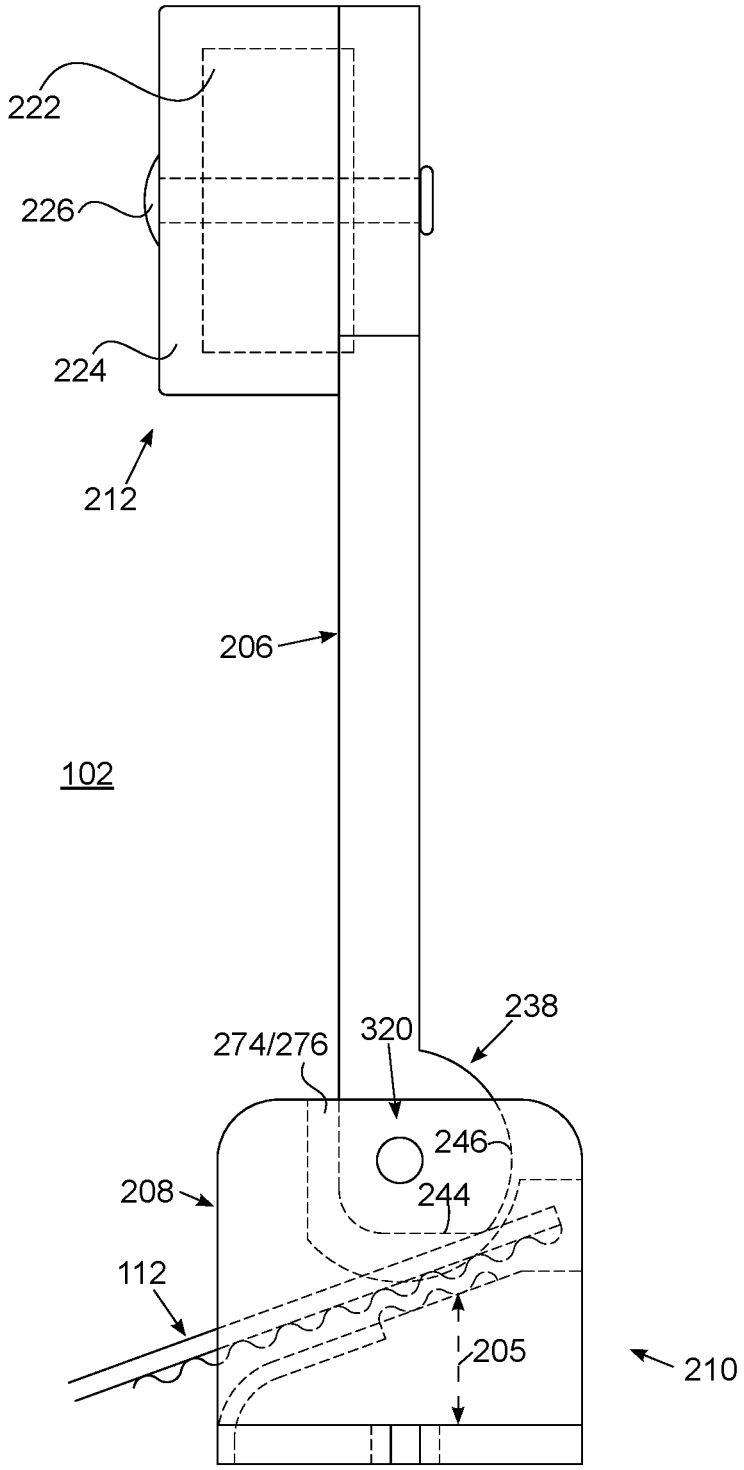
Figure 2I:
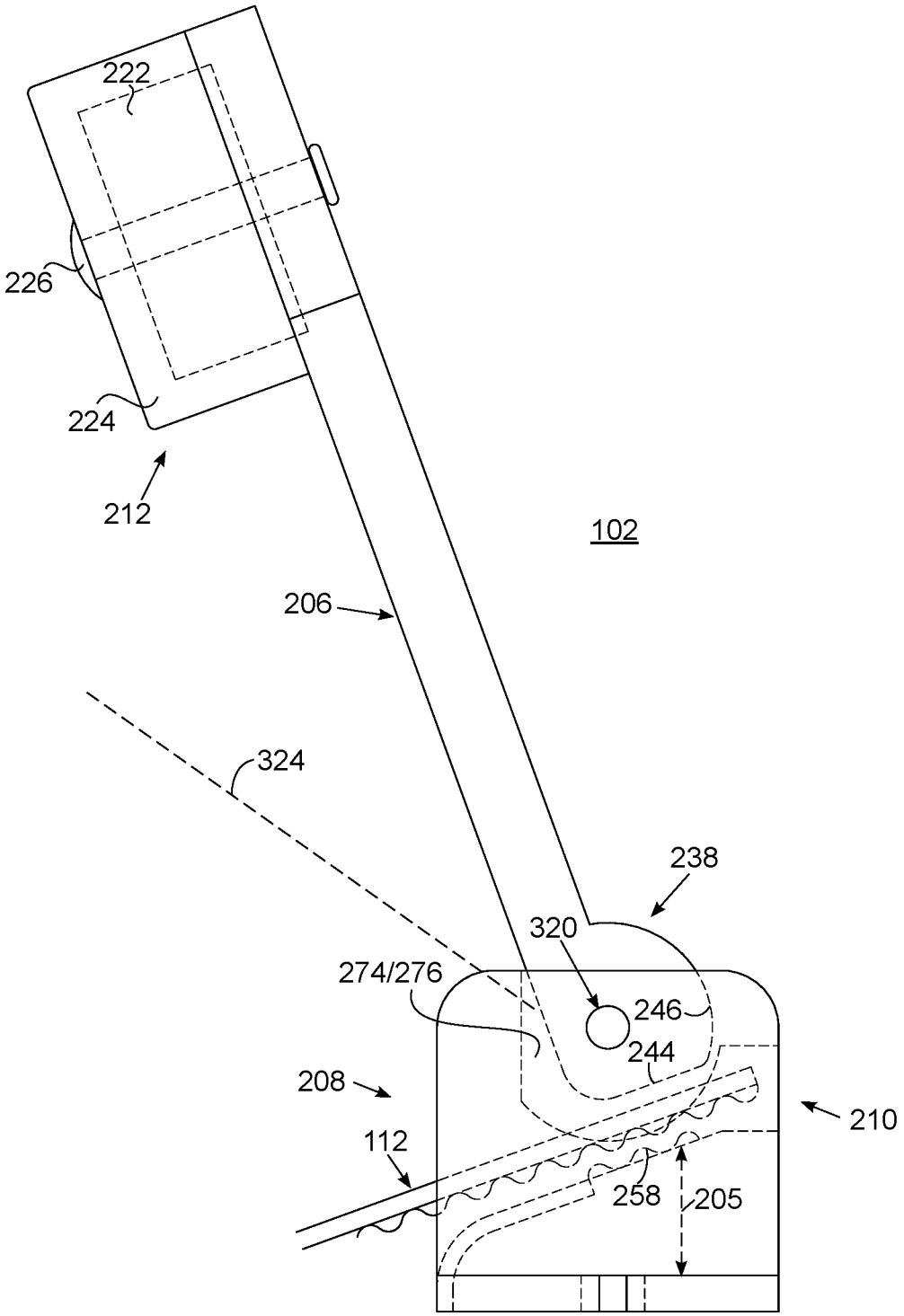

FIGS. 2A, 2B, 2E, and 2F exemplarily illustrate lever assembly 206 in an engagement or hold position in relation to mounting support 202, which presses adjusting member 112 against engagement section 214 of a channel-base 216 of channel 218 of mounting support 202, while FIGS. 2C, 2D, 2I exemplarily illustrate lever assembly 206 in full disengagement or release position in relation to mounting support 202, which relieves the pressure exerted on adjusting member 112 to frees adjusting member 112 to move away from engagement with engagement section 214 of a channel-base 216 of channel 218 of mounting support 202, to thereby allow removal and release of the inserted adjusting member 112. FIGS. 2G to 2I are non-limiting, exemplary profile (or side) views that progressively illustrate a non-limiting, exemplary method of movement of lever assembly 206 along reciprocating path 124 from a hold position (FIG. 2F) to release position (FIG. 2I) in accordance with one or more embodiments of the present invention.

Figure 3A:
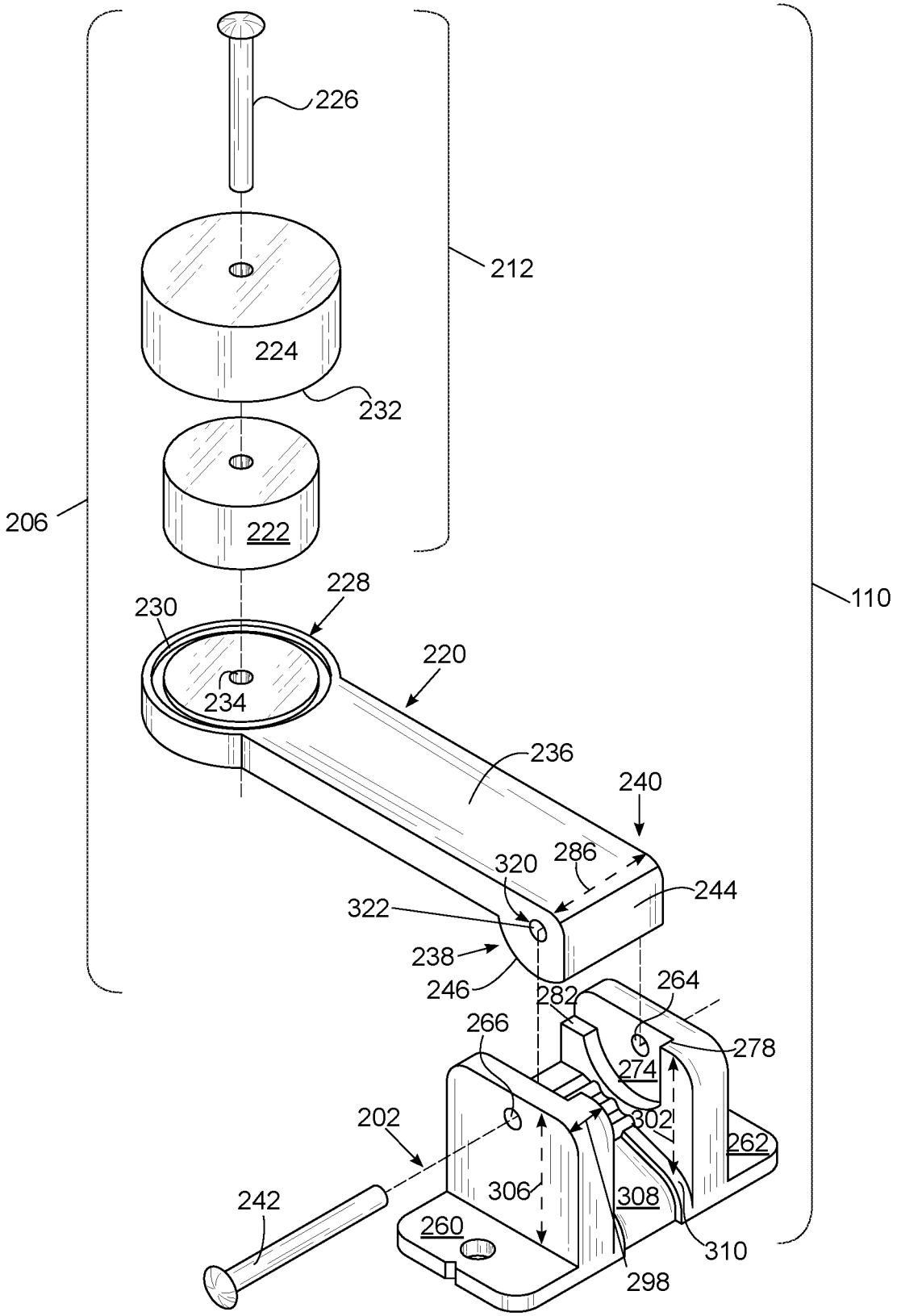
FIGS. 3A and 3B are non-limiting, exemplary, exploded illustrations of a retainer member illustratively shown in FIGS. 1A to 2I, with FIG. 3A illustrating an exploded view of the retainer member from the insertion side and FIG. 3B illustrating an exploded view of the retainer member from the extraction side in accordance with one or more embodiments of the present invention.
Figure 3B:
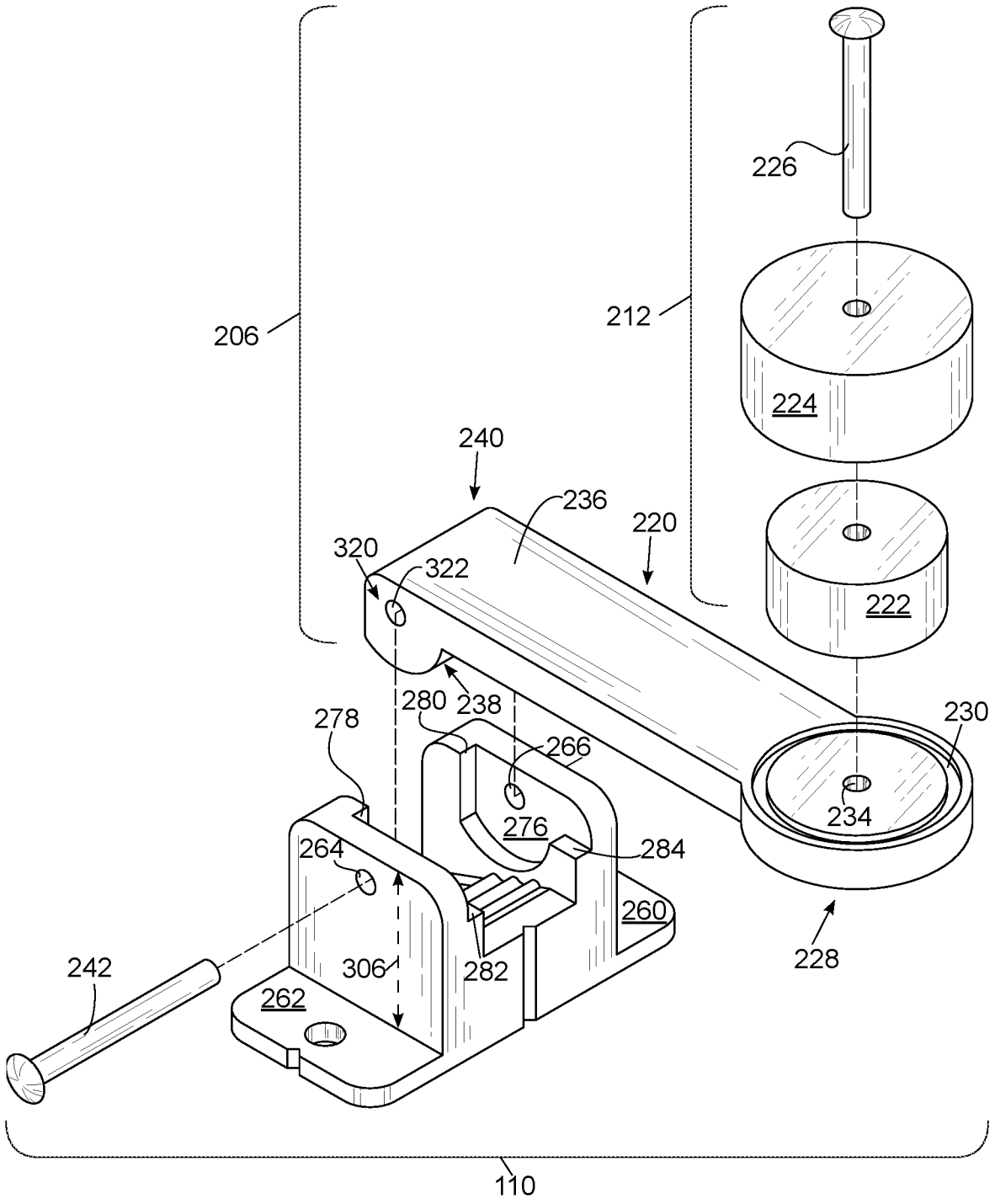
Figure 4A:
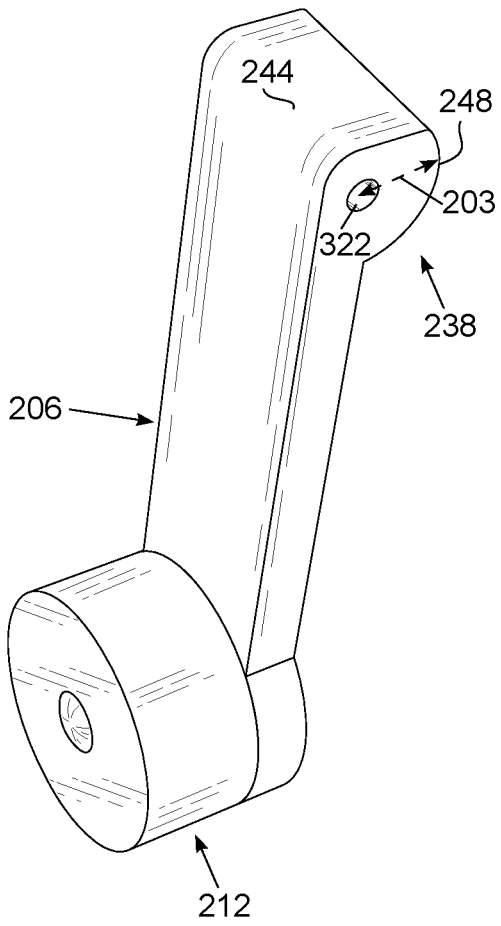
FIGS. 4A to 4E are non-limiting, exemplary, detailed illustrations of lever assembly and lever illustratively shown in FIGS. 1A to 3B in accordance with one or more embodiments of the present invention.
Figure 4B:
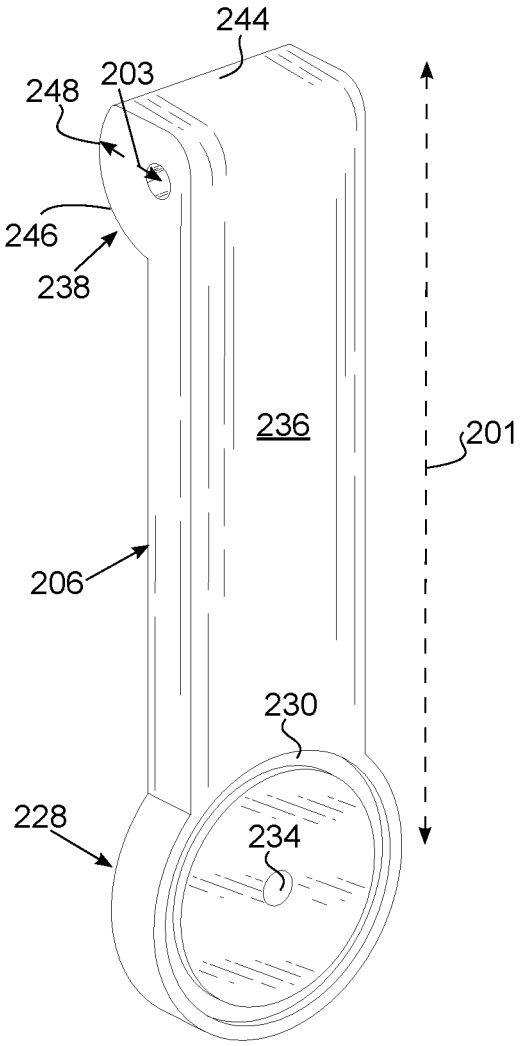
Figure 4C:
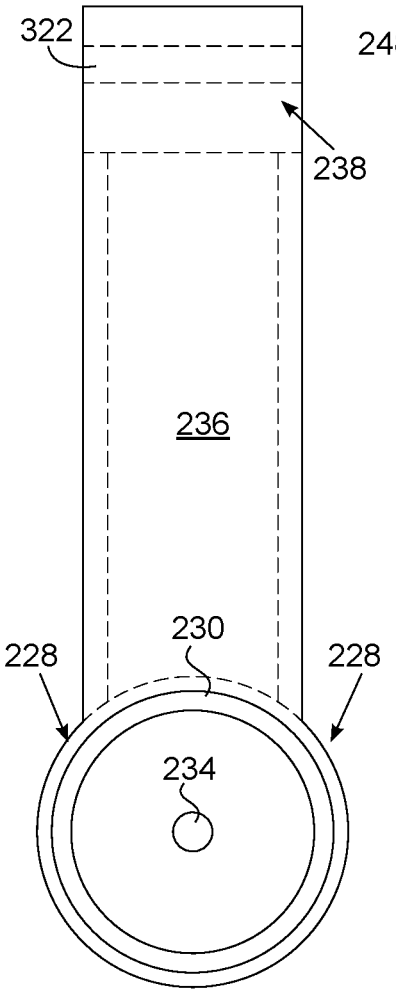
Figure 4D:
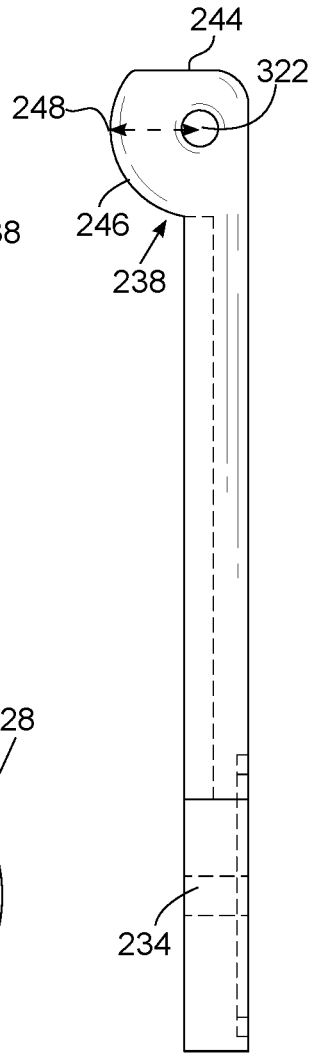
Figure 4E:
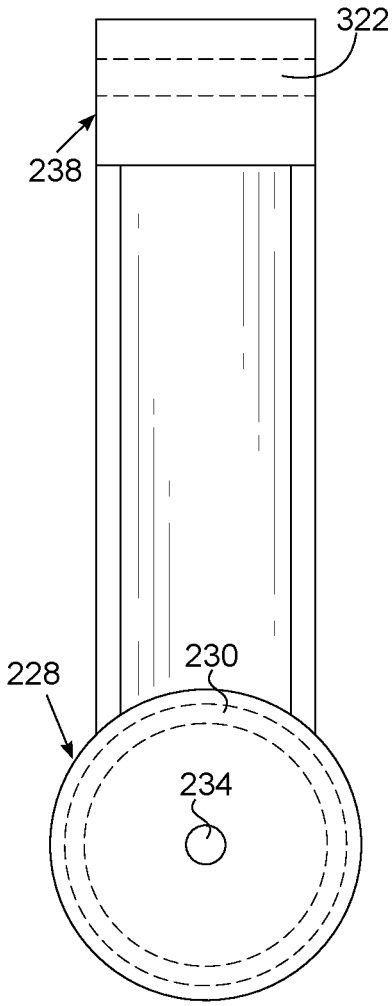

FIGS. 3A and 3B are non-limiting, exemplary, exploded illustrations of a retainer member illustratively shown in FIGS. 1A to 2I, with FIG. 3A illustrating an exploded view of the retainer member from the insertion side and FIG. 3B illustrating an exploded view of the retainer member from the extraction side in accordance with one or more embodiments of the present invention. FIGS. 3A and 3B illustrate a disassembled, exploded views with the separated components to show the cooperative working relationship, orientation, positioning, and manner of assembly of the various components in accordance with one or more embodiments of the present invention, with each component detailed below. As illustrated in FIGS. 1A to 3B, retainer member 110 is comprised of mounting support 202 and lever assembly 206 that includes a lever 220 and a weight assembly 212.

FIGS. 4A to 4E are non-limiting, exemplary, detailed illustrations of a lever assembly and lever illustratively shown in FIGS. 1A to 3B in accordance with one or more embodiments of the present invention. Lever assembly 206 has sufficient length 201 and a weighted end with sufficient weight to provide the required mechanical advantage (in terms of applied torque for example) to enable itself to be passively moved to a release position when the retainer mechanism 102 is appropriately tilted. In other words, lever assembly 206 provides leverage that has a rigid bar (e.g., lever 220) resting on a pivot 320, wherein lever 220 is used to help move firmly fixed load (e.g., the cam action of cam portion 238 of lever 220 when lever 220 is at hold position) when pressure (due to weight assembly 212) is applied to the weighted end 228 of lever 220.

As illustrated in FIGS. 1A to 4E, lever 220 of lever assembly 206 includes weight assembly 212 at a top side 236 thereof, which does not interfere with insertion end 122 of adjusting member 112. Further, weight assembly 212 on top side 236 moves the center of gravity of lever assembly 206 to a higher elevation, which provides a greater (momentum or impetus) force in the swing of lever assembly 206 from a hold to a release position.

Weight assembly 212 includes a weighted mass 222 encapsulated by an optional protective cover 224, with weighted mass 222 and cover 224 fastened by a fastener 226 to a first distal end (or weighted end) 228 of lever 220. Cover 224 protects weight-mass 222 against elements (e.g., moisture, water, excessive heat/cold, dirt, debris, etc.). It should be noted that weight mass 222 is optional, but if not used, lever 220 must be comprised of a heavy metal to generate appropriate force or energy momentum with which the lever may move from hold to release position. Optionally, distal end 228 may include an annular groove or recess 230, which is commensurately configured to receive a periphery edge 232 of cover 224, and a fastener opening 234 to receive and secure weight assembly 212 to distal end 228 of lever 206. It should be noted that although fastener 226 is illustrated as a simple rivet, most other types of fasteners may be used instead.

Second distal end 240 includes at least one protruded portion 238 that includes a pivot point 320 (defined by opening 322) to pivotally couple lever 220 with mounting support 202. Pivot point 320 may include hinge pin 242 that passes through opening 322 of hinge barrel (that also defines the protruded portion 238) and is coupled to second pair of holes 264 and 266 on lateral supports 252 and 254 of mounting-support 202.

As further illustrated in FIGS. 1A to 4E, lever assembly 206 further includes a protruded portion 238 at second distal end 240 of lever 220, which generates a cam action that when lever assembly 206 is at a hold position, protruded portion 238 maximally presses against adjusting member 112. Lever assembly 206 is pivotally hinged at the protruded (or cam) portion 238 on mounting support 202 with a fastener 242 (detailed below).

Cam portion 238 has a relief portion (generally straight or flat) 244 and a hold or latching portion (generally curved) 246. As detailed below, mounting support 202 includes alignment supports (or extraction side limiters) 282 and 284 that generally supports an apex 248 of curved portion 246 of protruded or cam portion 238 of lever 220 aligned in appropriate relative position in a sliding contact with a top surface (un-serrated side) 142 of adjusting member 112 to impart pressure thereon and move adjusting member 112 in to a tight engagement with engagement section 214 of mounting support 202 by providing maximum pressure on top surface 142 of adjusting member 112.

Figure 5A:
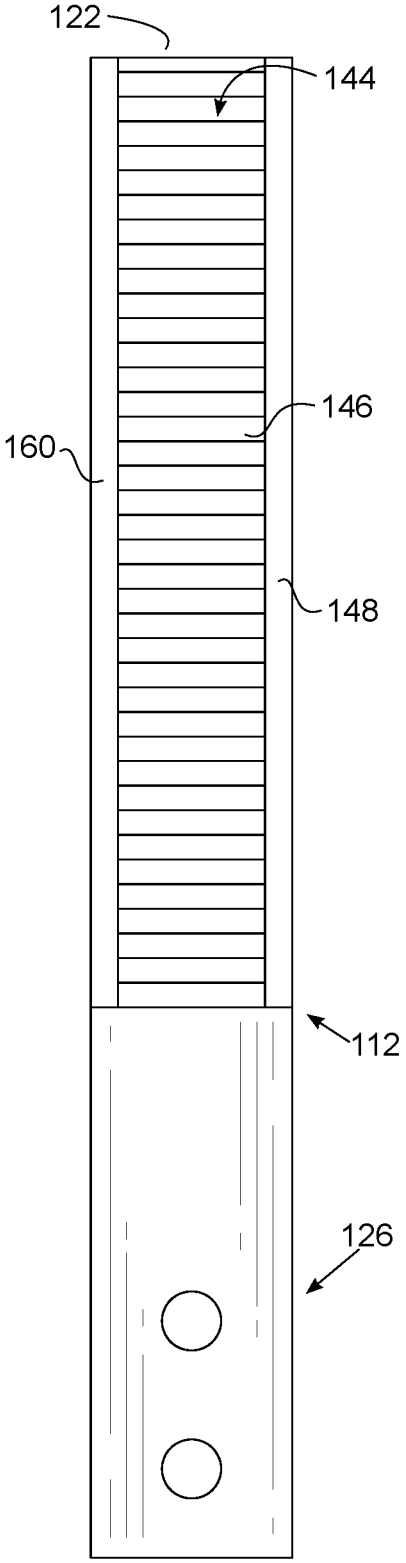
FIGS. 5A to 5F are non-limiting, exemplary, detailed illustrations of an adjusting member illustratively shown in FIGS. 1A to 4E in accordance with one or more embodiments of the present invention.
Figure 5B:
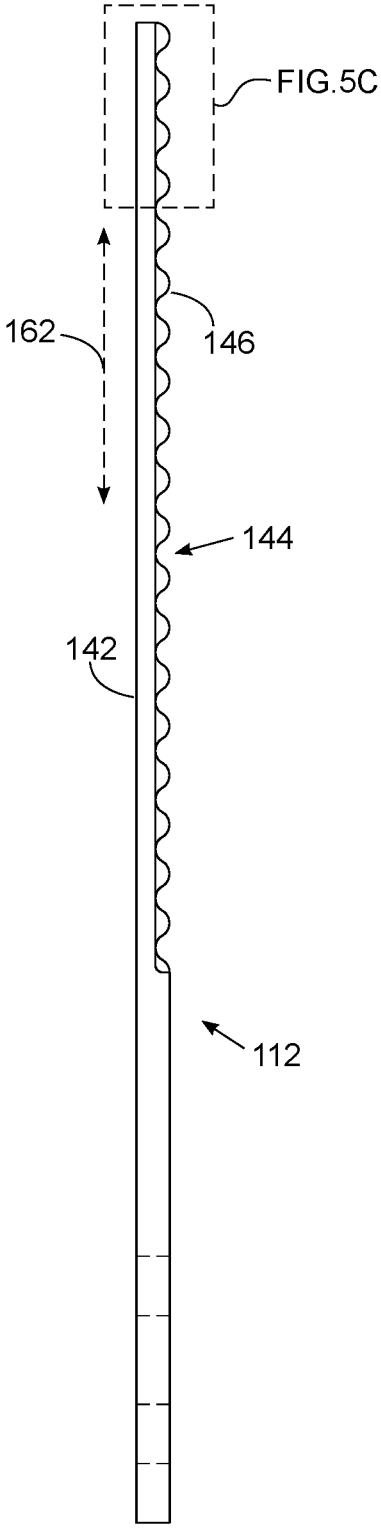
Figure 5C:
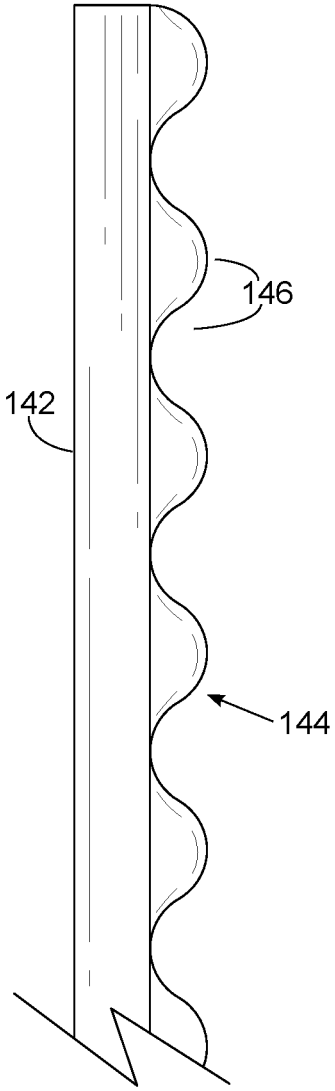
Figure 5D:
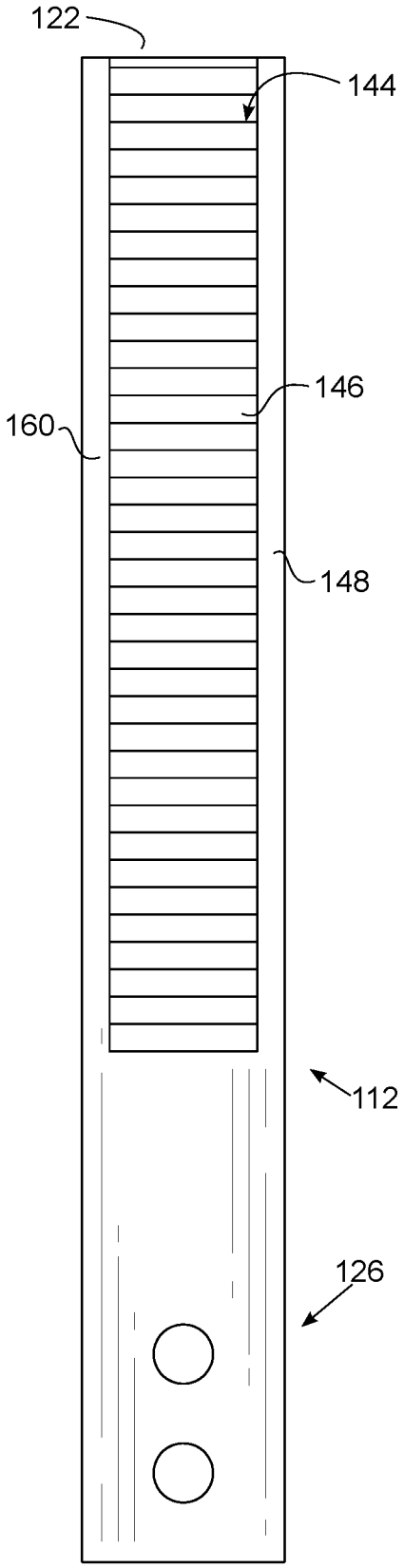
Figure 5E:
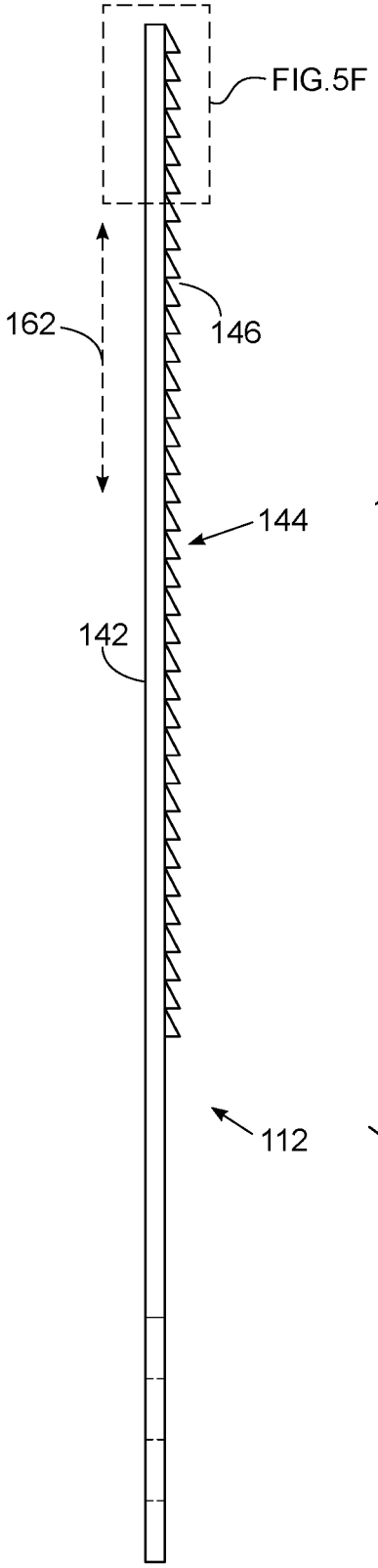
Figure 5F:
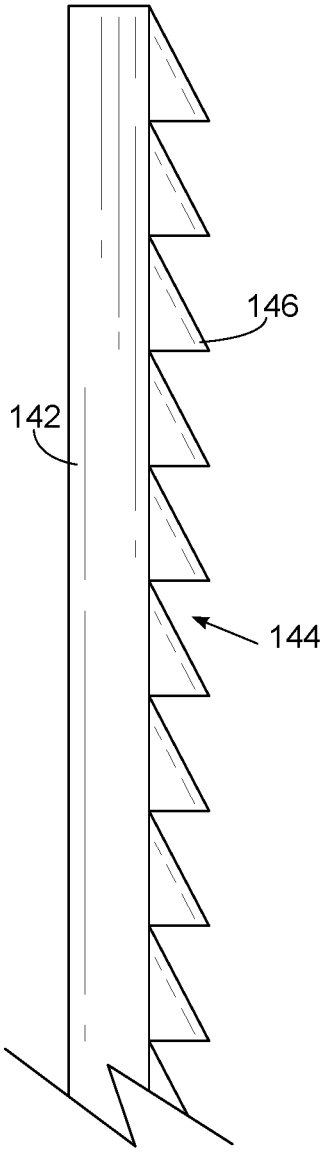

FIGS. 5A to 5C are non-limiting, exemplary, detailed illustrations of an adjusting member illustratively shown in FIGS. 1A to 4E, with FIG. 5A illustrating bottom or engagement side of the adjusting member, FIG. 5B illustrating a profile (or side) view the adjusting member, and FIG. 5C illustrating an enlarged portion form the profile view of FIG. 5B in accordance with one or more embodiments of the present invention. As illustrated in FIGS. 1A to 5C, adjusting member 112 is comprised of an un-serrated side (top side) 142 (FIGS. 5B and 5C) and a bottom side surface (serrated side) 144. Bottom side surface 144 of adjusting member 112 is comprised of serrations 146 that extend transversally in relation to a longitudinal axis 162 of adjusting member 112. As further illustrated, serrations 146 do not extend the full width of adjusting member 112, providing a lateral smooth surface 148 and 160 for a smooth insertion and extraction of adjusting member 112 in relation to support member 202 (detailed below). Serrations 146 improve grip with the associated engagement section 214 of channel 218 of mounting support 202. On the other hand, top side surface 142 is substantially smooth to reduce friction with cam section 238 of lever assembly 206, which aids in passive movement of lever assembly 206 (due to gravity and momentum) from hold to release position. Adjusting member 112 includes a distal end 126 that may be associated with bin 104 or lid 106 of bin 104. It should be noted that serrations 146 may comprise of different configurations, non-limiting examples of which may include a smooth wave profile (e.g., corrugations shown in FIGS. 5A to 5C) or, alternatively, saw-tooth profile (shown in FIGS. 5D to 5F) or other configurations (e.g., surfaces with protruded profiles such as rectangular, triangular, etc.).

FIGS. 6A to 6G are non-limiting, exemplary, detailed illustrations of a mounting support illustratively shown in FIGS. 1A to 4E in accordance with one or more embodiments of the present invention. As illustrated in FIGS. 1A to 6G, mounting support 202 is comprised of a base 250 and lateral supports 252 and 254 that protrude at an angle (generally vertically) from base 250 of mounting support 202. Lateral supports 252 and 254 in combination with base 250 define a channel 218 through which adjusting member 112 is passed and within which serrations 146 of adjusting member 112 engage with serrations 258 of engagement section 214 of a channel-base 216 of channel 218. It should be noted that serrations 258 of engagement section 214 may comprise of different configurations, non-limiting examples of which may include a smooth wave profile (e.g., corrugations shown in FIGS. 6A to 6G) or, alternatively, saw-tooth profile (shown in FIGS. 7A to 7F) or other configurations.

Base 250 of mounting support 202 includes a pair of mounting extensions 260 and 262 that include an attachment hole 256 for mechanically connecting mounting support 202 onto bin 104 or lid 106 of bin 104. Attachment holes 256 on the mounting extensions 260 and 262 enable the use of fasteners to couple mounting support 202 onto bin 104 or lid 106 of bin 104. The position of attachment holes 256 may be varied. For example, base 250 of mounting support 202 may have mounting extensions at insertion and extraction sides 208 and 210 instead of the illustrated lateral mounting extensions 260 and 262 with attachment holes 256. In other words, attachment holes 256 need not be positioned laterally, but may be positioned (with a wider base) along insertion/extraction sides 208 and 210 of mounting support 202. It should be noted that the number of attachment holes 256 should not be limited to only two, but may be greater than two.

It should be noted that the mounting method or mechanism may include or use magnets, glue, spring clip or others to fasten onto bin 104 or lid 106 of bin 104 instead of using fasteners. Other mechanism for connecting mounting support 202 onto bin 104 or lid 106 of bin 104 is contemplated, including, for example, the bin or the lid and the mounting support having complementary interlocking features that interlock without the use of fasteners (e.g., recess/projection connections). As a non-limiting, specific example, the mounting support may be secured without the use of fasteners and instead, secured by a snap action into a preformed receptacle of the bin or lid.

Mounting support 202 further includes lateral supports 252 and 254 for supporting lever assembly 206. Lateral supports 252 and 254 include a pair of openings 264 and 266 that establish a pivot point 320 for lever assembly 206, with openings 264 and 266 aligned with opening 322 of lever 220 to receive fastener 242. Lateral supports 252 and 254 have a first side 270 and 272 (inner facing sides that face channel 218) that includes recesses 274 and 276 that define first limiters 278 and 280 at insertion side 218 of mounting support 202 and second limiters 282 and 284 at extraction side 210 of mounting support 202. Lateral supports 252 and 254 have a second sides 292 and 294 (outer facing sides in relation to channel 218) that have a generally constant height 306 from insertion side 208 to extraction side, with first sides 270 and 272 of lateral supports 252 and 254 having a height 302 that varies (decreases) in span from insertion side 208 to extraction side 210 commensurate with the inclined 205 (ascending) of channel-base 216 (detailed below). It should be noted that channel base 216 at insertion side 208 is at the lowest elevation of the ascending channel base 216 in addition to being curved, both of which aspects or feature function as "chamfered end" to facilitate ease of insertion and release of adjusting member 112.

Second limiter 282 and 284 are alignment supports that generally limit the motion of lever assembly 206 at hold position while supporting an apex 248 of a protruded portion 238 of lever assembly 206 aligned in appropriate relative position in a sliding contact with top surface 142 of adjusting member 112 to impart pressure thereon and move adjusting member 112 into a tight engagement with serrations 258 engagement section 214 of mounting support 202, with cam portion 238 providing maximum pressure on top surface 142 of adjusting member 112. It should be noted that apex 248 is generally directly underneath or below opening 322 (pivot point 320) of lever assembly 206 (as illustrated by arrows 203 in FIGS. 4A and 4B).

Recesses 274 and 276 at inner sides 270 and 272 of lateral supports 252 and 254 have sufficient depth 296 to support and facilitate mounting of lever assembly 206 onto mounting support 202, with contour of recesses 274 and 276 generally following a profile (or counter) of cam portion 238 of distal end 240 of lever assembly 206. Recesses 274 and 276 accommodate a width 286 of protruded portion 238 of distal end 240 of lever assembly 206 (which is wider than a width 288 of channel-base 216), while limiting width 288 of channel-base 216 at a span that appropriately guides insertion of adjusting member 112 to prevent lateral motion of adjusting member 112 during insertion and removal. Accordingly, cam portion 238 of lever assembly 206 is made sufficiently wide for added strength, which is accommodated by recesses 274 and 276. Further, recesses 274 and 276 enable width 288 of channel-base 216 to be of sufficiently narrow span to receive and release adjusting member 112 without much lateral motion, further facilitating unhindered or unobstructed insertion and release of adjusting member 112. If adjusting member 112 is moved or force inserted into and released out of channel 218 of retainer member 110 at an angle (misaligned), serrations 146 of adjusting member 112 (FIGS. 5A to 5F) may engage serrations 258 of engagement section 214 of channel base 216 at an angle, which may damage engagement section serrations 258 over time. Limiting or preventing lateral motion of adjusting member 112 while being inserted or released prevents improper engagement of serrations 146 and 258. Therefore, channel-base width 288 operates as a guide or alignment feature for insertion and removal of adjusting member 112.

First sides 270 and 272 of lateral supports 252 and 254 may be made flat without any recesses to accommodate lever assembly 106 if channel-base width 288 is made wider, but adjusting member 112 used must be wider or otherwise, the serrations 146 and 258 may eventually be damaged over time (as per above). In the non-limiting, exemplary embodiment where no recesses 274 and 276 are provided, embossments or flanges may be positioned at first sides 270 and 272 of lateral supports 252 and 254 to function as limiters to limit a range of motion of lever assembly 206 (as detailed above). Nonetheless, distance between inner sides 270 and 272 of lateral supports 252 and 254 is therefore made sufficiently small to insert/release adjusting member 112 without much lateral motion, with recesses 274 and 276 providing greater width 290 for channel 218 above channel-base 216 to accommodate a wider cam portion 238 of lever assembly 206 for added strength for the lever assembly 206.

It should be noted that recesses 274 and 276 (which are mirror images and identical and located on inner side 270 and 272 of the lateral supports 252 and 254) do not take away from the overall strength of lateral supports 252 and 254 because a width 298 of lateral supports 252 and 254 may be extended (made wider or thicker) at or from outer sides 292 and 294 (outside of channel 218) as much as needed to compensate for any potential or possible strength that may be lost due to excavated parts that constitute recesses 274 and 276 (if any). Therefore, lateral supports 252 and 254 may be made as thick as desired at or from outer sides 292 and 294, while maintaining all other features (example, channel-base width 288) as described above.

Figure 6A:
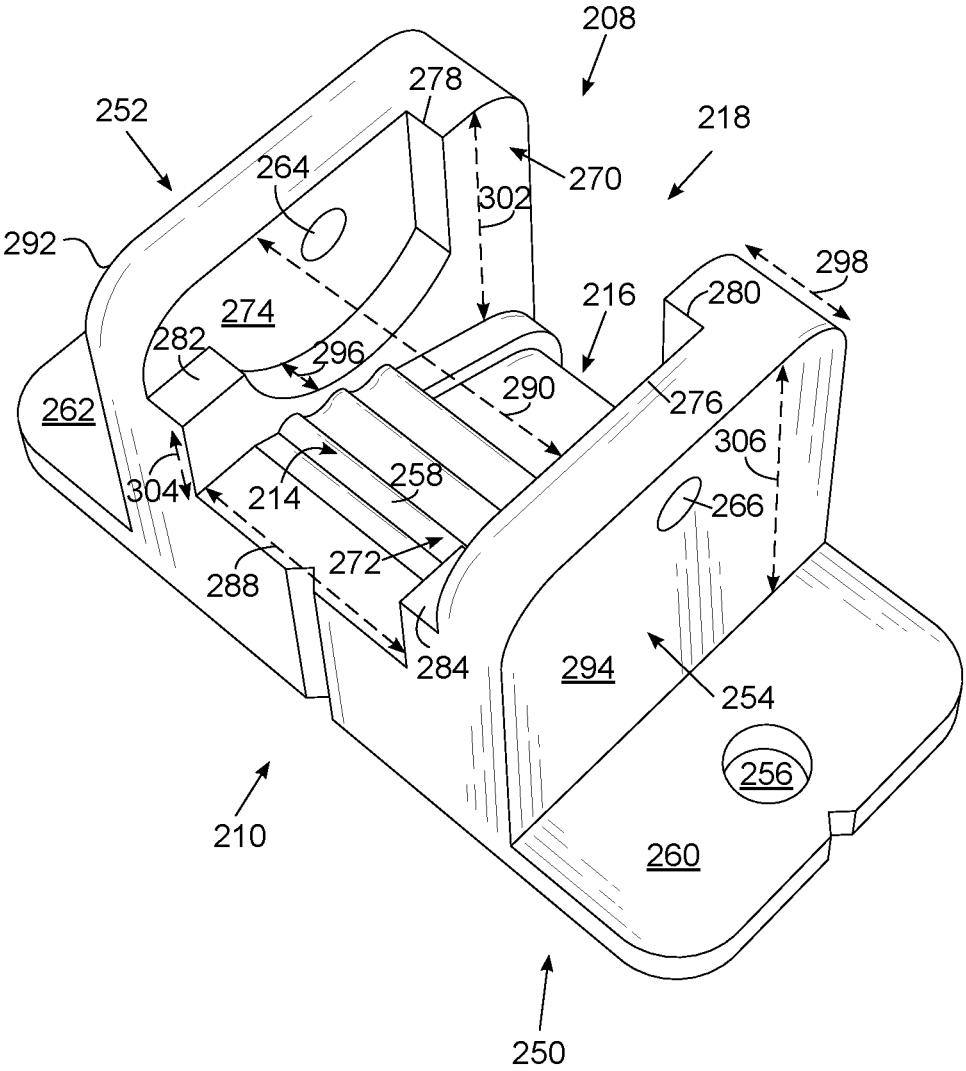
FIGS. 6A to 6G are non-limiting, exemplary, detailed illustrations of a mounting support illustratively shown in FIGS. 1A to 4E in accordance with one or more embodiments of the present invention.
Figure 6B:
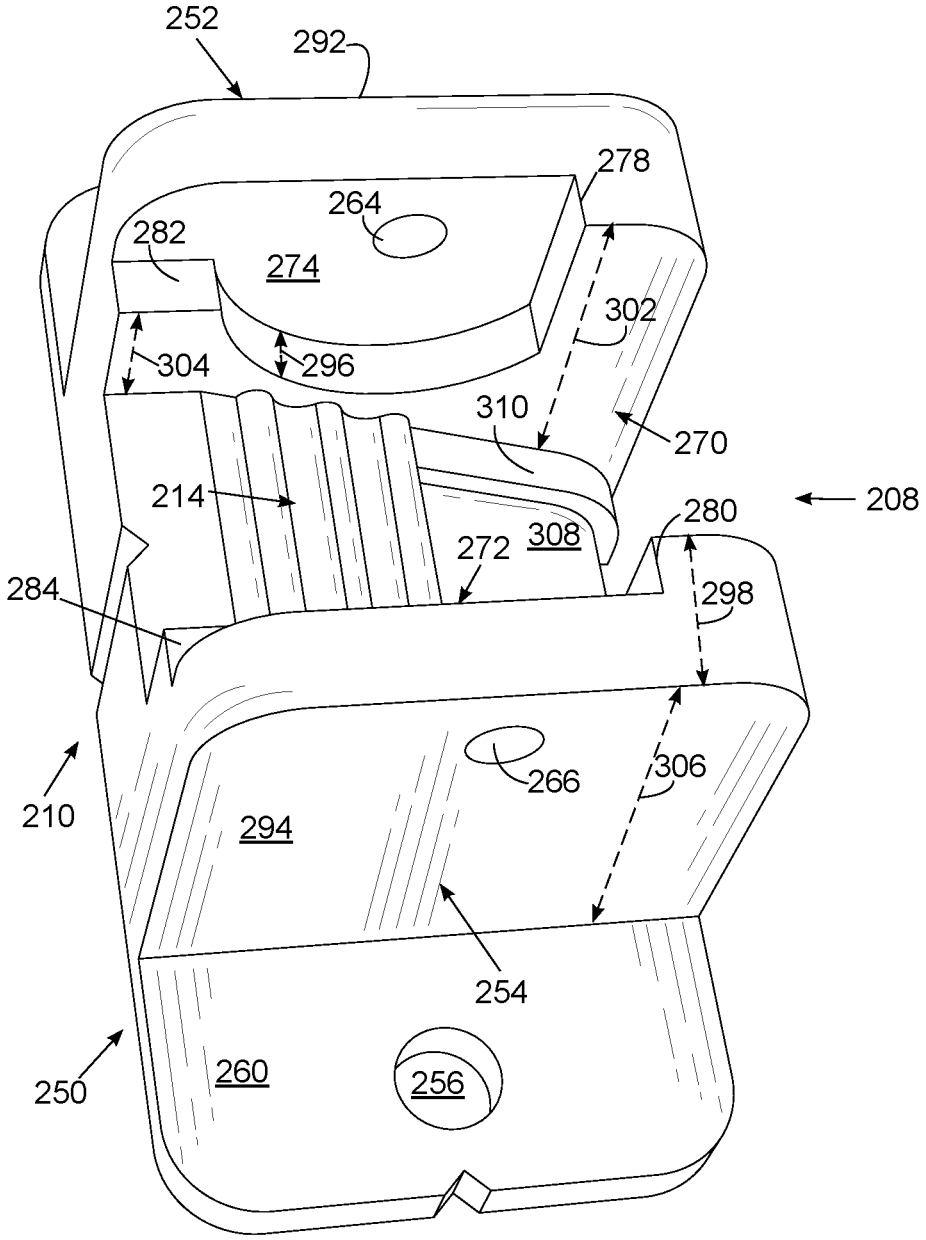
Figure 6C:
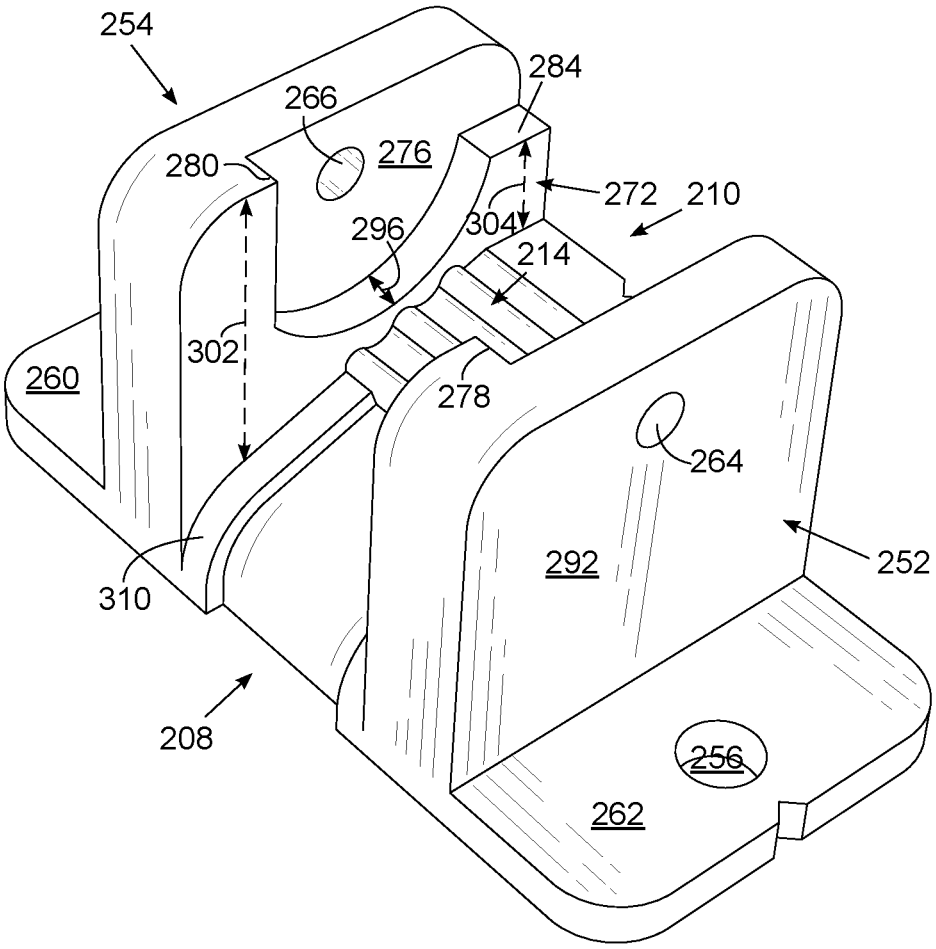
Figure 6D:
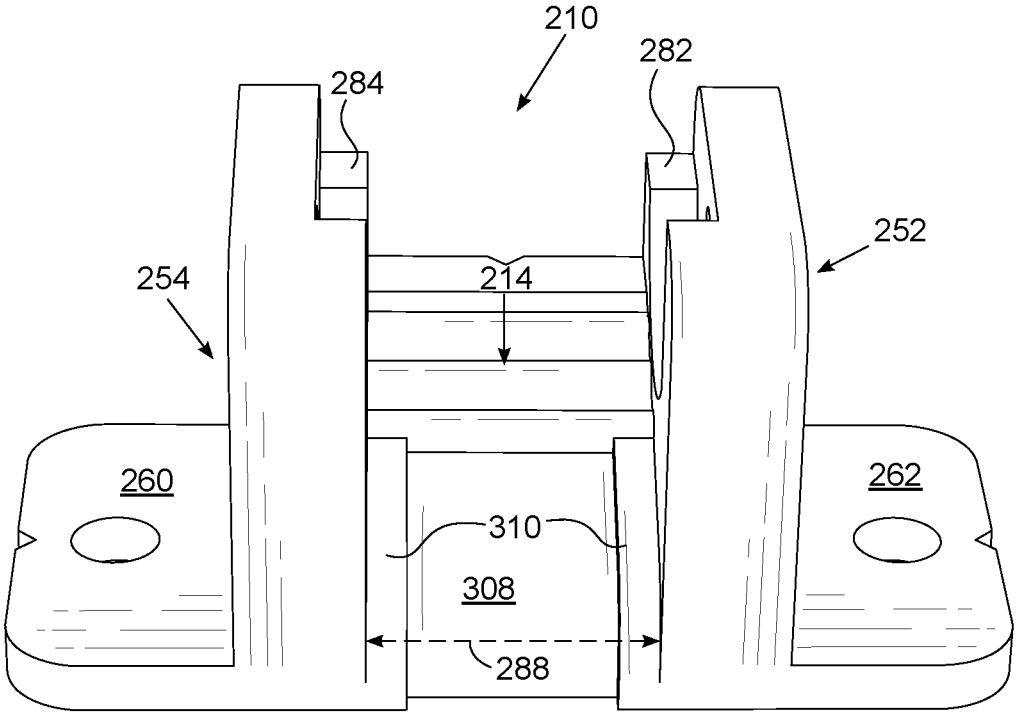
Figure 6E:
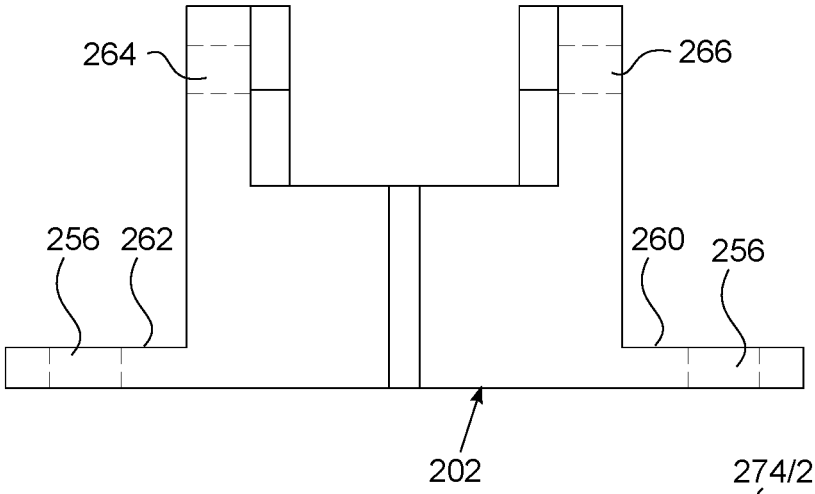
Figure 6F:
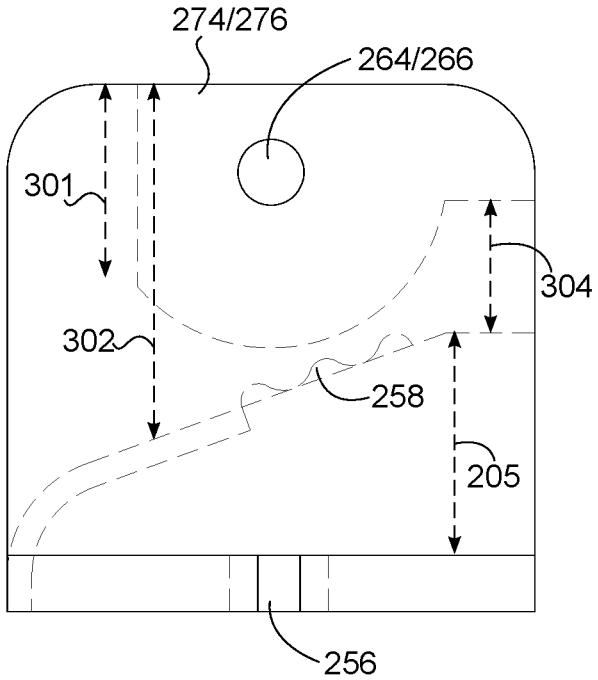
Figure 6G:
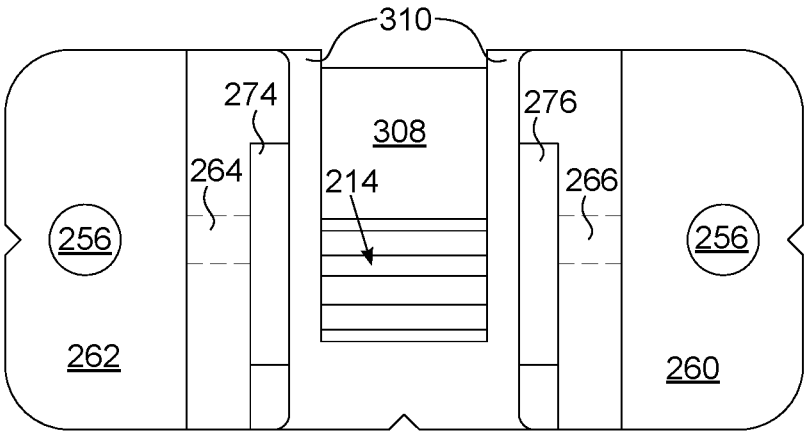
Figure 7A:
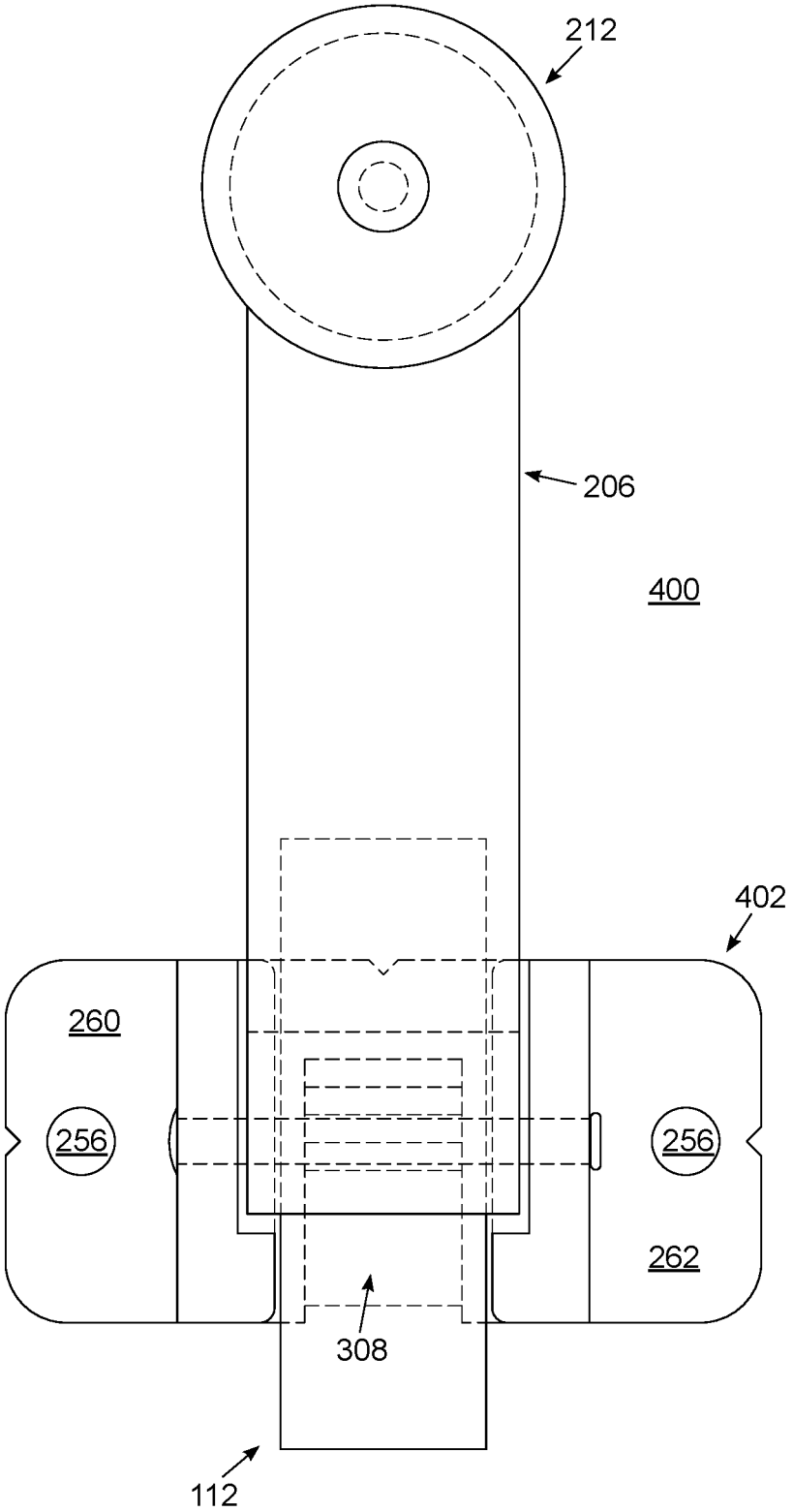
FIGS. 7A to 7F are non-limiting, exemplary, detailed illustrations of another embodiment of a retainer mechanism illustrated in FIGS. 1A to 6D in accordance with one or more embodiment of the present invention.
Figure 7B:
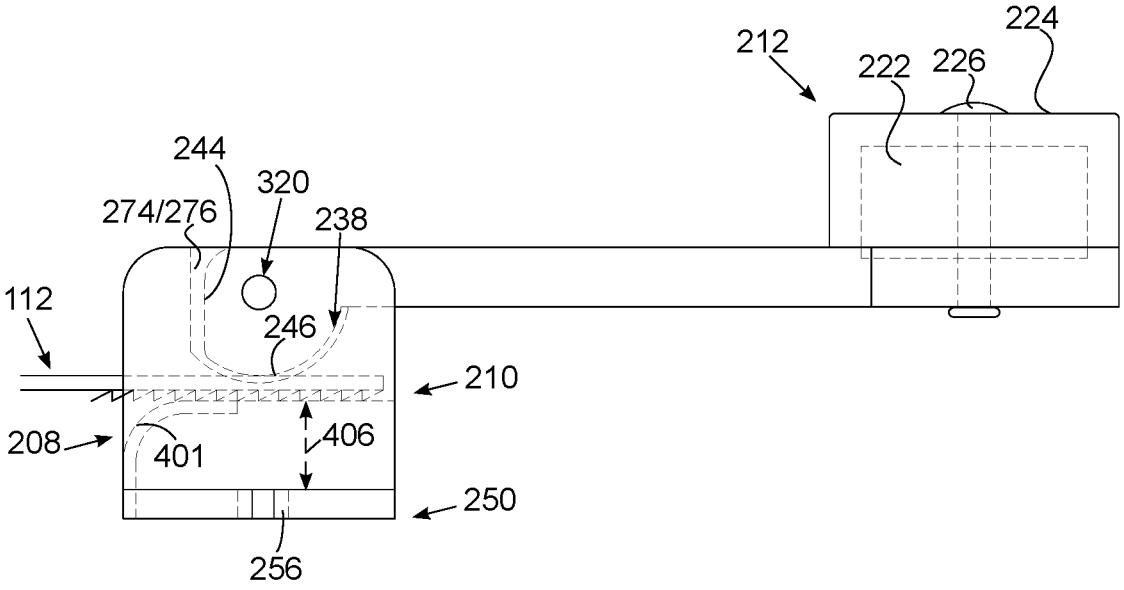
Figure 7C:
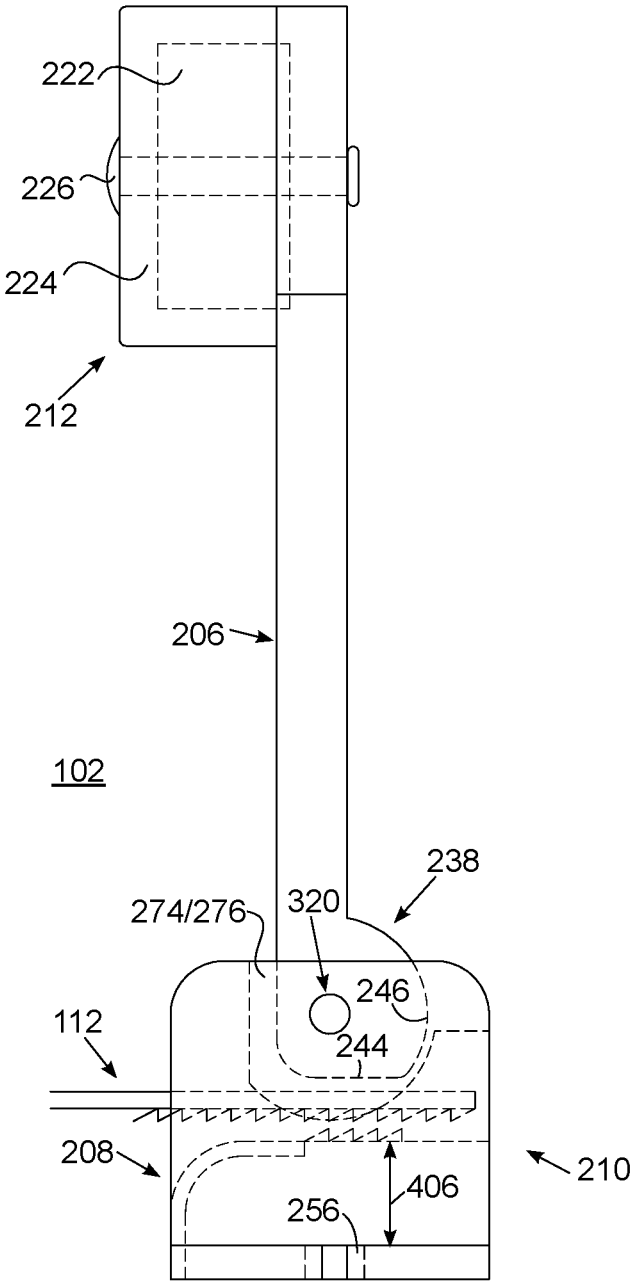
Figure 7D:
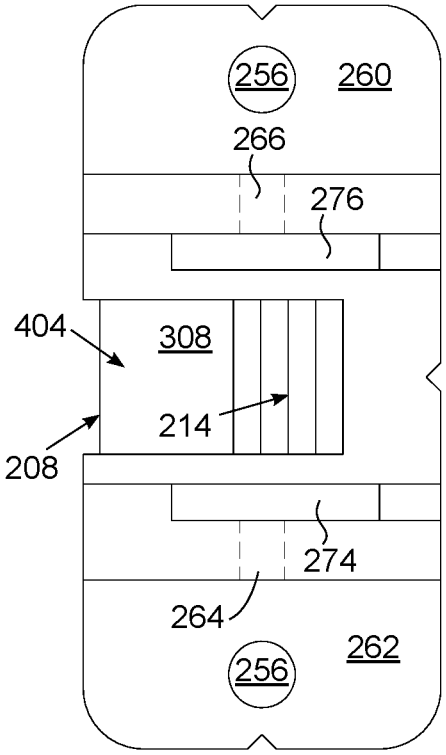
Figure 7E:
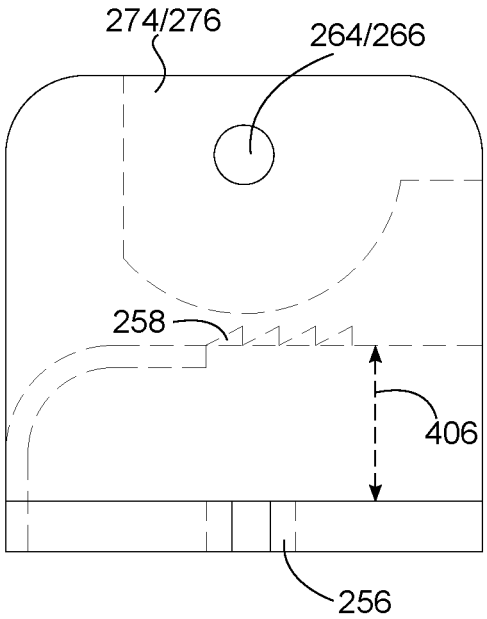
Figure 7F:
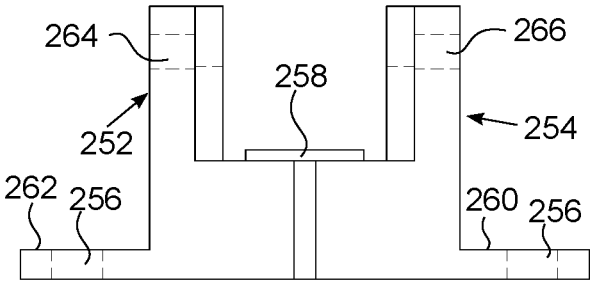

Recesses 274 and 276 respectively define limiters 278 and 280 at insertion side 208 and limiters 282 and 284 at extraction sides 210 of lateral supports 252 and 254, which limit a range of motion of lever assembly 206 from a fully open (release) position to a fully latched (or hold) position. The hold position of lever assembly 206 is at a first angle (e.g., generally parallel base 250 of retainer member 110), and release or open position is generally a rotation to a second angle (generally passed, but near perpendicular to base 250 of retainer member 110). Accordingly (and as best illustrated in FIG. 6F), insertion side limiters 278 and 280 have a higher height different of 301 than a height 304 of extraction side limiter 282 and 284, which are shorter.

Insertion side limiters 278 and 280 prevent lever assembly 206 from rotating too far (e.g., as shown by dashed line 324 in FIG. 2I) when lever assembly 206 is at release position. When retainer member 110 is mounted onto a lid and lever assembly 206 is at release position resting against insertion side limiters 278 and 280, lever assembly 206 may be used (as a "push down handle") to move lid 106 to a closed position in relation to an overfilled bin 104 and further, lever assembly 206 is maintained at release position due to insertion side limiter 278 and 280, which facilitate ease of insertion of adjusting member 112 by preventing lever assembly 206 from interfering with insertion of adjusting member 112. Insertion side limiter 278 and 280 further prevent lever assembly from rotating too far past the front edge of lid 106, which prevents the lever from striking a curb side of a sidewalk. That is, the release position angle enables lever assembly 206 to clear the curb of a road in case the open lid 106 (and hence bin 104) is brought or moved too close to the curb during emptying of bin 104. For example, there may be times when a user may swing and actually flip open lid 106 adjacent back of bin 104 to add content into bin 104. When lid 206 flip opens, lever assembly 206 may swing from a default hold position (as shown in FIG. 1A, if retainer member 110 is connected to lid 106) to open or release position and if there is a curb, the weighted end 228 of lever assembly 206 may strike the curb. The insertion side limiters 278 and 280 maintain weighted end 228 of lever assembly 206 at a position away from the curb when lid 106 flipped open. It should be noted that lid 106 is large compared to the overall height of bin 104, covering almost ¾ of the height of bin 104 and hence, lever assembly 206, which is extended further than free end 114 of lid 106, has the potential of striking against the curb when lid 106 is flipped to open position. Therefore, insertion side limiter 278 and 280 maintain lever assembly 206 at a higher position so that lever assembly 206 would not reach the curb.

Extraction side limiters 282 and 284 operate to prevent lever assembly 206 from interfering with adjusting member 112 when being removed. That is, extraction side limiters 282 and 284 limit range of motion of lever assembly 206 to a generally parallel orientation with base 250, preventing lever assembly 206 from having a hold position that is too far back (as best illustrated by dashed line 320 in FIG. 2F), which would require lever assembly 206 from being moved from hold position (at 320) to release position when bin 104 is emptied. By maintaining lever assembly 206 at higher level (at extraction side limiters 282 and 284), bin 104 need not be tilted more than 90° degrees to enable lever assembly 206 to passively move to release position. Extraction side limiter 282 and 284 move the center of gravity of the weighted end 228 of lever assembly 206 to a higher elevation 322, which facilitates the passive motion of lever assembly 206 to release position when bin 104 is tilted to be emptied.

As further illustrated in FIGS. 6A to 6G, channel-base 216 of mounting support 202 is at an incline 205 that ascends or rises from insertion side 208 to extraction side 210. Further, channel-base 216 is comprised of recessed portion 308 at insertion side 208 of mounting support 202 that define lateral projections (or "side-rails") 310 that extend and ascend or rise from insertion side 208 to engagement section 214 of channel-base 216.

Lateral projections (or side-rails) 310 enable lateral smooth surfaces 148 and 160 (FIG. 5A) of adjusting member 112 to slide on top of rails 310 during insertion and release of adjusting member 112 and further, enable serrated surface 146 of adjusting member 112 to remain above recessed portion 308 of channel-base 216 at the insertion side 208 during insertion or release of adjusting member 112. In other words, serrations 146 of adjusting member 112 extend into recess portion 308, but without contacting the "bottom floor" of channel-base 216 at recess portion 308. Rails 310 further facilitate easy insertion and release of adjusting member 112 when lever assembly is at release position.

Engagement section 214 of channel 218 is near extraction side 210 of retainer member 110, at a higher elevation compared with recess portion 308. It should be noted that a less preferred embodiment would be to have the entire channel-base 216 comprised of engagement section 214 where serrations 258 extend from insertion side 208 to extraction side 210. However, providing serrations 258 throughout channel base 216 would interfere with ease of insertion of adjusting member 112 (due to serrations 146 of adjusting member 112) and further, such an arrangement would also hinder release of adjusting member 112. That is, as adjusting member 112 is released, serrations 146 of adjusting member 112 would continue to engage serrations 258 of channel-base 216 from extraction side 210 to insertion side 208 as adjusting member 112 is released. By limiting engagement section 214 to the specified location, area, and size necessary, it allows for a smooth, and unhindered release and exit of adjusting member 112 while latching adjusting member 112 at hold position when lever assembly 206 is at hold position.

Locations of serrations 258 also align with position of engagement of cam portion 246 with adjusting member 112, which is below pivot point 320. That is, apex 248 of cam portion 246 of lever 220 is aligned in appropriate relative position in a sliding contact with top surface 142 of adjusting member 112 (on top of or above the serrations 258 of engagement section 214) to impart pressure thereon and move serrations 146 of adjusting member 112 in to a tight engagement with serrations 258 of engagement section 214 of mounting support 202 by providing maximum pressure on top surface 142 of adjusting member 112.

Channel base 216 of mounting support 202 of retainer member 110 is sloped at an angle to facilitate insertion of adjusting member 112. Further, if retainer member 110 is connected with bin 104, the slopping channel base 216 is generally at an angle to commensurately offset an angular incline of a slanted side of bin 104 with which the retainer member is coupled, which may maintain lever assembly at a hold position. Accordingly, when installed on lid 106 of bin 104, insertion side 208 of retainer member 110 is installed oriented near an edge of free end of lid 106, near rim 152 of opening 150 at side 116. Further, when installed on bin 104, insertion side 208 of retainer member 110 is installed oriented near rim 152 of opening 150 at side 116. This way, engagement section 214 (serration 258 of channel-base 216) is always oriented away from the edge of the free end of lid 106 or rim 152 of opening 150 of side 116 of bin 104, with ascending slope rising away from the edge of the free end of lid 106 or side 116 rim 152 of opening 150 of bin 104. It should be noted that installing retainer member 110 on lid 106 of bin 104 or at near a top of bin 104 as illustrated positions retainer mechanism 102 away from interfering with operations of the fully automatic or semi-automatic lift mechanism.

FIGS. 7A to 7F are non-limiting, exemplary, detailed illustrations of another embodiment of a retainer mechanism illustrated in FIGS. 1A to 6D in accordance with one or more embodiment of the present invention. Retainer mechanism 400 illustrated in FIGS. 7A to 7F includes similar corresponding or equivalent components, interconnections, functional, operational, and or cooperative relationships as retainer mechanism 102 that is shown in FIGS. 1A to 6D, and described above. Therefore, for the sake of brevity, clarity, convenience, and to avoid duplication, the general description of FIGS. 7A to 7F will not repeat every corresponding or equivalent component, interconnections, functional, operational, and or cooperative relationships that has already been described above in relation to retainer mechanism 102 that is shown in FIGS. 1A to 6D.

In this non-limiting, exemplary embodiment, retainer mechanism 400 includes a mounting support 402 with channel-base 404 that is not sloped (but it is elevated to a height of 406 compared to mounting extensions 260 and 262, and is generally flat). As with retainer mechanism 102, in this embodiment also, adjusting member 112 is retained within the mounting support 402 due to mating of serrated surfaces 146 of adjusting member 112 with serration 258 of channel-base 404. As with retainer mechanism 102, in this embodiment also, insertion side 208 of channel-base 404 is curved, defining a "chamfered side" 401 thereof for easy extraction and removal of adjusting member 112.

In this non-limiting, exemplary embodiment, mounting support 402 has been illustratively shown to have a non-limiting, exemplary saw tooth type serrations 258 for example, instead of corrugated type disclosed in FIGS. 6A to 6G. It should be noted that it is generally preferred the configuration of serrations 258 and serrations 146 are of similar type. In other words, if mounting support has saw tooth type serrations 258, then it is preferred that adjusting member 112 also have saw tooth type serrations, and so on.

For saw-tooth type configuration (FIG. 7A to 7F), each saw tooth type serration may include a first surface having a slope that ramp towards an apex of serrations, and a second surface that drops substantially vertically from the apex of serrations. First surface is inclined in an orientation opposite a directional movement that releases adjusting member 112 (that also preferably has saw tooth type serrations best shown in FIGS. 5D to 5F). Saw tooth serrations 258 of FIGS. 7A to 7F are oriented transverse a longitudinal axis of channel-base 216 that interact with serrations 146 of adjusting member 112 (FIGS. 5D to 5F), similar to corrugated serrations 258 of FIGS. 6A to 6G.

Figure 8A:
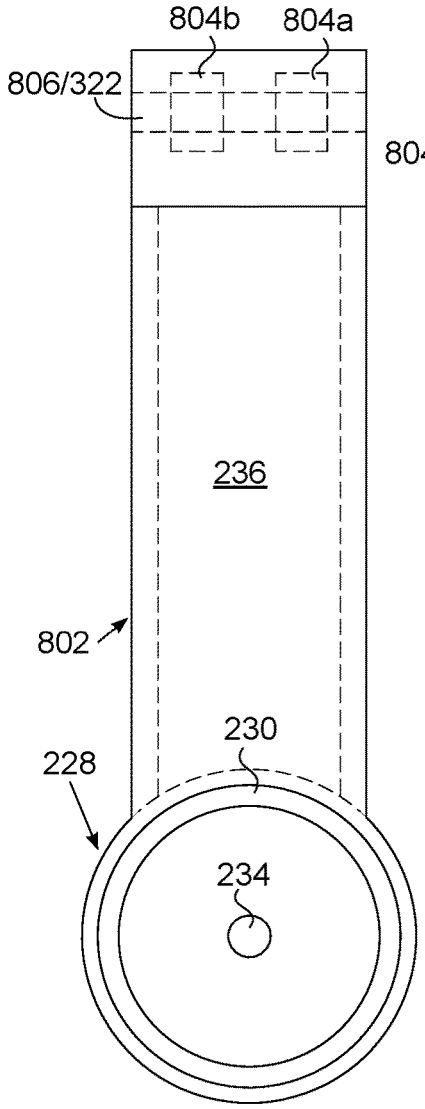
FIGS. 8A to 8C are non-limiting, exemplary detailed illustrations of another embodiment of a lever assembly illustrated in FIGS. 1A to 7F in accordance with one or more embodiments of the present invention.
Figure 8B:
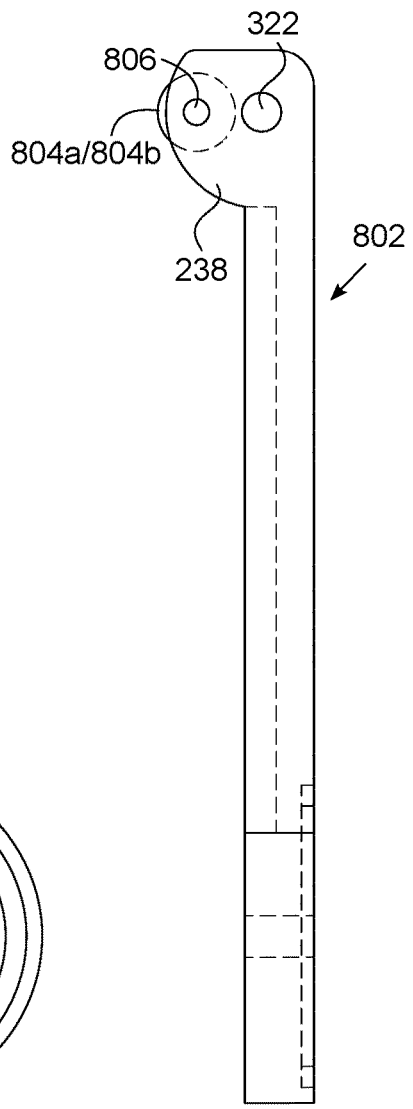
Figure 8C:
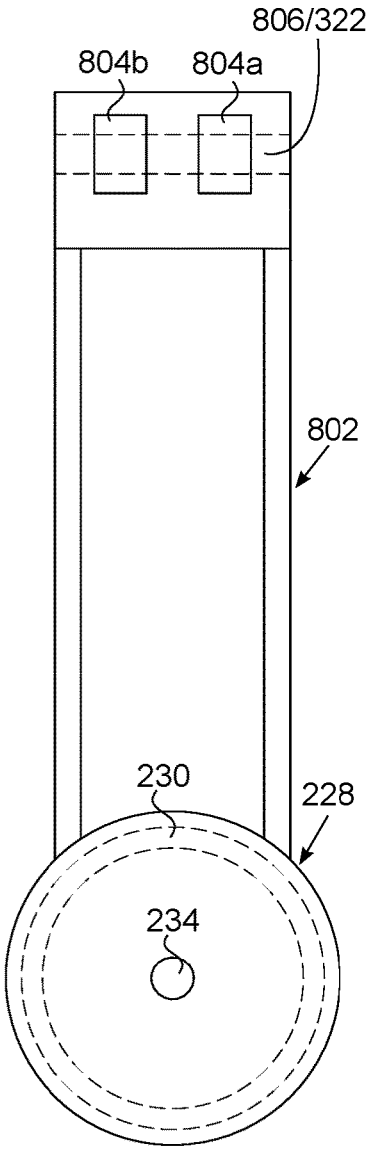

FIGS. 8A to 8C are non-limiting, exemplary illustrations of a lever illustrated in FIGS. 1A to 7F, detailing another embodiment of a lever in accordance with an embodiment of the present invention. Lever 802 illustrated in FIGS. 8A to 8C includes similar corresponding or equivalent components, interconnections, functional, and or cooperative relationships as lever 220 shown in FIGS. 1A to 7F, and described above. Therefore, for the sake of brevity, clarity, convenience, and to avoid duplication, the general description of FIGS. 8A to 8C will not repeat every corresponding or equivalent component, interconnections, functional, and or cooperative relationships that has already been described above in relation to lever 220 that is shown in FIGS. 1A to 7F.

As illustrated in FIGS. 1A to 8C, in this non-limiting, exemplary embodiment, lever 802 has a protruded portion 238 that accommodates a rotating member 804 such as a wheel (or bearing, etc.). It should be noted that lever 802 may easily be used with any one of the embodiments disclosed and shown in FIGS. 1A to 7F. Rotating member 804 is coupled within protruded portion 238 of lever 802 through an axle (such as a pin) that is inserted in an axle hole 806 at protruded portion 238. Accordingly, the one or more rotating member 804 facilitate to further reduce friction between the protruded portion 238 and top surface 142 of adjusting member 112 by their rolling action, which would also enable the use of lesser weight-mass 222, reducing the required torque needed to move lever 802 to release position (FIGS. 1J, 2I, and 7C). In other words, the use of rotating member 804 facilitates improved cam action of protruded portion 238 while reducing friction. Rotating member 804 rotates on top surface 142 of adjusting member 112 rather than sliding action of an apex 246 of protruded portion 238 (best shown in FIGS. 2F to 2I, and 7B and 7C), enabling lever 802 to easily move from a hold or engagement position to a release or disengagement position. As illustrated in FIG. 8B, the rotating member 804 may be a single piece 804 or comprised of two or more pieces 804*a*, 804*b*.

Figure 9A:
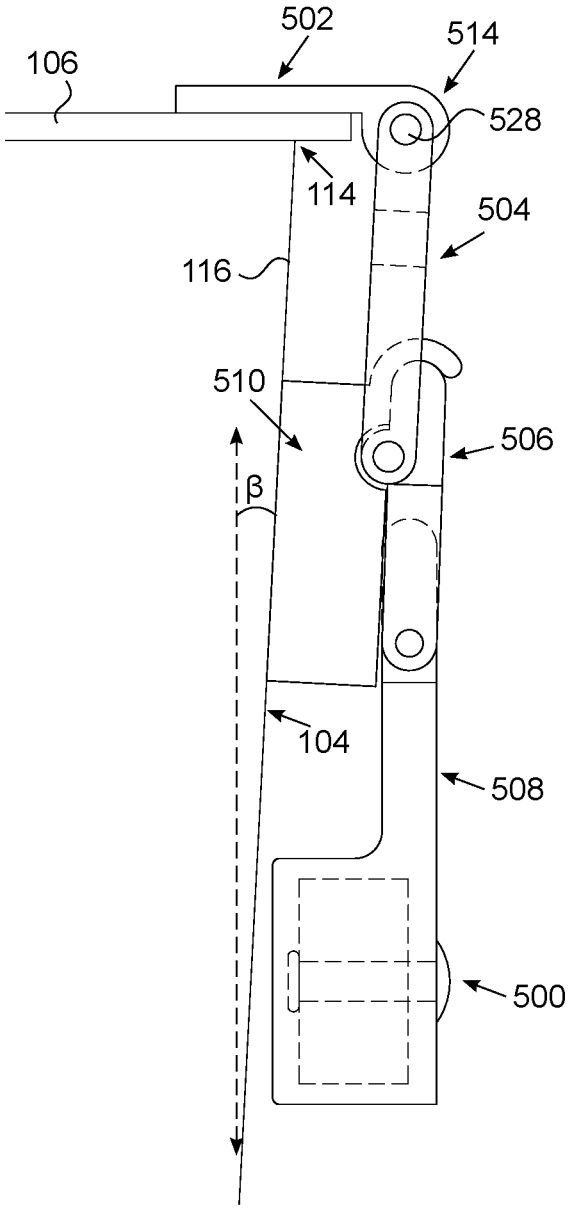
FIGS. 9A to 9R are non-limiting, exemplary, detailed illustrations of another embodiment of a retainer mechanism or parts thereof illustrated in FIGS. 1A to 8C, detailing an embodiment of a retainer member in accordance with one or more embodiment of the present invention.
Figure 9B:
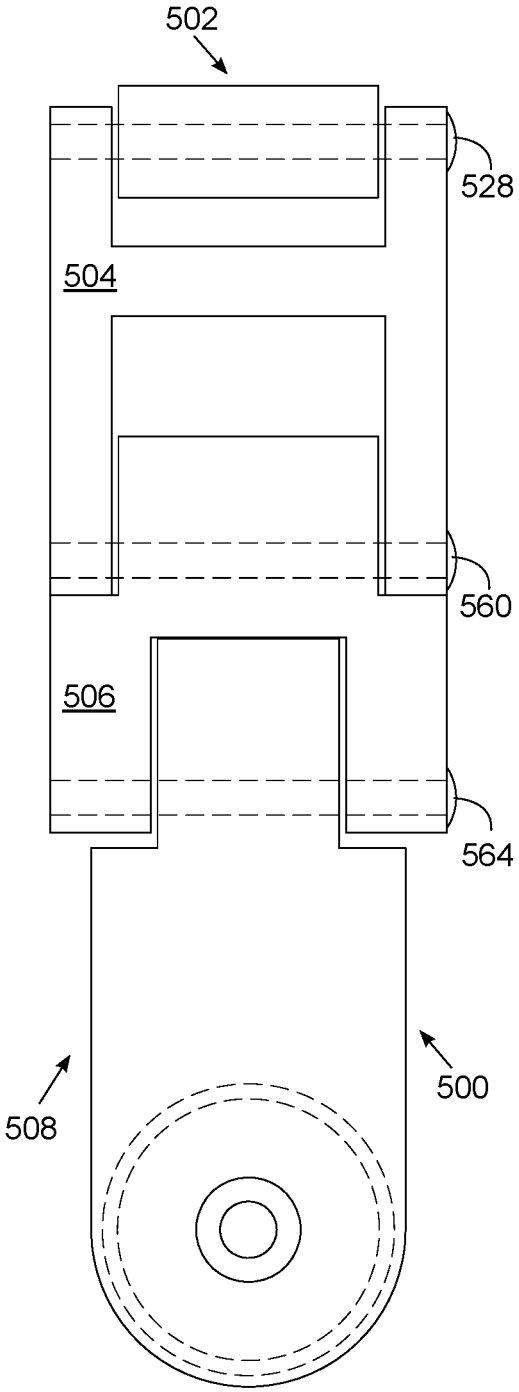
Figure 9C:
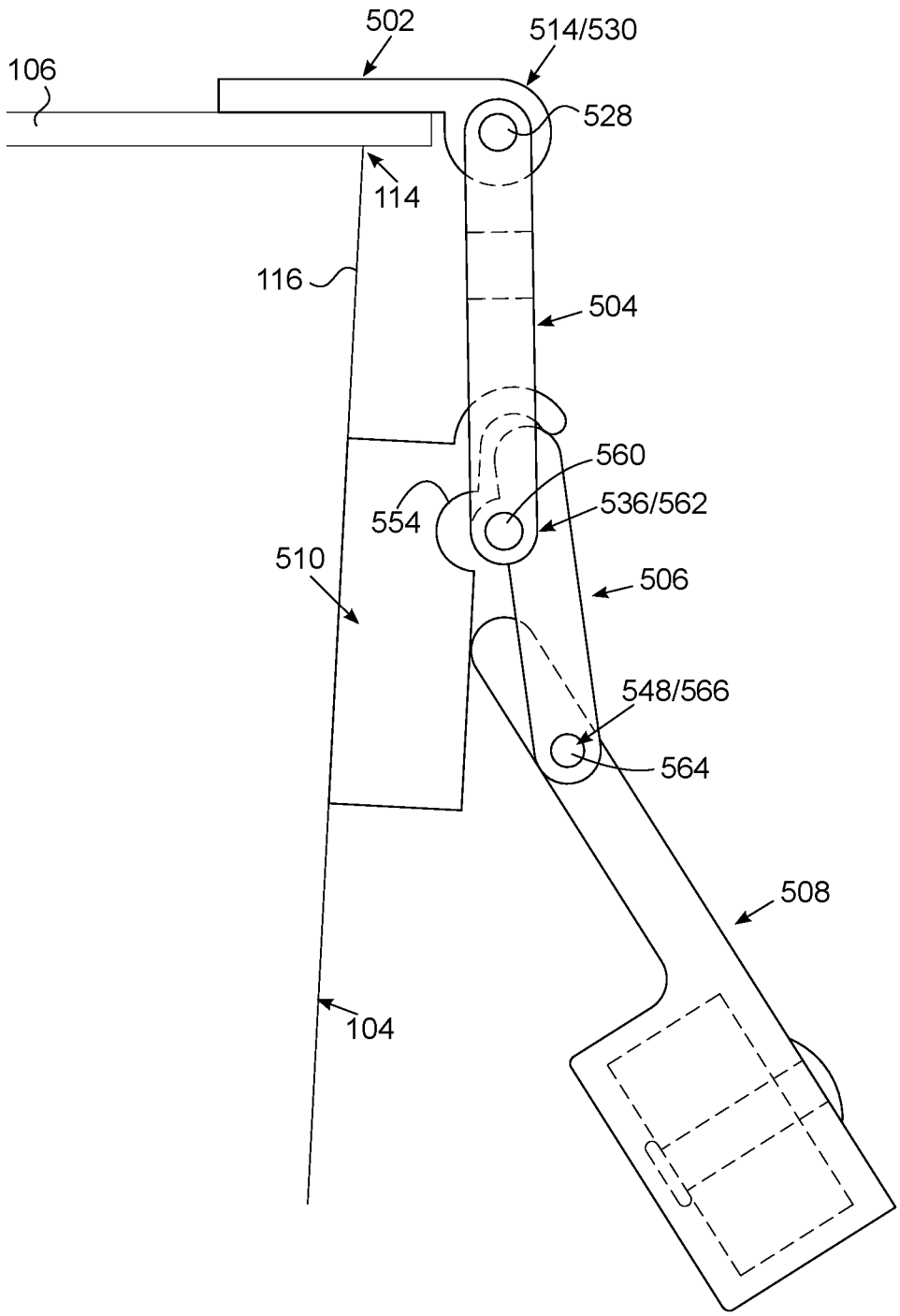
Figure 9D:
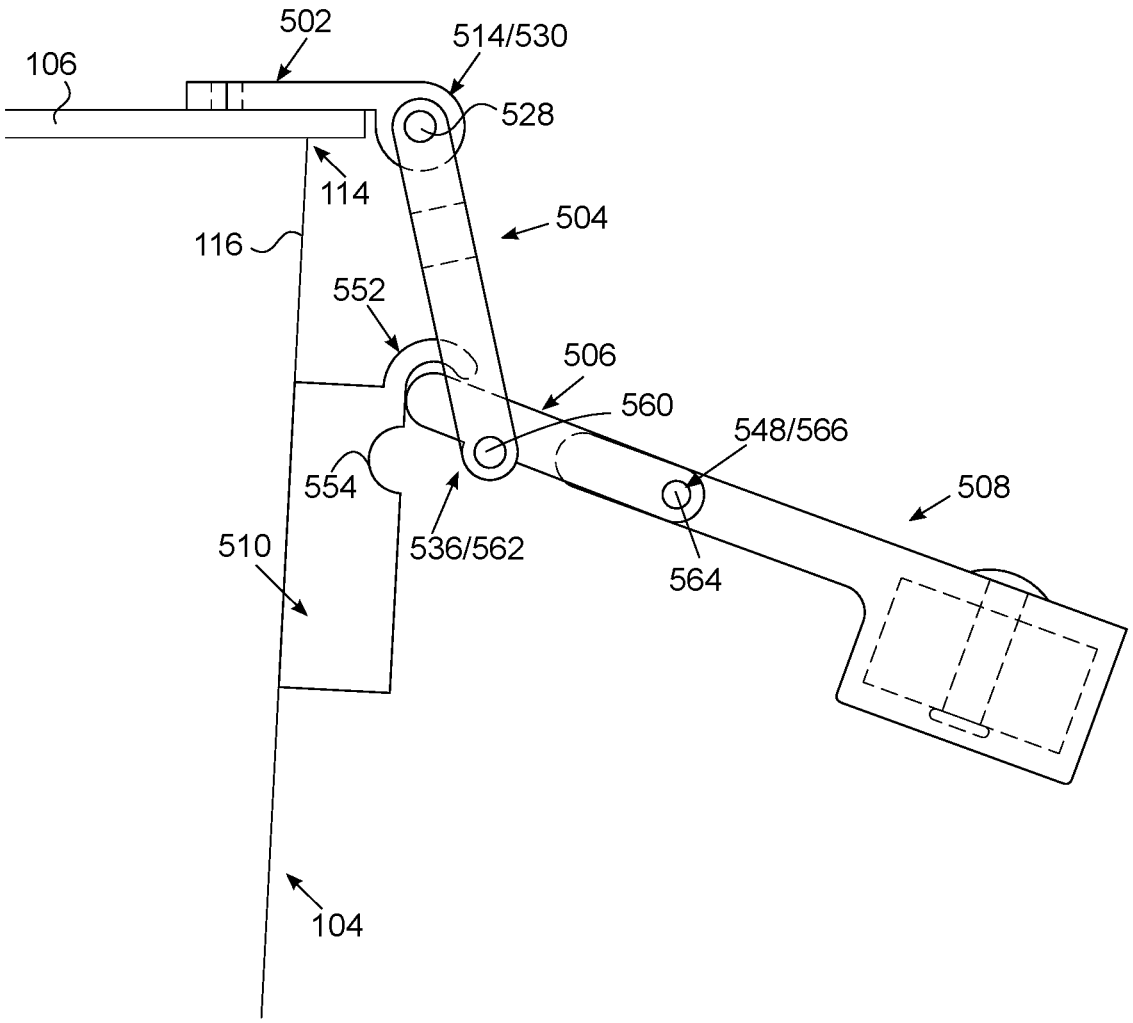
Figure 9E:
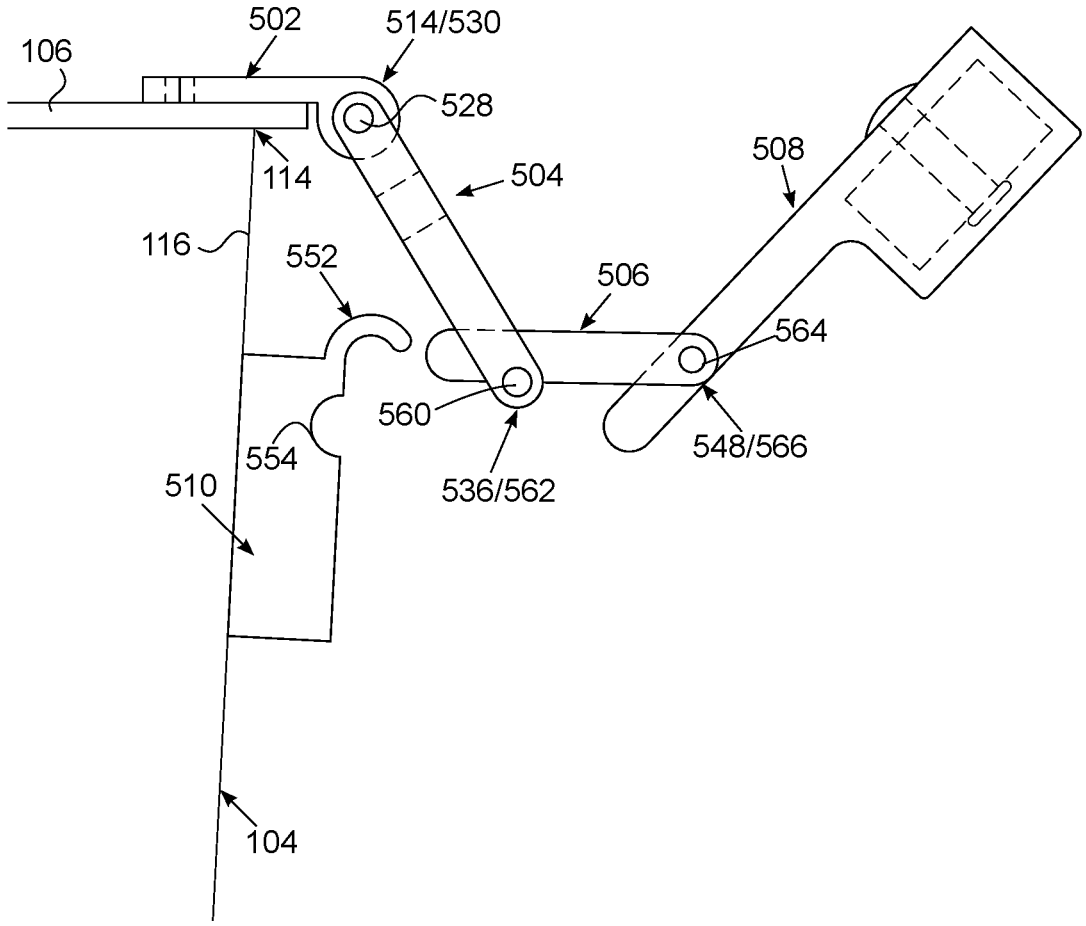
Figure 9F:
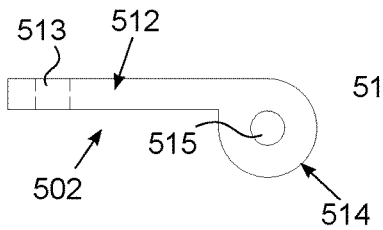
Figure 9G:
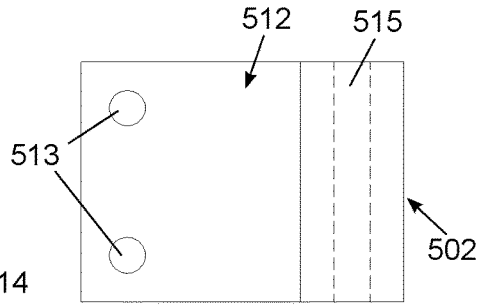
Figure 9H:
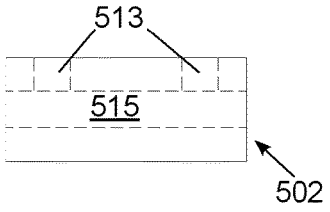
Figure 9I:
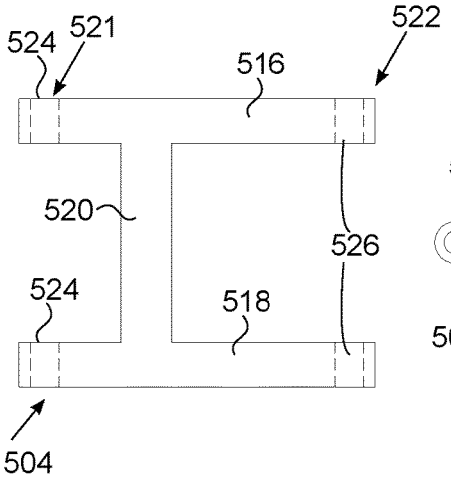
Figure 9J:
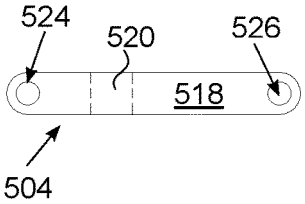
Figure 9K:
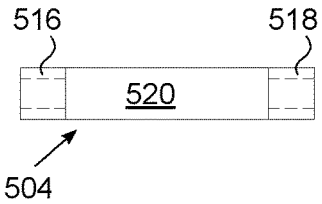
Figure 9L:
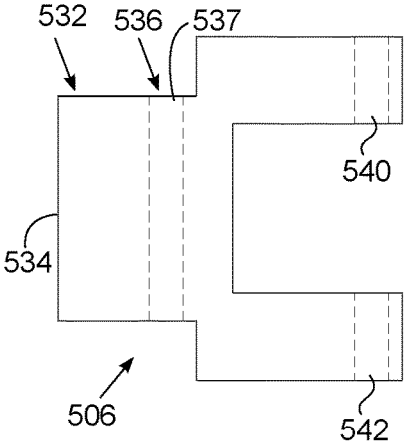
Figure 9M:
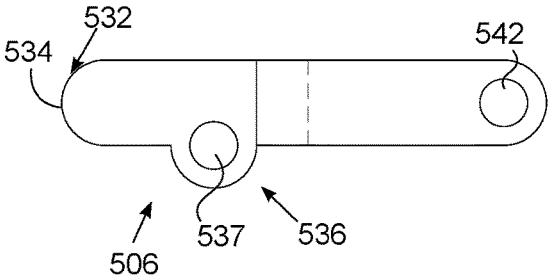
Figure 9N:
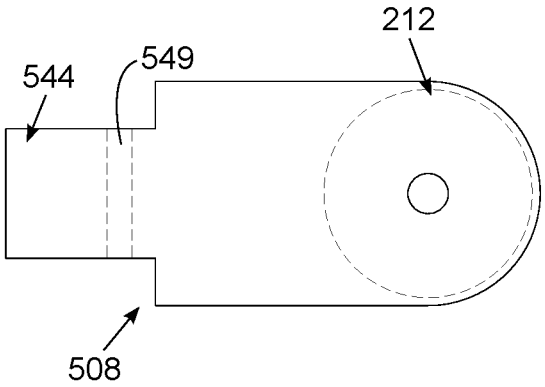
Figure 9O:
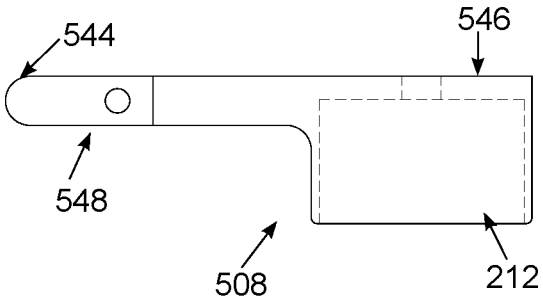
Figure 9P:
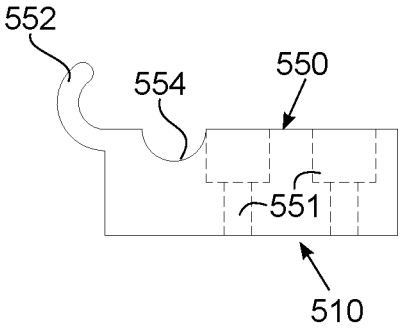
Figure 9Q:
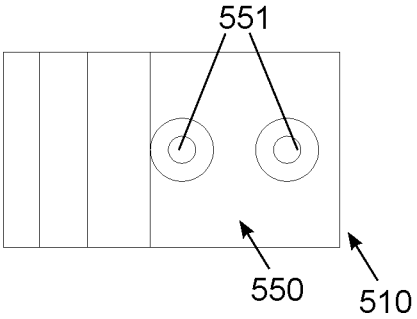
Figure 9R:
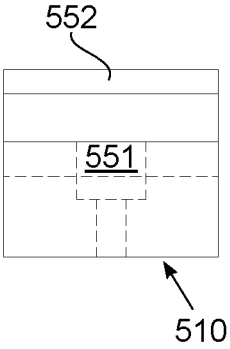

FIGS. 9A to 9R are non-limiting, exemplary, detailed illustrations of an embodiment of a retainer mechanism or parts thereof illustrated in FIGS. 1A to 8C, detailing an embodiment of a retainer member in accordance with an embodiment of the present invention. Retainer mechanism 500 illustrated in FIGS. 9A to 9R includes similar corresponding or equivalent components, interconnections, functional, operational, and or cooperative relationships as retainer mechanisms (or parts thereof) that are shown in FIGS. 1A to 8C, and described above. Therefore, for the sake of brevity, clarity, convenience, and to avoid duplication, the general description of FIGS. 9A to 9R will not repeat every corresponding or equivalent component, interconnections, functional, operational, and or cooperative relationships that has already been described above in relation to retainer mechanisms or parts thereof that are shown in FIGS. 1A to 8C.

As illustrated in FIGS. 9A to 9R, as further detailed below, in this non-limiting, exemplary embodiment, retainer mechanism 500 includes a mounting member 502 associated with lid 106 of bin 104 and an intermediary (or adapter) member 504 that couples a latch member 506 with mounting member 502. Further included is a lever assembly 508 coupled with latch member 506. Retainer mechanism 500 further includes a catch member 510 that receives and detachably latches latch member 506. As illustrated, with this embodiment, lid 106 of bin 104 must close and contact outer rim 152 of opening 150 of bin 104. In other words, lid 106 will not latch with bin 104 using retainer mechanism 500 if bin 104 is overfull.

FIGS. 9A to 9D are non-limiting, exemplary illustrations that progressively show securing and eventual release of lid 106 of bin 104 using retainer mechanism 500 in accordance with the present invention from a fully latched position (FIGS. 9A and 9B) to a fully unlatched position (FIG. 9E). Preferably, the latch member 506 is non-aligned (by angle differential B) with intermediate member 504 and the catch member 510, which provides a more secure latch by creating inward torque towards a latching position. It should be noted that the lever assembly 508 being separate from latch 506 provides added leverage that facilitates unlatching latch 506 to free open lid 106 even if lid 106 is tightly engaged with bin due to bin 104 being full (or somewhat overfull). When bin 104 is tilted, weight assembly 212 of lever 508 causes lever 508 to pivot, thus pushing latch member 506 away from catch member 510 to unlatch latch member 506 from catch member 510. This unlatches lid 106 from bin 104 to open.

FIGS. 9F to 9H are non-limiting, exemplary illustrations of the various view of mounting member 502, which is comprised of a connection section 512 with connection openings 513 to connect with lid 106 of bin 104. Mounting member 502 further includes a first pivot point 514 (e.g., a first hinge barrel (opening) 515) that moveably couples intermediary member 504 with mounting member 502 by a fastener (e.g., a first rivet 528), enabling intermediary member 504 to rotate at first pivot point 514.

FIGS. 9I to 9K are non-limiting, exemplary illustrations of the various view of intermediate (or adapter) member 504, which is comprise of a first and a second longitudinally extending lateral bars 516 and 518 and a third transversely extending bar 520 connected to the first and the second bars 516 and 518. First and second distal ends 521 and 522 of first and second bars 516 and 518 include respective first and second set of hinge knuckles 524 and 526, with first set of hinge knuckles 524 moveably coupled with mounting member 502 at first pivot point 514 by the hinge pin 528, defining a first hinge mechanism 530, and second set of hinge knuckles 526 moveably coupled with latch member 506.

FIGS. 9L and 9M are non-limiting, exemplary illustrations of the various view of latch member 506, which is comprised of a first distal end 532 comprised of a latching portion 534 of latch member 506. Latch member 506 further includes a second pivot point 536 (e.g., a second hinge barrel (opening) 537) that moveably couples latch member 506 with second set of hinge knuckles 526 of intermediary member 504 by a fastener (e.g., second rivet 560), enabling latch member 506 to rotate at second pivot point 536, defining a second hinge mechanism 562. Latch member 506 additionally includes a set of lateral hinge knuckles 540 and 542 moveably coupled with lever assembly 508.

FIGS. 9N and 9O are non-limiting, exemplary illustrations of the various view of lever assembly 508, including weight assembly 212. Lever assembly 508 is comprised of a first lever distal end 544 that defines a leverage point of lever assembly 508 and a second lever distal end 546 that includes weight-mass 222. Lever assembly 508 also includes a third pivot point 548 (e.g., a third hinge barrel (opening) 549) that moveably couples lever assembly 508 with second set of lateral hinge knuckles 526 of latch member 506, by a fastener (e.g., third rivet 564) enabling lever assembly 508 to rotate at third pivot point 548, defining a third hinge mechanism 566.

FIGS. 9P to 9R are non-limiting, exemplary illustrations of the various view of catch member 510, which includes a catch connection section 550 (with connection openings 551) to connect with bin 104, a catching portion 552 that latches latch portion 534 of latch member 506, and a relief 554 that accommodates second hinge barrel 536 of latch member 506. When latch member 506 is latched onto catching portion 552 of catch member 510, second hinge barrel 536 of latch member 506 is received within relief 554, which enables second pivot point 536 to pass the vertical alignment (by an angle β), which prevents unintentional dislodging of latch member 506 from catching portion 552. Without relief 554, a slight upward pressure on latch member 506 (e.g., by opening of lid 106) would unlatch latch member 506 from catch member 510. Accordingly, latch member 506 is non-aligned (by angle differential B) with intermediate member 504, which provides a more secure latch by creating inward torque towards a latching position.

FIGS. 10A to 10G are non-limiting, exemplary, detailed illustrations of an embodiment of a retainer mechanism or parts thereof illustrated in FIGS. 1A to 9R, detailing an embodiment of a retainer member in accordance with an embodiment of the present invention. Retainer mechanism 600 illustrated in FIGS. 10 to 10G includes similar corresponding or equivalent components, interconnections, functional, operational, and or cooperative relationships as retainer mechanisms (or parts thereof) that are shown in FIGS. 1A to 9R, and described above. Therefore, for the sake of brevity, clarity, convenience, and to avoid duplication, the general description of FIGS. 10A to 10G will not repeat every corresponding or equivalent component, interconnections, functional, operational, and or cooperative relationships that has already been described above in relation to retainer mechanisms or parts thereof that are shown in FIGS. 1A to 9R.

Figure 10A:
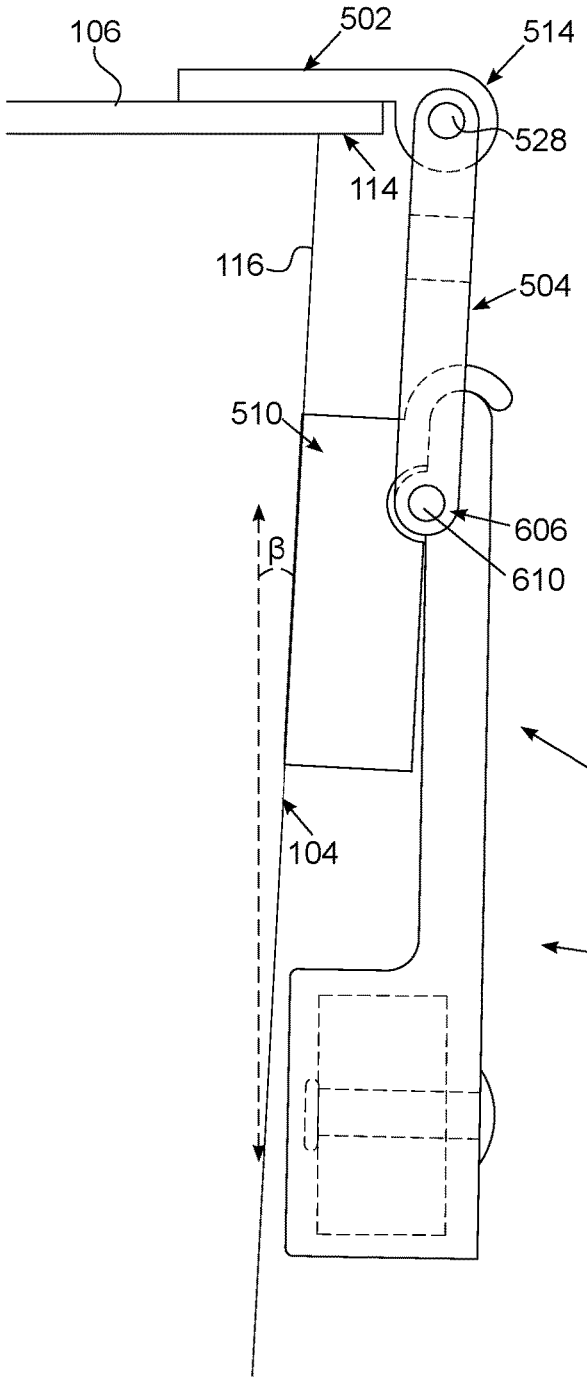
FIGS. 10A to 10G are non-limiting, exemplary, detailed illustrations of an embodiment of a retainer mechanism or parts thereof illustrated in FIGS. 1A to 9R, detailing an embodiment of a retainer member in accordance with one or more embodiments of the present invention.
Figure 10B:
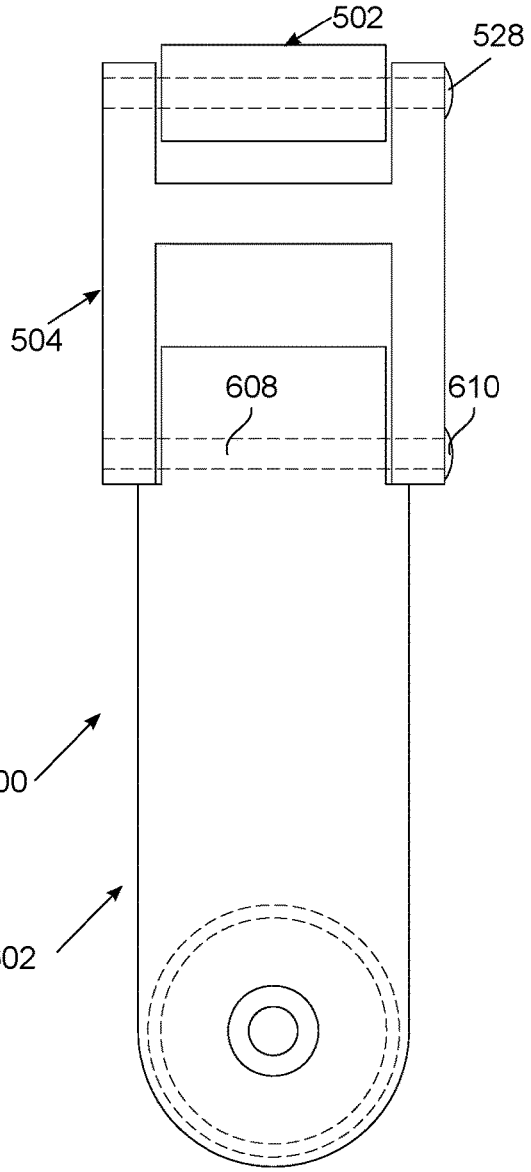
Figure 10C:
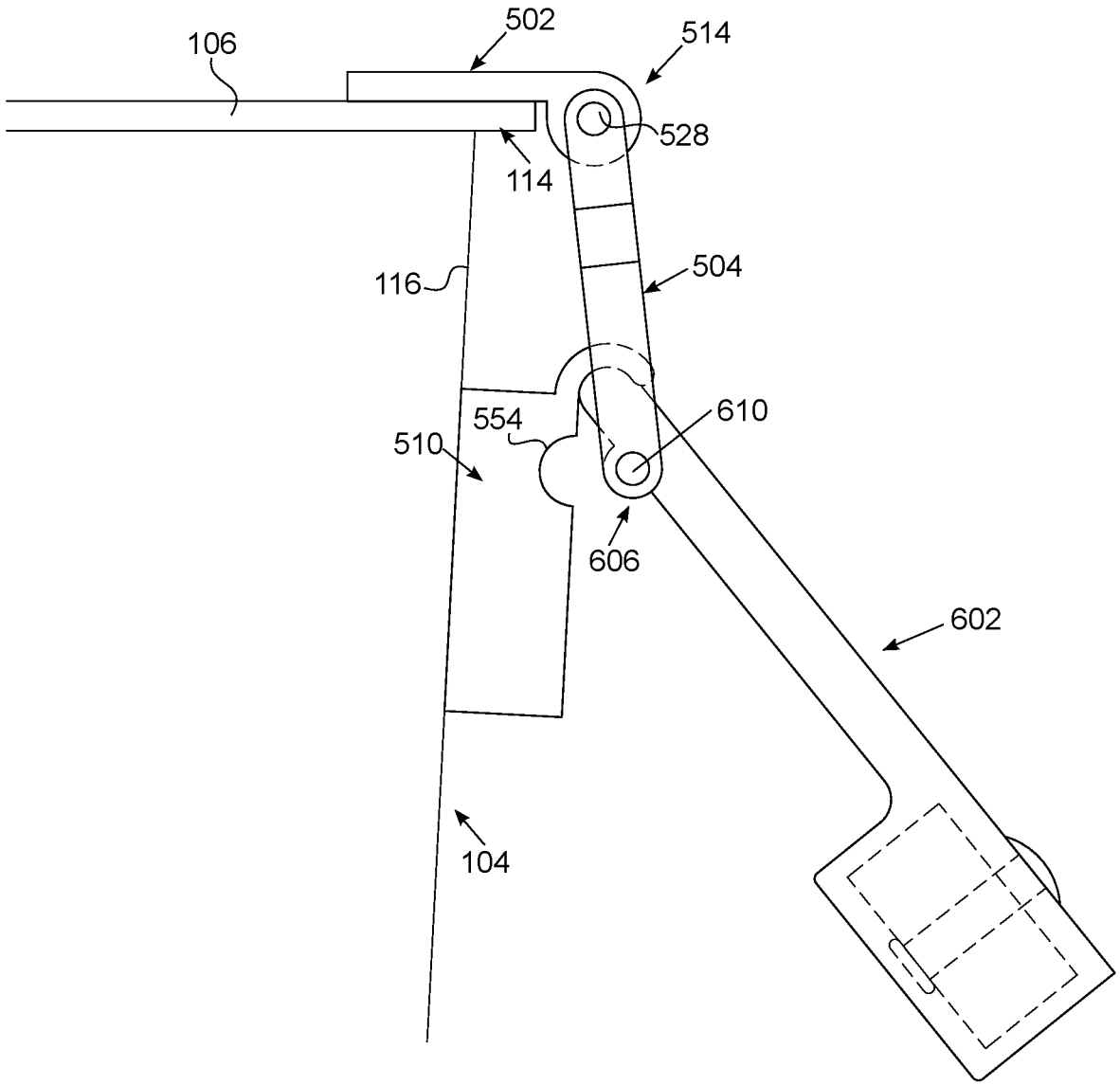
Figure 10D:
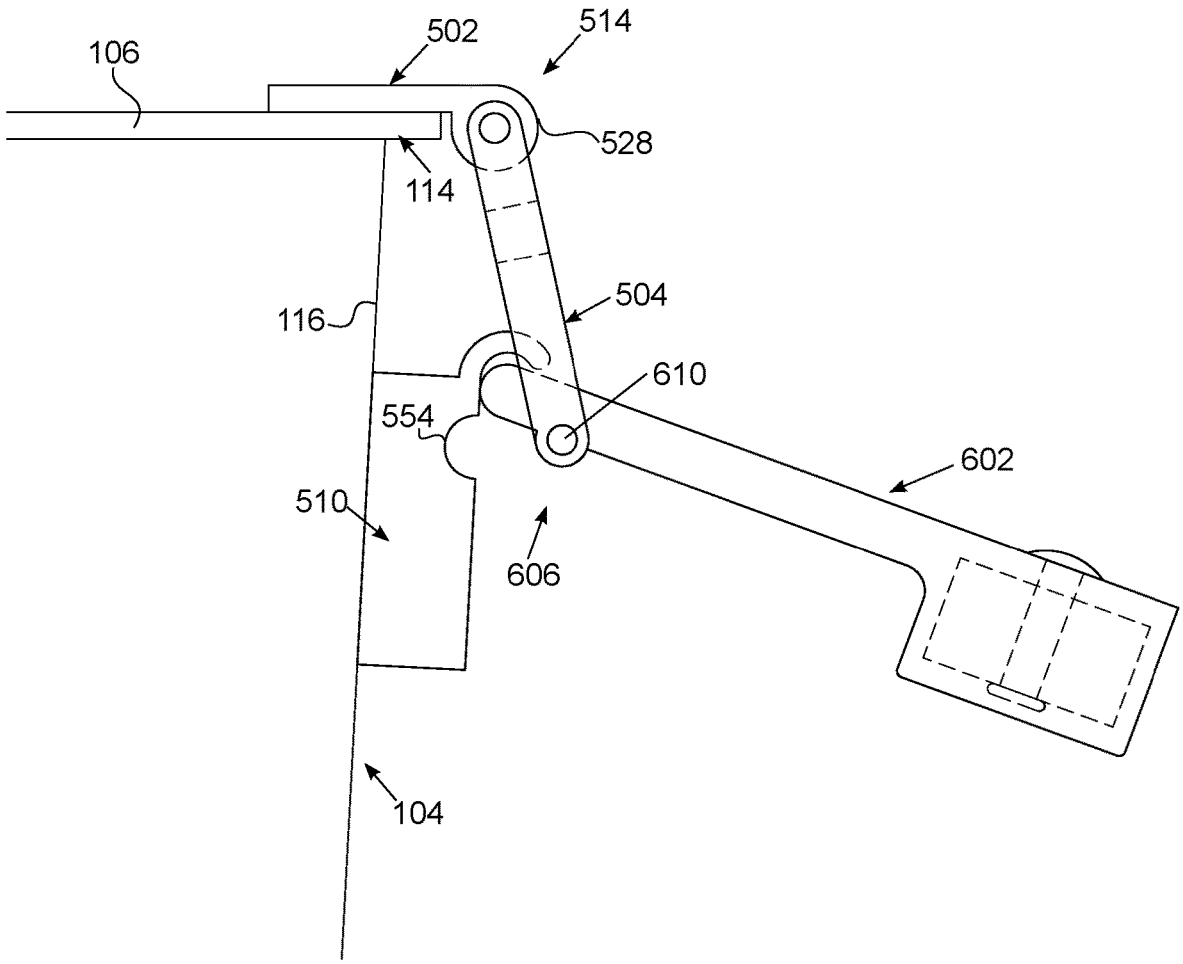
Figure 10E:
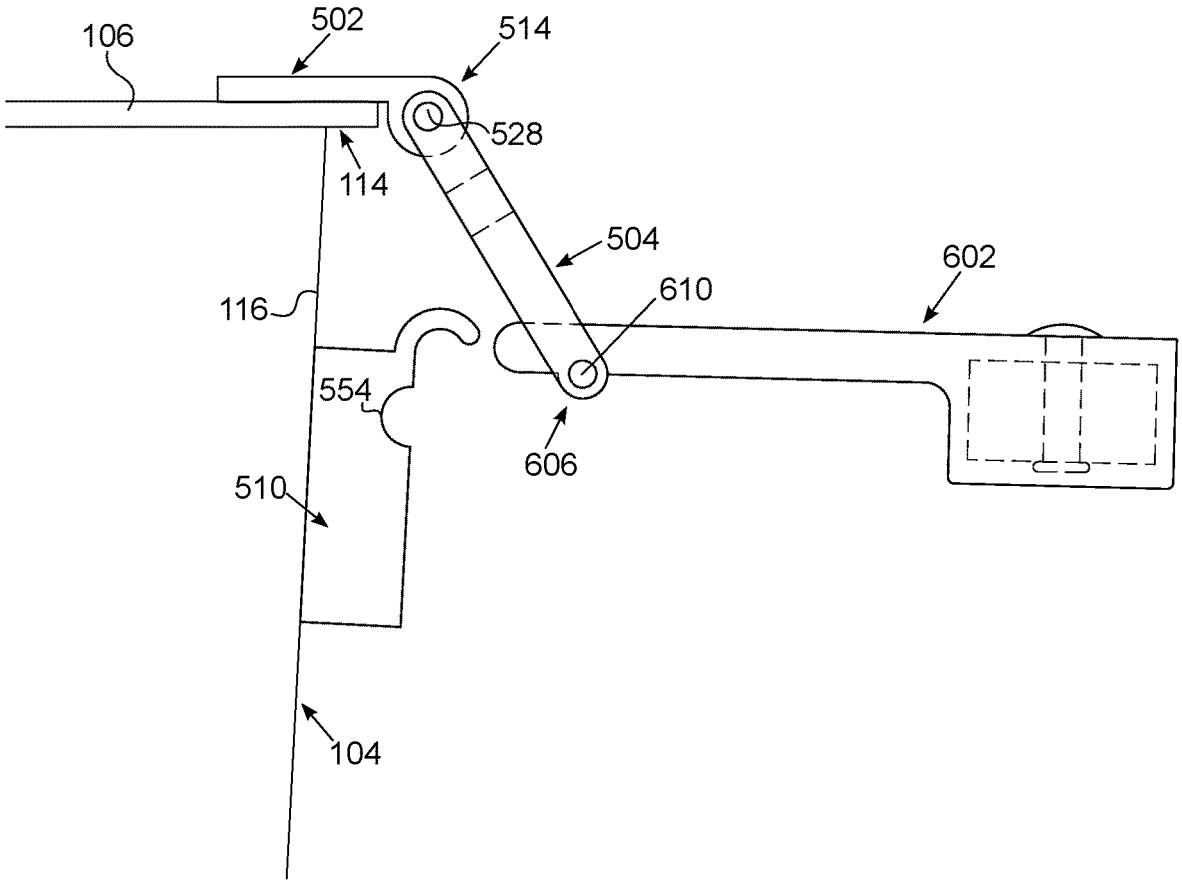
Figure 10F:
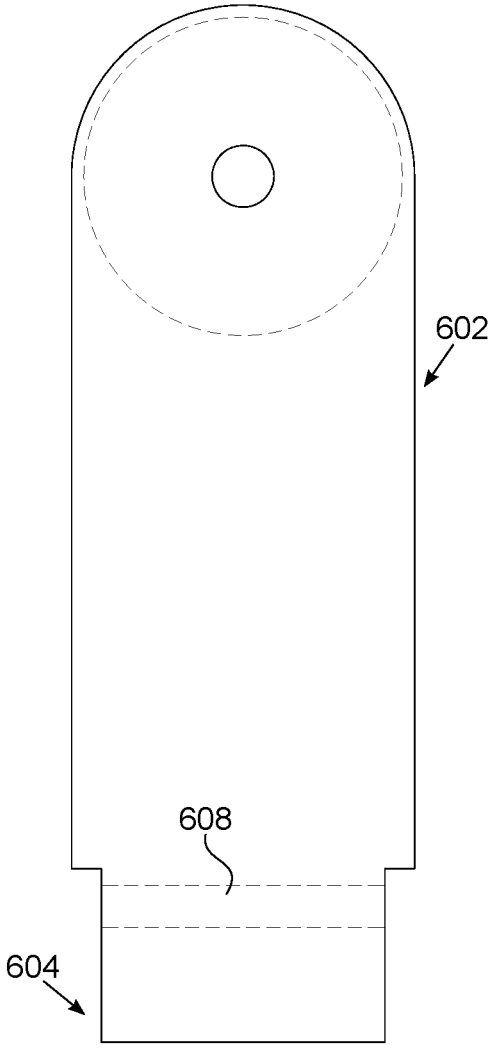
Figure 10G:
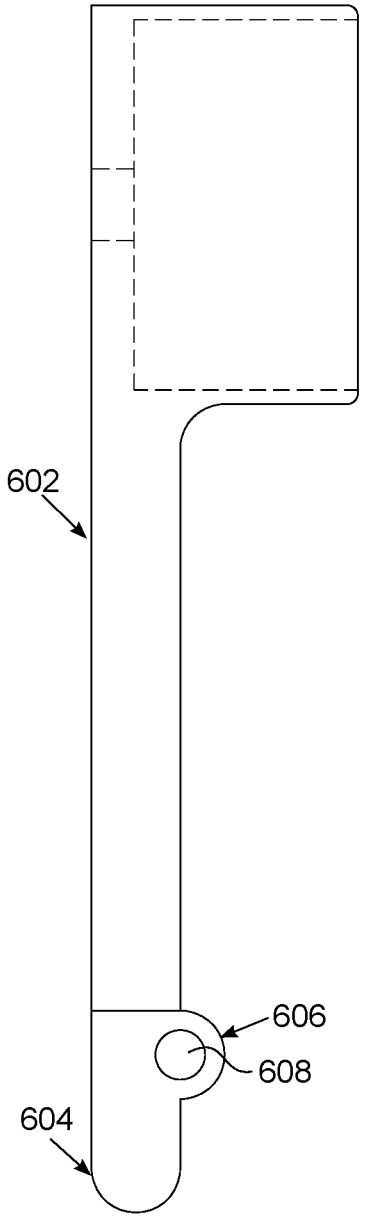

In this non-limiting, exemplary embodiment, latch member 506 is combined with lever assembly 508 of retainer mechanism 500, providing somewhat similar functionality with the retainer mechanism 500 shown in FIGS. 9A to 9R, but with fewer parts. FIGS. 10C to 10E are non-limiting, exemplary illustrations that progressively show securing and eventual release of lid 106 of bin 104 using retainer mechanism 600 in accordance with the present invention from a fully latched position (FIGS. 10A and 10B) to a fully unlatched position (FIG. 10E).

As illustrated, catch member 510 receives and detachably latches a latching end 604 of lever assembly 602 without the need of a separate latch member 506. Further lever assembly 602 includes pivot point 606 (e.g., hinge barrel opening 608) that moveably couples lever assembly 602 with second set of hinge knuckles 526 of intermediary member 504 by a fastener (e.g., a rivet 610), enabling lever assembly 602 to rotate at pivot point 606. When lever assembly 602 is latched onto catching portion 552 of catch member 510, hinge barrel opening 608 is received within relief 554, which enables pivot point 606 to pass the vertical alignment (by an angle β), which prevents unintentional dislodging of lever assembly 602 from catching portion 552. Without relief 554, a slight upward pressure on lever assembly 602 (e.g., by opening of lid 106) would unlatch lever assembly 602 from catch member 510.

It should be noted that the preferred embodiment (retainer mechanism 500 shown in FIGS. 9A to 9R) provides for a shorter lever length and use of lesser weight mass (not as heavy) for proper operation. In other words, with retainer mechanism 500, it would take less force to unlatch lid 106 from bin 104 compared with retainer mechanism 600. In other words, for retainer mechanism 600 to unlatch, the weight and the lever need to overcome the pull of the lid thus requiring more weight and more torque. The retainer mechanism 500 has intermediate (or adapter) member 504, which isolates the force of the pull of the lid from the lever therefore the lever and the associate weight only need to dislodge 506 since the lever doesn't feel the pull of the lid.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A device, comprising:

a retainer member that is associated with one of a bin and a lid of the bin; and an adjusting member associated with one of the bin and the lid of the bin and further, the retainer member;

the adjusting member includes a side with an uneven surface;

the retainer member includes:

a mounting support having an engagement section that has an uneven surface;

a weighted lever assembly associated with the mounting support;

the weighted lever assembly is actively moved to one of a hold or a release positions to hold or release the adjusting member;

in the hold position the weighted lever assembly maintains the adjusting member against the engagement section to interlock the uneven surface of the engagement section with the uneven surface of the adjusting member;

the weighted lever assembly is passively moved to the release position by gravitational force when the retainer member is tilted to a specific orientation only, which, in turn, releases the adjusting member, with the released adjusting member freeing the lid for operating the bin.

2. The device as set forth in claim 1, wherein:

the retainer member holds and securely maintains the adjusting member at a fixed position along a length of the adjusting member, which, in turn, holds and securely maintains the lid in relation to an opening of the bin.

3. The device as set forth in claim 1, wherein:

the retainer member holds and securely maintains the adjusting member at a fixed position along a length of the adjusting, member, which, in turn, holds and securely maintains the lid in relation to an opening of the bin that is overfilled, further compacting and securing content of the bin as the adjusting member is tightened in relation to the retainer member.

4. The device as set forth in claim 1, wherein:

the lid is hinged at one side of an opening of the bin forming a hinged lid, with one of the retainer member and the adjusting member associated with the free, front side of the lid.

5. The device as set forth in claim 1, wherein:

the mounting support of the retainer member is sloped at an angle to commensurately offset an angular incline of a slanted side of the bin with which the retainer member is coupled to maintain the lever assembly at a hold position;

wherein: the adjusting member rests against a mounting support, and the mounting, support maintains a resting point for the lever assembly.

6. The device as set forth in claim 1, wherein:

the mounting support of the retainer member is sloped at an angle to facilitate insertion of the adjusting member.

7. The device as set forth in claim 1, wherein:

the mounting support is comprised of mounting mechanism that facilitate the mounting of the mounting support with one of the bin and the lid of the bin.

8. The device as set forth in claim 1, wherein:

the mounting support includes an alignment support that generally supports an apex of a protruded portion of the lever assembly aligned in a sliding contact with a top surface of the adjusting member to impart pressure thereon and move the adjusting member in to a tight engagement with an engagement section of the mounting support by providing maximum pressure on the top surface of the adjusting member.

9. The device as set forth in claim 7, wherein:

a protruded portion of the weighted lever assembly generates a cam action.

10. The device as set forth in claim 1, wherein:

the mounting support further includes lateral supports for supporting the weighted lever assembly on the mounting support.

11. The device as set forth in claim 1, wherein:

a protruded portion of the weighted lever assembly at hold position is, maximally pressed against the adjusting member.

12. The device as set forth in claim 1, wherein:

the mounting support further includes lateral supports that protrude from a base of the mounting support;

the lateral supports in combination with the base define a channel through which the adjusting member is passed and within which the adjusting member engages with, an engagement section of the channel.

13. The device as set forth in claim 12, wherein:

the engagement section of the channel is comprised of the uneven surface to improve grip of the adjusting member with the retainer member.

14. The device as set forth in claim 13, wherein:

the uneven surface of the engagement section of the channel and the uneven surface of the adjusting member have one of saw-tooth and corrugated configuration.

15. The device as set forth in claim 1, wherein:

the adjusting member is comprised of:

a bottom surface that is uneven to improve grip with the associated engagement section of a channel of the mounting support;

a top surface that is substantially smooth to reduce friction with a cam section of the lever assembly; and a distal hinged end that is associated with one of the bin and the lid of the bin.

16. The device as set forth in claim 1, wherein:

the weighted lever assembly includes a cam portion, and is pivotally hinged at the cam portion on the mounting support.

17. A retainer mechanism, comprising:

a retainer member; and an adjusting member associated with the retainer member;

the adjusting member includes a side with an uneven surface;

the retainer member is comprised of:

a mounting support having an engagement section that has an uneven surface; and a weighted lever assembly associated with the mounting support;

the adjusting member is held in hold position by the weighted lever assembly in a hold position, which maintains the uneven surface of the adjusting member to grip the uneven surface of engagement section;

the weighted lever assembly is passively moved to the release position by gravitational force when the retainer member is tilted to a specific orientation only, which, in turn, releases the adjusting member, with the released adjusting member freeing the lid for operating the bin.

18. The retainer mechanism as set forth in claim 17, wherein:

the lever includes a cam portion, and is pivotally hinged at the cam portion on the mounting support.

19. The retainer mechanism as set forth in claim 18, wherein:

the cam portion includes one or more rotating member that facilitate to reduce friction between the cam portion that contacts a top surface of the adjusting member.

20. The retainer mechanism as set forth in claim 18, wherein:

the cam portion is pivotally hinged on the mounting support with fastener.

21. The retainer mechanism as set forth in claim 17, wherein:

the mounting support is comprised of:

a base;

lateral supports that protrude at an angle generally vertically from the base of the mounting support;

the lateral supports in combination with the base define a channel through which the adjusting member is passed and within which the adjusting member engages with an engagement section of a channel-base.

22. The retainer mechanism as set forth in claim 21, wherein:

the base includes attachment holes for mechanically connecting the mounting support onto one of a bin and a lid of the bin.

23. The retainer mechanism as set forth in claim 21, wherein:

the lateral supports include:

a pair of openings that establish a pivot point for the lever assembly.

24. The retainer mechanism as set forth in claim 21, wherein:

channel-base is comprised of:

recessed portion at an insertion side of the mounting support that define lateral projections that extend longitudinally from the insertion side to an engagement section of the channel-base, with the engagement section of the channel near, an extraction side of the retainer member.

25. The retainer mechanism as set forth in claim 21, wherein:

the lateral supports include:

recesses at channel facing sides of the lateral supports that support and facilitate mounting of the weighted lever assembly onto the mounting support;

the recesses define a set of limiters at insertion side and extraction side of the lateral supports, which limit a range of motion of the weighted lever assembly from a fully open position to a fully latched position.

26. The retainer mechanism as set forth in claim 17, wherein:

the weighted lever assembly includes a weighted mass at atop side thereof.

27. The retainer mechanism as set forth in claim 21 wherein:

the lateral supports have a first side;

the first side of lateral supports include:

a first limiter at an insertion side of the mounting support and a second limiter at an extraction side of the mounting support;

the second limiter is an alignment support that generally limit the motion of the lever assembly at rest position while supporting an apex of a protruded portion of the lever assembly aligned in appropriate relative position in a sliding contact with a top surface of the adjusting member to impart pressure thereon and move the adjusting member in to a tight engagement with an engagement section of the mounting support, with the protruded portion providing maximum pressure on the top surface of the adjusting member.

28. A device, comprising:

an adjusting member that is flexible includes a side with an uneven surface;

the adjusting member is detachably associated with a retainer member;

the retainer member includes:

a mounting support that has an engagement section that has an uneven surface; and a movable weighted lever assembly associated with a mounting support;

the weighted lever assembly is actively moved to one of a hold or a release positions to hold or release the adjusting member in relation to the retainer member;

the adjusting member is held in hold position by the weighted lever assembly in the hold position, which maintains the uneven surface of the adjusting member against the uneven surface of the engagement section to securely maintain the adjusting member in the hold position;

the weighted lever assembly is passively moved by gravitational force operating, on the weighted lever assembly to the release position to release the adjusting member from the retainer member when the retainer member is tilted to a specific orientation.

* * * * *